US011468905B2

(12) United States Patent
Sugiura et al.

(10) Patent No.: US 11,468,905 B2
(45) Date of Patent: Oct. 11, 2022

(54) SAMPLE SEQUENCE CONVERTER, SIGNAL ENCODING APPARATUS, SIGNAL DECODING APPARATUS, SAMPLE SEQUENCE CONVERTING METHOD, SIGNAL ENCODING METHOD, SIGNAL DECODING METHOD AND PROGRAM

(71) Applicant: NIPPON TELEGRAPH AND TELEPHONE CORPORATION, Chiyoda-ku (JP)

(72) Inventors: Ryosuke Sugiura, Atsugi (JP); Takehiro Moriya, Atsugi (JP); Noboru Harada, Atsugi (JP); Takahito Kawanishi, Atsugi (JP); Yutaka Kamamoto, Atsugi (JP); Kouichi Furukado, Yokosuka (JP); Junichi Nakajima, Yokosuka (JP); Jouji Nakayama, Musashino (JP); Kenichi Noguchi, Yokosuka (JP); Keisuke Hasegawa, Yokosuka (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 724 days.

(21) Appl. No.: 16/332,583

(22) PCT Filed: Sep. 13, 2017

(86) PCT No.: PCT/JP2017/032991
§ 371 (c)(1),
(2) Date: Mar. 12, 2019

(87) PCT Pub. No.: WO2018/052004
PCT Pub. Date: Mar. 22, 2018

(65) Prior Publication Data

US 2021/0335372 A1 Oct. 28, 2021

(30) Foreign Application Priority Data

Sep. 15, 2016 (JP) ..... JP2016-180196
Jan. 10, 2017 (JP) ..... JP2017-001966

(51) Int. Cl.
*G10L 19/035* (2013.01)
*G10L 19/00* (2013.01)

(52) U.S. Cl.
CPC ..... *G10L 19/035* (2013.01); *G10L 19/0017* (2013.01)

(58) Field of Classification Search
CPC ..... G10L 19/035; G10L 19/0017
See application file for complete search history.

(56) References Cited

U.S. PATENT DOCUMENTS

2007/0063877 A1* 3/2007 Shmunk ..... G10L 19/0204 341/50

FOREIGN PATENT DOCUMENTS

JP 05158495 A * 6/1993
JP 2002123298 A * 4/2002
(Continued)

OTHER PUBLICATIONS

International Search Report dated Nov. 28, 2017 in PCT/JP2017/032991 filed on Sep. 13, 2017.
(Continued)

*Primary Examiner* — Anne L Thomas-Homescu
(74) *Attorney, Agent, or Firm* — Oblon, McClelland, Maier & Neustadt, L.L.P.

(57) ABSTRACT

Performance of an encoding process and a decoding process for a sound signal is enhanced. A representative value calculating part 110 calculates, for each frequency section by a plurality of samples fewer than the number of frequency samples of a sample sequence of a frequency domain signal corresponding to an input acoustic signal, from the sample sequence of the frequency domain signal, a representative value of the frequency section from sample values of
(Continued)

samples included in the frequency section, for each of predetermined time sections. A signal companding part 120 obtains, for each of the predetermined time sections, a frequency domain sample sequence obtained by multiplying a weight according to a function value of the representative value by a companding function for which an inverse function can be defined and each of the samples corresponding to the representative value in the sample sequence of the frequency domain signal, as a sample sequence of a weighted frequency domain signal.

18 Claims, 31 Drawing Sheets

(56) References Cited

FOREIGN PATENT DOCUMENTS

| | | | | |
|---|---|---|---|---|
| JP | 2002353820 A | * | 12/2002 | ..... H04L 1/0066 |
| JP | 2009230154 A | * | 10/2009 | ..... G10L 21/0208 |

OTHER PUBLICATIONS

Schuller, G. D. T., et al., "Perceptual Audio Coding Using Adaptive Pre- and Post-Filters and Lossless Compression", IEEE Transactions on Speech and Audio Processing, Sep. 2002, vol. 10, No. 6, pp. 379-390.

Liebchen, T., et al., "The MPEG-4 Audio Lossless Coding (ALS) Standard—Technology and Applications", in Proc. Audio Engineering Society (AES) 119th Convention, Paper #6589, Oct. 7-10, 2005, total 14 pages.

International Telecommunication Union, "Lossless compression of G.711 pulse code modulation" (Series G: Transmission Systems and Media, Digital Systems and Networks Digital terminal equipments—Coding of voice and audio signals), Recommendation ITU-T G.711. 0, Sep. 2009, total 72 pages.

Extended European Search Report dated Mar. 27, 2020, in Patent Application No. 17850905.55, citing document AA therein, 9 pages.

* cited by examiner

SAMPLE SEQUENCE CONVERTER, SIGNAL ENCODING APPARATUS, SIGNAL DECODING APPARATUS, SAMPLE SEQUENCE CONVERTING METHOD, SIGNAL ENCODING METHOD, SIGNAL DECODING METHOD AND PROGRAM

TECHNICAL FIELD

The present invention relates to a technique for converting a sample sequence derived from a sound signal to a sample sequence compressed or decompressed based on a sample value in the vicinity of the sample sequence in signal processing technology such as sound signal encoding technology.

BACKGROUND ART

Generally, in lossy compression encoding, after a quantizing part 17 quantizes an input signal, a lossless encoding part 18 gives a code by lossless encoding such as entropy encoding, based on the quantized signal, and a multiplexing part 19 outputs a code corresponding to the quantized signal and a code corresponding to a quantization width together as shown in FIG. 1. At the time of decoding, after a demultiplexing part 21 takes out the signal code and the code corresponding to the quantization width, and a lossless decoding part 22 performs lossless decoding of the signal code, a dequantizing part 23 performs dequantization of the quantized signal that has been decoded, to obtain the original signal as shown in FIG. 2.

Especially in lossy compression encoding of a sound signal of voice, music and the like, a method is known in which analysis of the signal by an analyzing part 15 and a filtering process by a filtering part 16 are added before the quantization process of FIG. 1, and a weight appropriate for aural characteristics is given according to the signal so that an error caused by quantization is aurally reduced as shown in FIG. 3 (see Non-patent literature 1). In this conventional method, in addition to the code corresponding to the quantized signal and the code corresponding to the quantization width used for quantization, a code corresponding to a filter coefficient used for filtering is also sent to a decoder as auxiliary information, and the decoder obtains the original signal by an inverse filtering part 24 performing inverse filtering of the weighted signal that has been decoded, as post-processing of the dequantization process of FIG. 2, as shown in FIG. 4.

PRIOR ART LITERATURE

Non-Patent Literature

Non-patent literature 1: Gerald D. T. Schuller, Bin Yu, Dawei Huang, and Bernd Edler, "Perceptual Audio Coding Using Adaptive Pre-and Post-Filters and Lossless Compression," IEEE TRANSACTIONS ON SPEECH AND AUDIO PROCESSING, VOL. 10, NO. 6, SEPTEMBER 2002.

SUMMARY OF THE INVENTION

Problems to be Solved by the Invention

In the conventional technique described in Non-patent literature 1, the amount of necessary information increases by the filter coefficient in comparison with simple lossy compression encoding as shown in FIGS. 1 and 2. However, aural weighting is only required to satisfy the following two properties roughly classified, and strict information is often unnecessary. 1. In a frame, a relatively small weight is applied to a large value of a signal or a value of a frequency spectrum of the signal, and a relatively large weight is applied to a small value. 2. In a frame, in the vicinity of a peak of the signal or the frequency spectrum of the signal, a relatively small weight is applied similarly to the peak.

An object of the present invention is to, by having both of the above two properties and converting a sample sequence by pre-processing and post-processing that do not require auxiliary information for the post-processing, enhance aural quality of an encoding process and a decoding process for a sound signal.

Means to Solve the Problems

In order to solve the above problem, a sample sequence converter of a first aspect of the present invention is a sample sequence converter that obtains a weighted frequency domain signal obtained by converting a frequency domain signal corresponding to an input acoustic signal, the weighted frequency domain signal being to be inputted to an encoder encoding the weighted frequency domain signal, or a weighted frequency domain signal corresponding to a weighted time domain signal corresponding to the weighted frequency domain signal obtained by converting the frequency domain signal corresponding to the input acoustic signal, the weighted time domain signal being to be inputted to an encoder encoding the weighted time domain signal, the sample sequence converter comprising: a representative value calculating part calculating, for each frequency section by a plurality of samples fewer than the number of frequency samples of a sample sequence of the frequency domain signal corresponding to the input acoustic signal, from the sample sequence of the frequency domain signal, a representative value of the frequency section from sample values of samples included in the frequency section, for each of predetermined time sections; and a signal companding part obtaining, for each of the predetermined time sections, a frequency domain sample sequence obtained by multiplying a weight according to a function value of the representative value by a companding function for which an inverse function can be defined and each of the samples corresponding to the representative value in the sample sequence of the frequency domain signal, as a sample sequence of the weighted frequency domain signal.

A sample sequence converter of a second aspect of the present invention is sample sequence converter that obtains a frequency domain signal corresponding to a decoded acoustic signal from a weighted frequency domain signal obtained by a decoder or a weighted frequency domain signal corresponding to the weighted time domain signal obtained by the decoder, the sample sequence converter comprising: a companded representative value calculating part calculating, for each frequency section by a plurality of samples fewer than the number of frequency samples of a sample sequence of the weighted frequency domain signal, from the sample sequence of the weighted frequency domain signal, a representative value of the frequency section from sample values of samples included in the frequency section, for each of predetermined time sections; and a signal decompanding part obtaining, for each of the predetermined time sections, a frequency domain sample sequence obtained by multiplying a weight according to a function value of the representative value by a companding function for which an inverse function can be defined and each of the samples corresponding to the representative value in the sample sequence of the weighted frequency domain signal, as a sample sequence of the frequency domain signal corresponding to the decoded acoustic signal.

A sample sequence converter of a third aspect of the present invention is sample sequence converter that obtains a weighted acoustic signal obtained by converting an input acoustic signal, the weighted acoustic signal being to be inputted to an encoder encoding the weighted acoustic signal, or a weighted acoustic signal corresponding to a weighted frequency domain signal corresponding to the weighted acoustic signal obtained by converting the input acoustic signal, the weighted frequency domain signal being to be inputted to an encoder encoding the weighted frequency domain signal, the sample sequence converter comprising: a representative value calculating part calculating, for each time section by a plurality of samples fewer than the number of samples of a sample sequence of the input acoustic signal in a time domain, from the sample sequence of the input acoustic signal, a representative value of the time section from sample values of samples included in the time section, for each of predetermined time sections; and a signal companding part obtaining, for each of the predetermined time sections, a time domain sample sequence obtained by multiplying a weight according to a function value of the representative value by a companding function for which an inverse function can be defined and each of the samples corresponding to the representative value in the sample sequence of the input acoustic signal, as a sample sequence of the weighted acoustic signal.

A sample sequence converter of a fourth aspect of the present invention is a sample sequence converter that obtains a decoded acoustic signal from a weighted acoustic signal in a time domain obtained by a decoder or a weighted acoustic signal in the time domain corresponding to a weighted acoustic signal in a frequency domain obtained by the decoder, the sample sequence converter comprising: a companded representative value calculating part calculating, for each time section by a plurality of samples fewer than the number of samples of a sample sequence of the weighted acoustic signal in the time domain, from the sample sequence of the weighted acoustic signal, a representative value of the time section from sample values of samples included in the time section, for each of predetermined time sections; and a signal decompanding part obtaining, for each of the predetermined time sections, a time domain sample sequence obtained by multiplying a weight according to a function value of the representative value by a companding function for which an inverse function can be defined and each of the samples corresponding to the representative value in the sample sequence of the weighted acoustic signal, as a sample sequence of the decoded acoustic signal.

Effects of the Invention

According to the present invention, it is possible to, by having both of two properties required for aural weighting, and converting a sample sequence by pre-processing and post-processing that do not require auxiliary information for the post-processing, enhance aural quality of an encoding process and a decoding process for a sound signal.

DETAILED DESCRIPTION OF THE EMBODIMENTS

Figure 1:
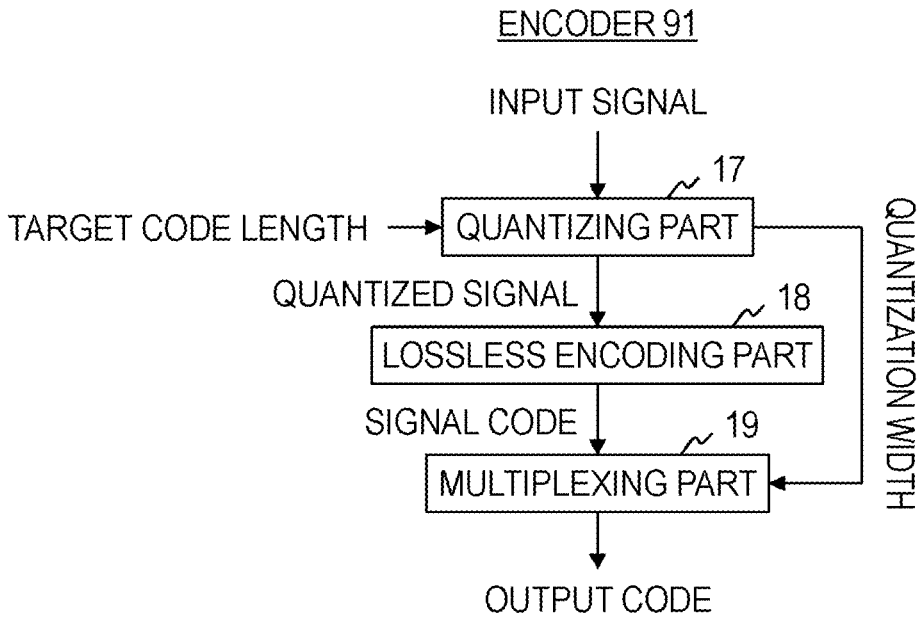
FIG. 1 is a diagram illustrating a functional configuration of a conventional encoder.

Embodiments of the present invention will be described below in detail. In drawings, component parts having the same function are given the same reference numeral, and overlapping description will be omitted.

Though symbols "~", "^", "-" and the like used in sentences are originally those to be shown immediately above characters that are shown immediately after the symbols, they are shown immediately before the characters because of restrictions of the text notation. In formulas, these symbols are shown at the original positions, that is, immediately above the characters.

First Embodiment

A first embodiment of the present invention comprises an encoder 1 and a decoder 2. The encoder 1 encodes a sound signal (an acoustic signal) of voice, music or the like inputted in frames to obtain a code, and outputs the code. The code outputted by the encoder 1 is inputted to the decoder 2. The decoder 2 decodes the inputted code and outputs an acoustic signal in frames.

Figure 2:
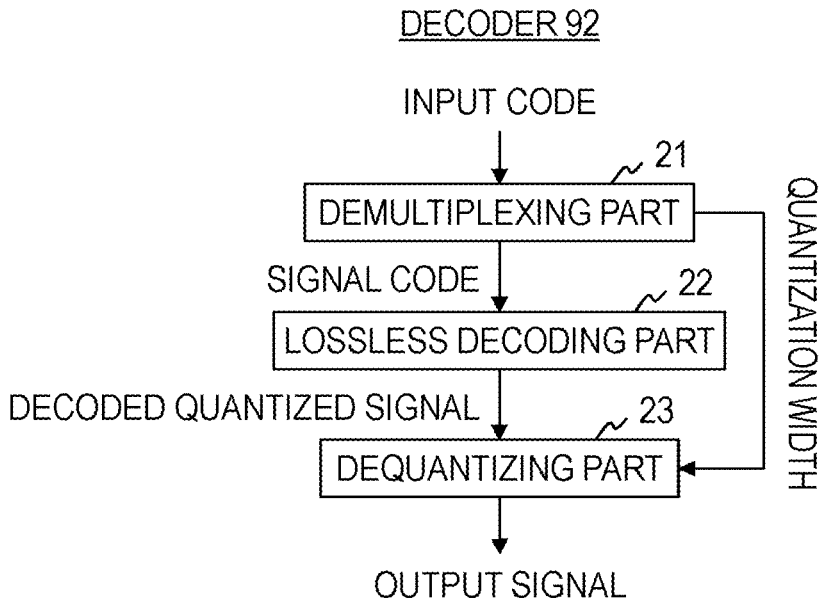
FIG. 2 is a diagram illustrating a functional configuration of a conventional decoder.
Figure 3:
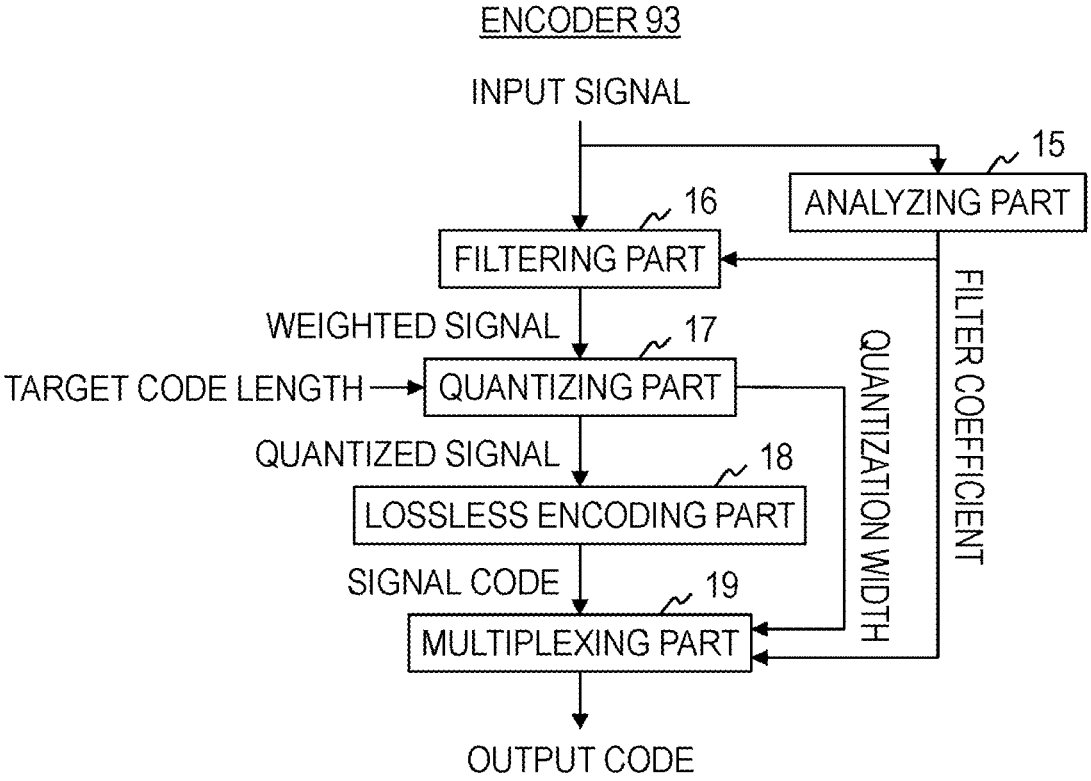
FIG. 3 is a diagram illustrating a functional configuration of a conventional encoder.
Figure 4:
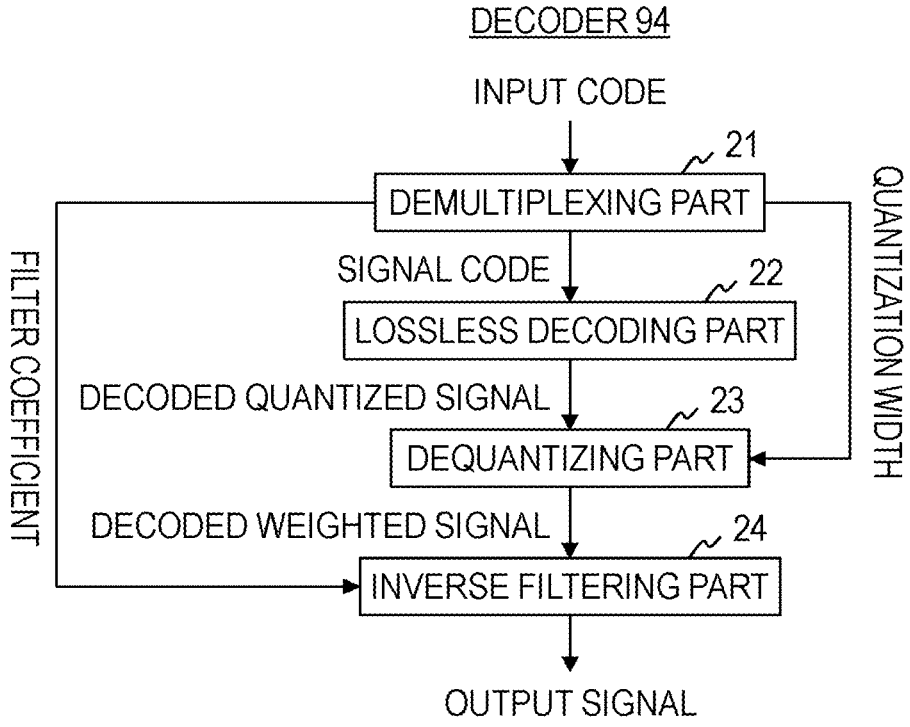
FIG. 4 is a diagram illustrating a functional configuration of a conventional decoder.
Figure 5:
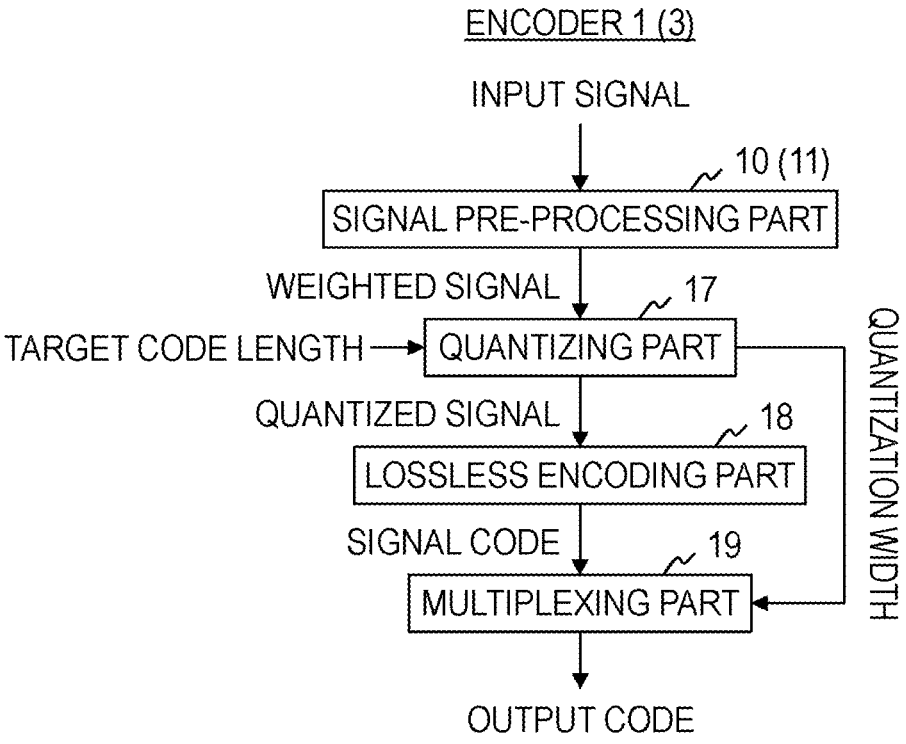
FIG. 5 is a diagram illustrating a functional configuration of encoders of first and second embodiments.
Figure 6:
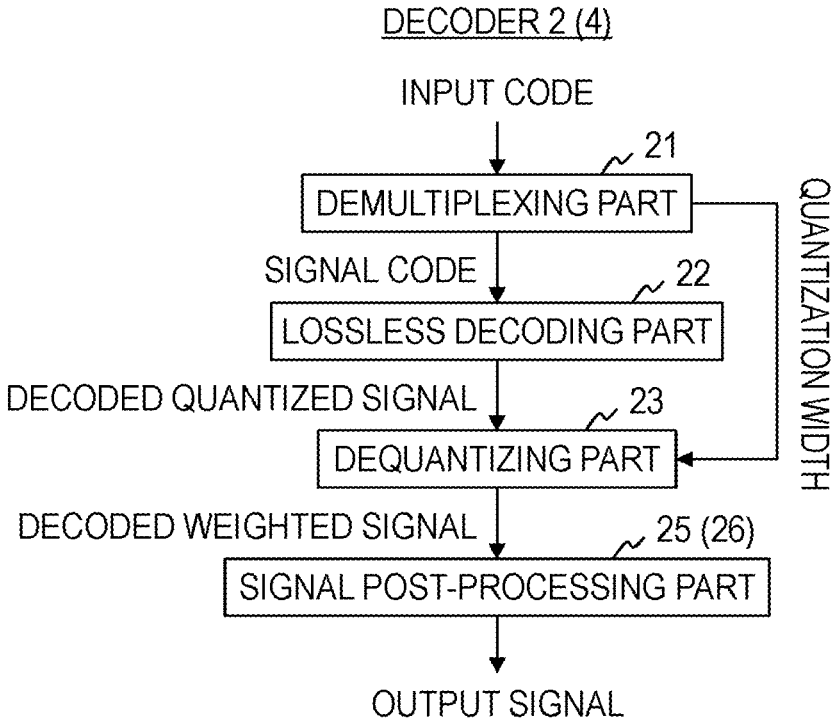
FIG. 6 is a diagram illustrating a functional configuration of decoders of the first and second embodiments.

The encoder 1 of the first embodiment includes a signal pre-processing part 10, a quantizing part 17, a lossless encoding part 18 and a multiplexing part 19 as shown in FIG. 5. That is, the encoder 1 is such that is obtained by adding the signal pre-processing part 10 to a conventional encoder 91 shown in FIG. 1. The decoder 2 of the first embodiment includes a demultiplexing part 21, a lossless decoding part 22, a dequantizing part 23 and a signal post-processing part 25 as shown in FIG. 6. That is, the decoder 2 is such that is obtained by adding the signal post-processing part 25 to a conventional decoder 92 shown in FIG. 2.

Each of the encoder 1 and the decoder 2 is a special apparatus configured by a special program being read in a well-known or dedicated computer having, for example, a central processing unit (CPU), a random access memory (RAM) and the like. For example, each of the encoder 1 and the decoder 2 executes each process under the control of the central processing unit. Data inputted to each of the encoder 1 and the decoder 2 or data obtained by each process is, for example, stored into the random access memory, and the data stored in the random access memory is read out and used for another process as necessary. At least a part of processing parts of each of the encoder 1 and the decoder 2 may be configured with hardware such as an integrated circuit.

Figure 7:
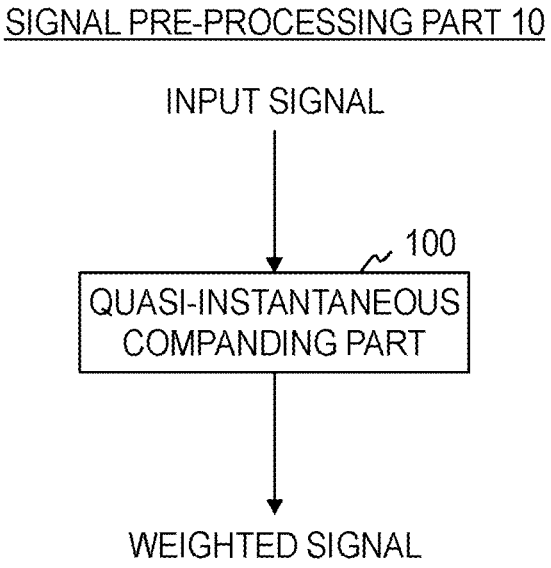
FIG. 7 is a diagram illustrating a functional configuration of a signal pre-processing part of the first embodiment.
Figure 8:
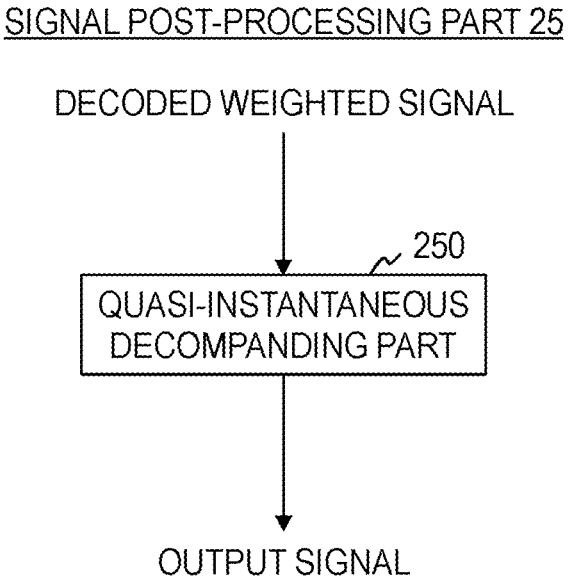
FIG. 8 is a diagram illustrating a functional configuration of a signal post-processing part of the first embodiment.
Figure 9:
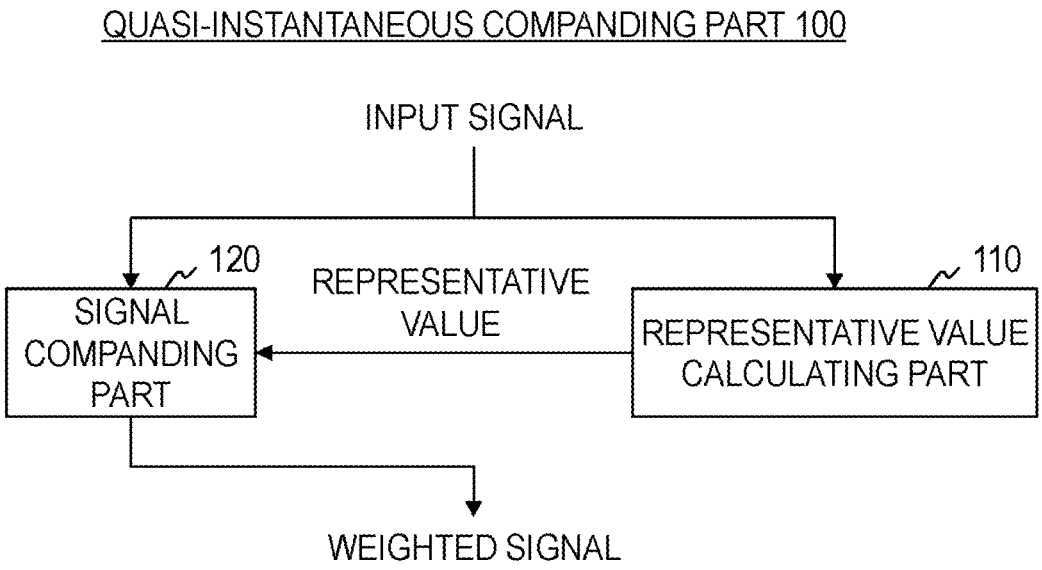
FIG. 9 is a diagram illustrating a functional configuration of a quasi-instantaneous companding part of the first embodiment.
Figure 10:
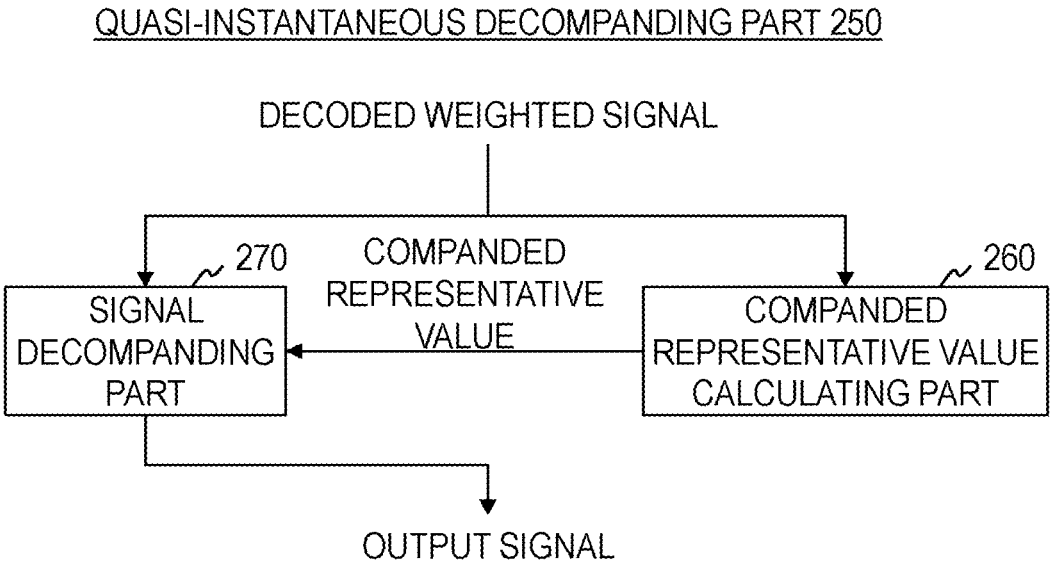
FIG. 10 is a diagram illustrating a functional configuration of a quasi-instantaneous decompanding part of the first embodiment.

The signal pre-processing part 10 of the encoder 1 and the signal post-processing part 25 of the decoder 2 perform a process of "quasi-instantaneous companding". The quasi-instantaneous companding refers to transformation of collectively compressing or decompressing sample values in a predetermined section according to a representative value of the sample values. The signal pre-processing part 10 includes a quasi-instantaneous companding part 100 as shown in FIG. 7. The signal post-processing part 25 includes a quasi-instantaneous decompanding part 250 as shown in FIG. 8. The quasi-instantaneous companding part 100 includes a representative value calculating part 110 and a signal companding part 120 as shown in FIG. 9. The quasi-instantaneous decompanding part 250 includes a companded representative value calculating part 260 and a signal decompanding part 270 as shown in FIG. 10.

The encoder 1 adaptively weights an input signal using quasi-instantaneous companding that does not require auxiliary information as pre-processing to obtain a weighted signal, and performs quantization and lossless encoding similar to the conventional technique for the weighted signal. The decoder 2 performs lossless decoding and dequantization similar to the conventional technique, with a code as an input, and applies weighting opposite to the quasi-instantaneous companding of the encoder 1 to the weighted signal using quasi-instantaneous companding that does not require auxiliary information as post-processing. By these processes, it becomes possible for the encoder 1 and the decoder 2 of the first embodiment to aurally reduce quantization distortion.

<<Encoder 1>>

Figure 11:
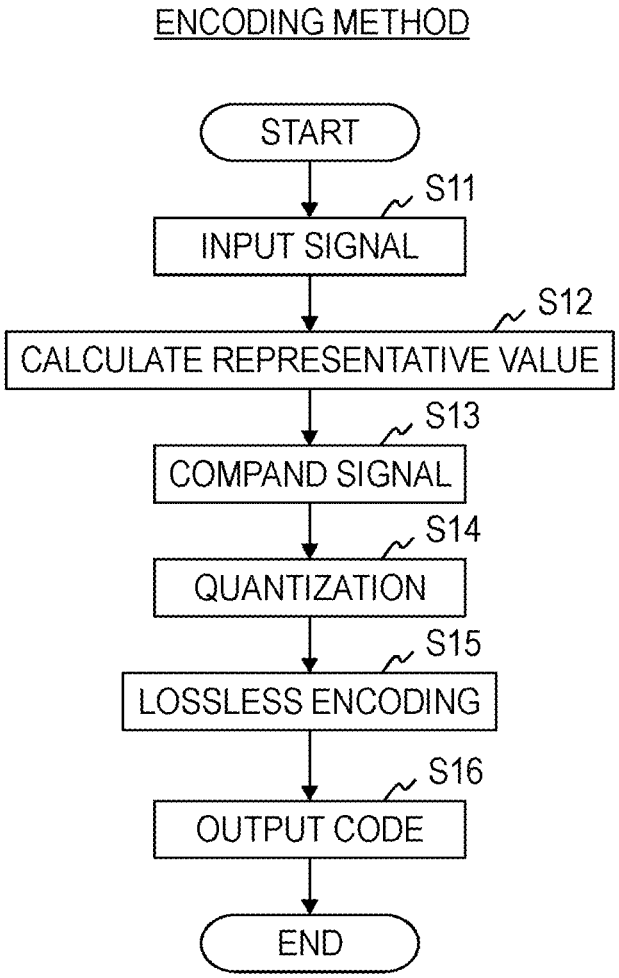
FIG. 11 is a diagram illustrating a process procedure of an encoding method of the embodiments.

A process procedure of an encoding method executed by the encoder 1 of the first embodiment will be described with reference to FIG. 11.

At step S11, a time domain acoustic signal $X_k$ (k=0, . . . , N−1; N (>0) is the number of samples in a predetermined frame; and k is a sample number in the frame) of voice, music or the like is inputted to the encoder 1 in frames. The acoustic signal $X_k$ inputted to the encoder 1 is inputted to the signal pre-processing part 10.

[Signal Pre-Processing Part 10]

The signal pre-processing part 10 receives, for each frame, the acoustic signal $X_k$ (k=0, . . . , N−1) inputted to the encoder 1, performs the process by the quasi-instantaneous companding part 100, and outputs a weighted signal $Y_k$ (k=0, . . . , N−1) to the quantizing part 17.

[Quasi-Instantaneous Companding Part 100]

The quasi-instantaneous companding part 100 receives, for each frame, the acoustic signal $X_k$ (k=0, . . . , N−1) inputted to the encoder 1, performs processes by the representative value calculating part 110 and the signal companding part 120, and outputs the weighted signal $Y_k$ (k=0, . . . , N−1) to the quantizing part 17.

[Representative Value Calculating Part 110]

At step S12, the representative value calculating part 110 receives, for each frame, the acoustic signal $X_k$ (k=0, . . . , N−1) inputted to the quasi-instantaneous companding part 100, calculates a representative value $\bar{X}_m$ (m=1, . . . , N/M) for each section by predetermined M (≤N) samples, and outputs the representative value $\bar{X}_m$ to the signal companding part 120. As the representative value $\bar{X}_m$, a feature value that can be also estimated by the decoder 2 is used.

One predetermined feature value among the following is calculated as the representative value. For example, an average absolute value shown below:

$$\bar{X}_m = \frac{1}{M}\sum_{k=M(m-1)}^{Mm-1} |X_k| \tag{1}$$

Or a root mean square shown below:

$$\bar{X}_m = \sqrt{\frac{1}{M}\sum_{k=M(m-1)}^{Mm-1} |X_k|^2} \tag{2}$$

Or a p-th power root of p-th power mean (p>0) shown below:

$$\bar{X}_m = \sqrt[p]{\frac{1}{M}\sum_{k=M(m-1)}^{Mm-1} |X_k|^p} \tag{3}$$

Or the maximum absolute value shown below:

$$\bar{X}_m = \max_{M(m-1)\le k\le Mm-1} |X_k| \tag{4}$$

Or the minimum absolute value shown below:

$$\bar{X}_m = \min_{M(m-1)\le k\le Mm-1} |X_k| \tag{5}$$

Then, the representative value is outputted.

In order to reduce the amount of operation, the calculation of the representative value may be performed using partial M' (<M) samples in the section by the M samples, for example, as below.

$$\bar{X}_m = \frac{1}{M'}\sum_{k\in G_m} |X_k|,\ (G_m \subseteq [M(m-1), \ldots, Mm-1]) \tag{6}$$

Here, M' indicates the number of samples used to calculate the representative value, and $G_m$ indicates a number of a sample used to calculate the representative value determined in advance.

[Signal Companding Part 120]

At step S13, the signal companding part 120 receives, for each frame, the representative value $\bar{X}_m$ (m=1, . . . , N/M) outputted by the representative value calculating part 110 and the acoustic signal $X_k$ (k=0, . . . , N−1) for each frame inputted from the quasi-instantaneous companding part 100, generates the weighted signal $Y_k$ (k=0, . . . , N−1) as below, and outputs the weighted signal $Y_k$ to the quantizing part 17.

First, the representative value $\bar{X}_m$ is transformed using a companding function f(x). The companding function f(x) is an arbitrary function for which an inverse function $f^{-1}(y)$ can be defined. As the companding function f(x), for example, a generalized logarithmic function as shown below or the like can be used.

$$f(x) = \frac{g\log_\gamma(1+\mu x)}{g\log_\gamma(1+\mu)} \tag{7}$$

$$g\log_\gamma(x) = \begin{cases} \log x & (\text{if } \gamma = 0) \\ \frac{1}{\gamma}(x^\gamma - 1) & (\text{if } \gamma > 0) \end{cases} \tag{8}$$

Here, γ and μ are set to be predetermined positive numbers.

Next, using a representative value $f(\bar{X}_m)$ after transformation by the companding function f(x) and the original representative value $\bar{X}_m$, the sample value $X_k$ of the acoustic signal is converted to a weighted signal $Y_k$ as below for each section by M samples.

$$Y_k = \frac{f(\bar{X}_m)}{\bar{X}_m} X_k\ (k = M(m-1), \ldots, Mm-1) \tag{9}$$

Here, an example of performing two-stage operation has been shown in which the representative value $\bar{X}_m$ is transformed using the companding function f(x) first, and, by multiplying a weight $f(\bar{X}_m)/\bar{X}_m$ according to a function value of the function and the sample value $X_k$, the sample value $X_k$ is converted to the weighted signal $Y_k$. The present invention is, however, not limited to such a calculation method, but any calculation method may be performed if the operation is such that the weighted signal $Y_k$ can be obtained. For example, such calculation that the operation of Formula (9) is performed by one stage may be performed.

The companding function for which an inverse function can be defined is not limited to an operation for a single sample value like Formula (7). For example, a function to output an operation result for each sample with a plurality of samples as arguments may be adopted, or an operation of further performing an operation for which an inverse operation is possible may be included in a function for which an inverse function can be defined to define the function as the companding function.

$$f(\bar{X}_m) \tag{10}$$

For example, the above formula in Formula (9) may be grasped as the companding function.

$$\frac{f(\bar{X}_m)}{\bar{X}_m} \tag{11}$$

Or the above formula in Formula (9) may be grasped as the companding function.

Quasi-instantaneous companding is expressed by simple constant multiplication dependent only on a representative value when seen for each section. Thereby, as far as the feature value given in the description of the representative value calculating part 110 is used, it is also possible for the decoder 2 to estimate the representative value $\bar{X}_m$ from the weighted signal $Y_k$ and perform decompanding without auxiliary information.

[Quantizing Part 17]

At step S14, the quantizing part 17 receives the weighted signal $Y_k$ (k=0, . . . , N−1) for each frame outputted by the signal pre-processing part 10, performs scalar quantization of the weighted signal $Y_k$ to meet a target code length and outputs the quantized signal. For example, similarly to the conventional technique, the quantizing part 17 divides the weighted signal $Y_k$ by a value corresponding to a quantization width to obtain an integer value as a quantized signal. The quantizing part 17 outputs the quantized signal and the quantization width used for quantization to the lossless encoding part 18 and the multiplexing part 19, respectively. As the quantization width, for example, a predetermined quantization value may be used, or the quantization width may be searched for, for example, by, based on a code length as a result of compression by the lossless encoding part 18, increasing the quantization width if the code length is too long for the target code length and decreasing the quantization width if the code length is too short for the target code length. The quantizing part 17 may be caused to operate for each frame with the same number of samples N as the signal pre-processing part 10 or may be caused to operate for every number of samples different from the number of samples of the signal pre-processing part 10, for example, for every number of samples 2N.

[Lossless Encoding Part 18]

At step S15, the lossless encoding part 18 receives the quantized signal outputted by the quantizing part 17, allocates a code corresponding to the quantized signal by lossless encoding, and outputs the signal code. The lossless encoding part 18 outputs the signal code to the multiplexing part 19. As the lossless encoding, for example, general entropy encoding may be used, or an existing lossless encoding method like MPEG-ALS (see Reference Document 1) and G.711.0 (see Reference Document 2) may be used. The lossless encoding part 18 may be caused to operate for each frame with the same number of samples N as the signal pre-processing part 10 or may be caused to operate for every number of samples different from the number of frames of the signal pre-processing part 10, for example, for every number of samples 2N.

[Reference Document 1] T. Liebechen, T. Moriya, N. Harada, Y. Kamamoto, and Y. A. Reznik, "The MPEG-4 Audio Lossless Coding (ALS) standard—technology and applications," in Proc. AES 119th Convention, Paper #6589, October, 2005.

[Reference Document 2] ITU-T G.711.0, "Lossless compression of G.711 pulse code modulation," 2009.

[Multiplexing Part 19]

At step S16, the multiplexing part 19 receives the quantization width outputted by the quantizing part 17 and the signal code outputted by the lossless encoding part 18, and outputs a quantization width code that is a code corresponding to the quantization width and the signal code together as an output code. The quantization width code is obtained by encoding the value of the quantization width. As a method for encoding the value of the quantization width, a well-known encoding method can be used. The multiplexing part 19 may be caused to operate for each frame with the same number of samples N as the signal pre-processing part 10 or may be caused to operate for every number of samples different from the number of frames of the signal pre-processing part 10, for example, for every number of samples 2N.

Figure 12:
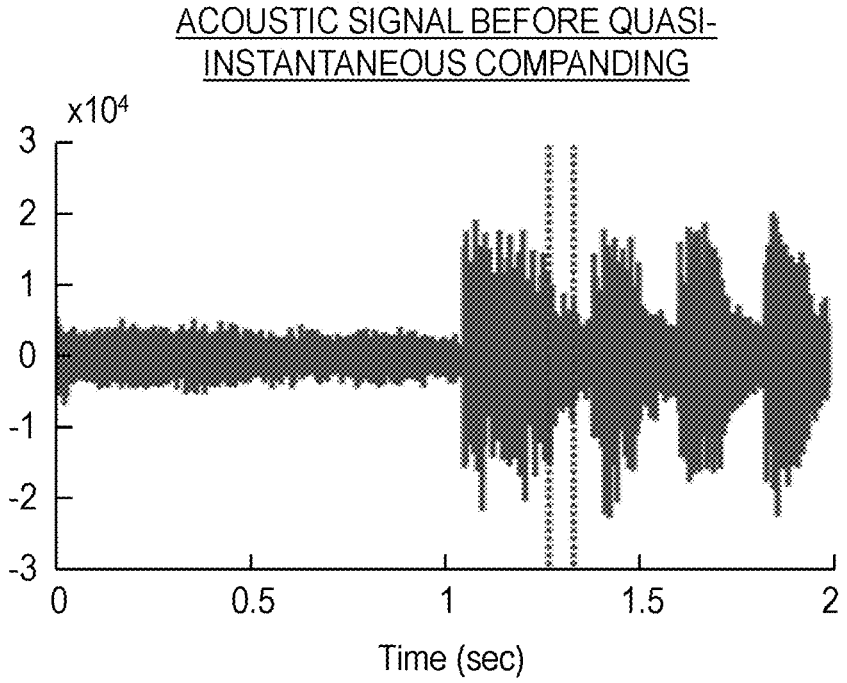
FIG. 12 is a diagram illustrating an acoustic signal before quasi-instantaneous companding.
Figure 13:
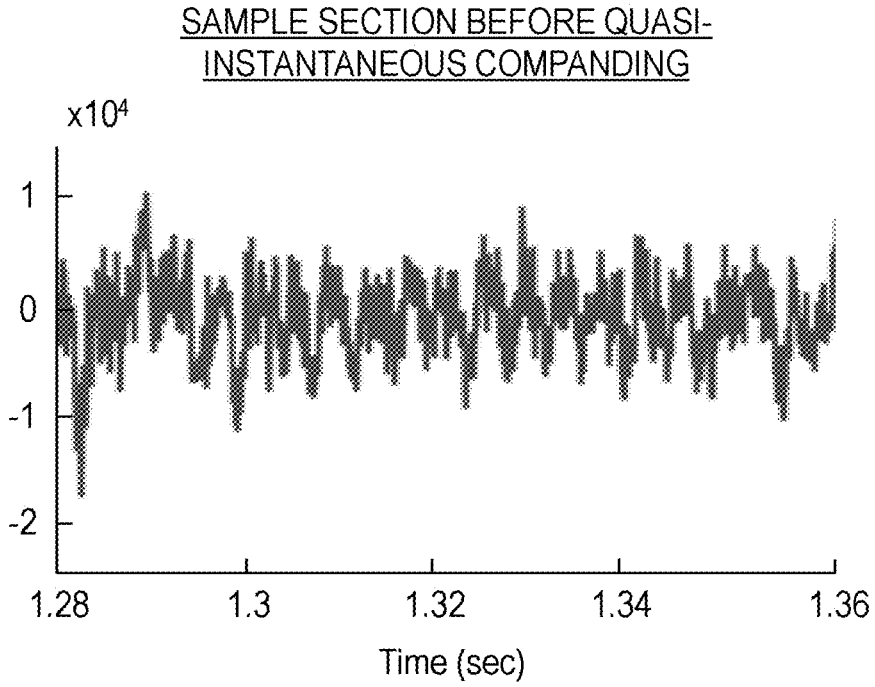
FIG. 13 is a diagram illustrating a sample section before quasi-instantaneous companding.
Figure 14:
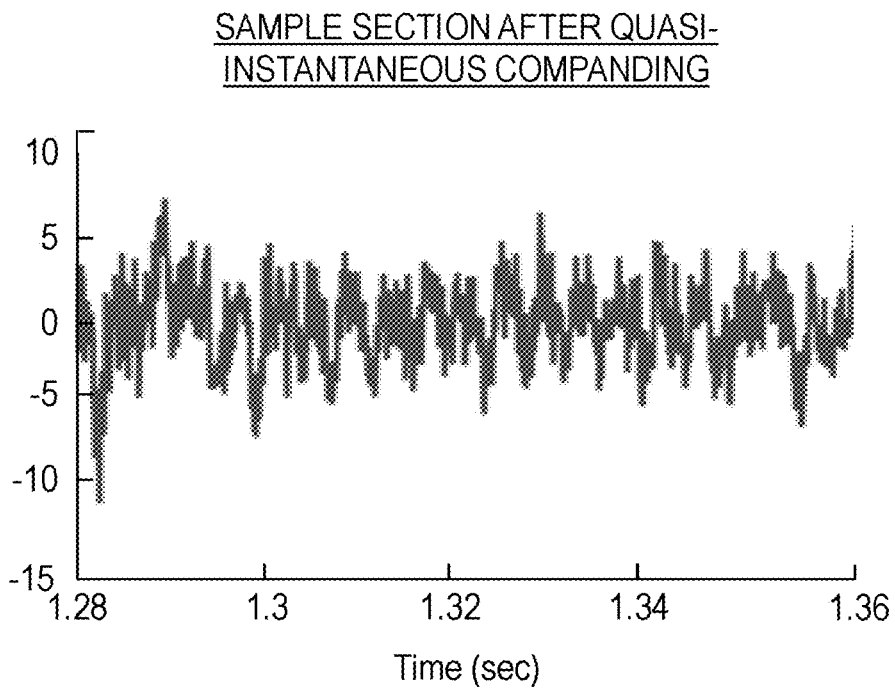
FIG. 14 is a diagram illustrating a sample section after quasi-instantaneous companding.
Figure 15:
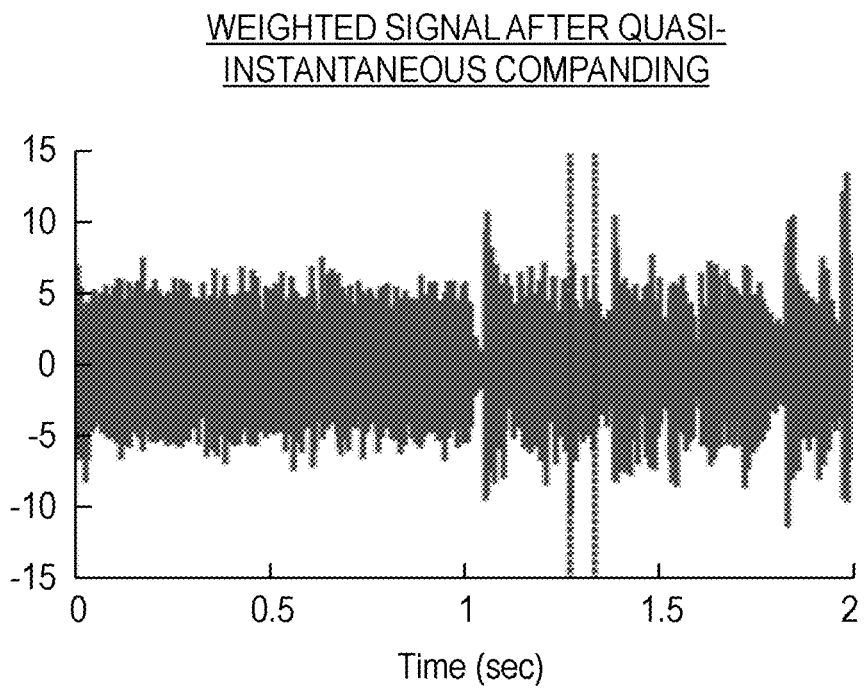
FIG. 15 is a diagram illustrating a weighted signal after quasi-instantaneous companding.

FIGS. 12 to 15 show a specific example of a process of an inputted acoustic signal being converted by the pre-processing of the encoding method of the first embodiment. FIG. 12 shows a signal waveform of the acoustic signal $X_k$ in a time domain. The horizontal axis indicates time, and the vertical axis indicates amplitude. In the example of FIG. 12, the acoustic signal $X_k$ from 0 second to 2 seconds is shown. FIG. 13 shows a signal waveform of the acoustic signal in a section by M samples, which is cut out at a position separated by dotted lines in FIG. 12 in order to calculate a representative value. The representative value is calculated from the M samples included in the section of 1.28 to 1.36 seconds shown in FIG. 13. FIG. 14 shows a signal waveform of a weighted signal in the section by the M samples after weighting is performed according to a function value of the representative value by the companding function. Compared with FIG. 13, it is seen that amplitude values are transformed without the shape of the waveform being changed. FIG. 15 shows a signal waveform of the weighted signal $Y_k$ outputted from the signal pre-processing part finally. Compared with FIG. 12, it is seen that the signal waveform is companded as a whole.

<<Decoder 2>>

Figure 16:
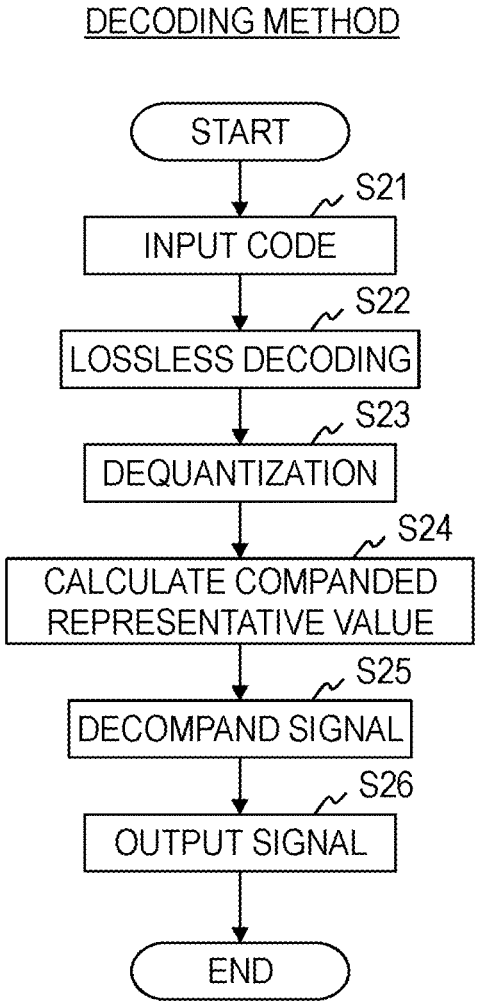
FIG. 16 is a diagram illustrating a process procedure of a decoding method of the embodiments.

A process procedure of a decoding method executed by the decoder 2 of the first embodiment will be described with reference to FIG. 16.

[Demultiplexing Part 21]

At step S21, the demultiplexing part 21 receives a code inputted to the decoder 2 and outputs the signal code and a quantization width corresponding to a quantization width code to the lossless decoding part 22 and the dequantizing part 23, respectively. The quantization width corresponding to the quantization width code is obtained by decoding the quantization width code. As a method for decoding the quantization width code, a decoding method corresponding to a well-known encoding method by which the quantization width has been encoded can be used. Though the signal post-processing part 25 operates for each frame the number of samples of which is N as described below, the demultiplexing part 21 may be caused to operate for each frame with the same number of samples N as the signal post-processing part 25 or may be caused to operate for every number of samples different from the number of frames of the signal post-processing part 25, for example, for every number of samples 2N.

[Lossless Decoding Part 22]

At step S22, the lossless decoding part 22 receives the signal code outputted by the demultiplexing part 21, performs lossless decoding corresponding to the process of the lossless encoding part 18, and outputs a signal corresponding to the signal code to the dequantizing part 23 as a decoded quantized signal. The lossless decoding part 22 may be caused to operate for each frame with the same number of samples N as the signal post-processing part 25 or may be caused to operate for every number of samples different from the number of frames of the signal post-processing part 25, for example, for every number of samples 2N.

[Dequantizing Part 23]

At step S23, the dequantizing part 23 receives the decoded quantized signal outputted by the lossless decoding part 22 and the quantization width outputted by the demultiplexing part 21, and multiplies a value corresponding to the quantization width and each sample value of the decoded quantized signal for each sample to obtain a dequantized signal, for example, similarly to the conventional technique. The dequantizing part 23 outputs the dequantized signal to the signal post-processing part 25 as a decoded weighted signal $\hat{Y}_k$ (k=0, . . . , N−1) for each frame the number of samples of which is N. The dequantizing part 23 may be caused to operate for each frame with the same number of samples N as the signal post-processing part 25 or may be caused to operate for every number of samples different from the number of frames of the signal post-processing part 25, for example, for every number of samples 2N.

[Signal Post-Processing Part 25]

The signal post-processing part 25 receives, for each frame, the decoded weighted signal $\hat{Y}_k$ (k=0, . . . , N−1) outputted by the dequantizing part 23, performs a process by the quasi-instantaneous decompanding part 250, and outputs an output signal $\hat{X}_k$ (k=0, . . . , N−1).

[Quasi-Instantaneous Decompanding Part 250]

The quasi-instantaneous decompanding part 250 receives, for each frame, the decoded weighted signal $\hat{Y}_k$ (k=0, . . . , N−1) inputted from the dequantizing part 23, performs processes by the companded representative value calculating part 260 and the signal decompanding part 270, and outputs an output signal $\hat{X}_k$ (k=0, . . . , N−1).

[Companded Representative Value Calculating Part 260]

At step S24, the companded representative value calculating part 260 receives, for each frame, the decoded weighted signal $\hat{Y}_k$ (k=0, . . . , N−1) outputted by the dequantizing part 23, calculates a representative value $\bar{Y}_m$ (m=1, . . . , N/M) for each section by M samples similarly to the representative value calculating part 110 of the encoder 1 corresponding to the decoder 2, and outputs the representative value to the signal decompanding part 270 as a companded representative value $\bar{Y}_m$. As a method for calculating the companded representative value $\bar{Y}_m$, the same method as the representative value calculating part 110 of the encoder 1 corresponding to the decoder 2 is used.

The example of an average absolute value follows.

$$\bar{Y}_m = \frac{1}{M}\sum_{k=M(m-1)}^{Mm-1} |\hat{Y}_k| \tag{12}$$

The above formula is adopted in the case of an average absolute value.

If the representative value is calculated with a feature value as given in the above description of the representative value calculating part 110, the companded representative value calculated here (at the companded representative value calculating part 260) is equal to a value obtained by transforming the representative value calculated by the representative value calculating part 110 of the encoder 1 with the companding function if there is not distortion due to quantization at the encoder 1 and, even if there is quantization distortion at the encoder 1, is almost the same as the value obtained by transforming the representative value calculated by the representative value calculating part 110 of the encoder 1 by the companding function. Therefore, it is possible to estimate the original representative value by inversely transforming the companded representative value using an inverse function of the companding function at the subsequent-stage signal decompanding part 270.

[Signal Decompanding Part 270]

At step S25, the signal decompanding part 270 receives, for each frame, the companded representative value $\bar{Y}_m$ (m=1, . . . , N/M) outputted by the companded representative value calculating part 260 and the decoded weighted signal $\hat{Y}_k$ (k=0, . . . , N−1) outputted by the dequantizing part 23, generates an output signal $\hat{Y}_k$ (k=0, . . . , N−1) as below, and outputs the output signal.

First, the companded representative value $\bar{Y}_m$ is transformed using an inverse function $f^{-1}(y)$ of a predetermined companding function f(x).

For example, if a generalized logarithmic function is used as the companding function f(x) at the signal companding part 120 of the corresponding encoder 1, the following is used as the inverse function $f^{-1}(y)$.

$$f^{-1}(y) = \frac{1}{\mu}(\mathrm{gexp}_\gamma((\mathrm{gexp}_\gamma(1+\mu))y - 1)) \tag{13}$$

$$\mathrm{gexp}_\gamma(y) = \begin{cases} e^y & (\mathit{if}\ \gamma = 0) \\ (1+\gamma y)^\gamma & (\mathit{if}\ \gamma > 0) \end{cases} \tag{14}$$

Next, using a companded representative value $f^{-1}(\bar{Y}_m)$ after transformation by the inverse function $f^{-1}(y)$ and the original companded representative value $\bar{Y}_m$, the sample value $\hat{Y}_k$ of the decoded weighted signal is converted to a weighted signal $\hat{X}_k$ as below for each section by M samples.

$$\hat{X}_k = \frac{f^{-1}(\bar{Y}_m)}{\bar{Y}_m}\hat{Y}_k\ (k = M(m-1), \ldots, Mm-1) \tag{15}$$

Here, an example of performing two-stage operation has been shown in which the companded representative value $\bar{Y}_m$ is transformed using the inverse function $f^{-1}(y)$ first, and, by multiplying a weight $f^{-1}(\bar{Y}_m)\bar{Y}_m$ according to the function value and the sample value $\hat{Y}_k$, conversion to the output signal $\hat{X}_k$ is performed. The present invention is, however, not limited to such a calculation method, but any calculation method may be performed similarly to the signal companding part 120. For example, such calculation that the operation of Formula (15) is performed by one stage may be performed.

Figure 17:
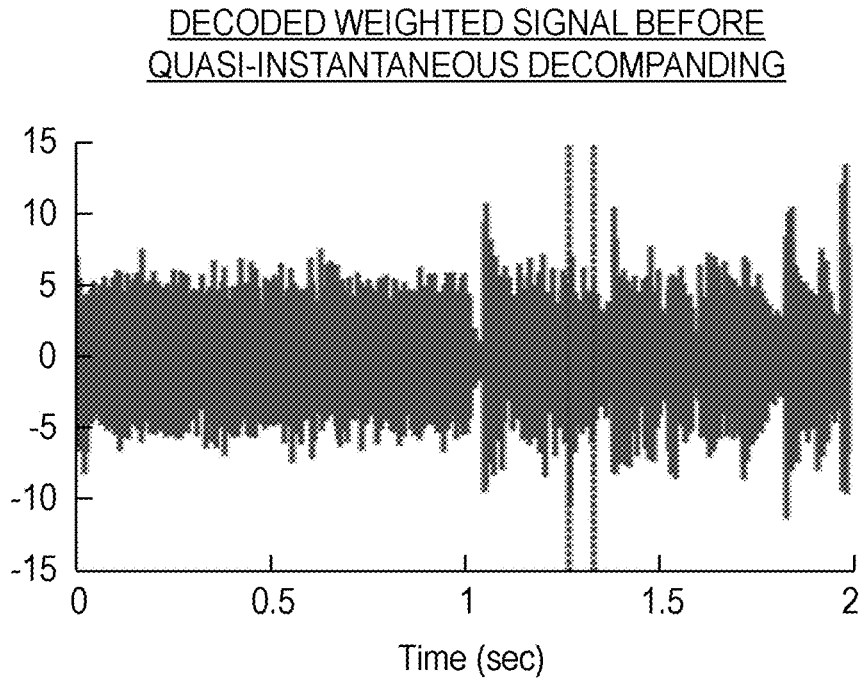
FIG. 17 is a diagram illustrating a decoded weighted signal before quasi-instantaneous decompanding.
Figure 18:
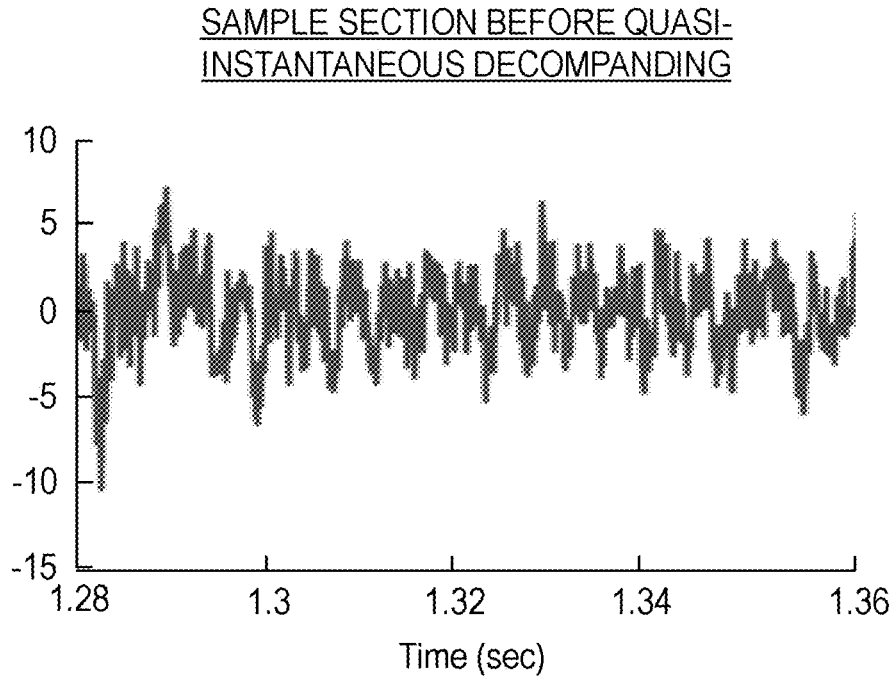
FIG. 18 is a diagram illustrating a sample section before quasi-instantaneous decompanding.
Figure 19:
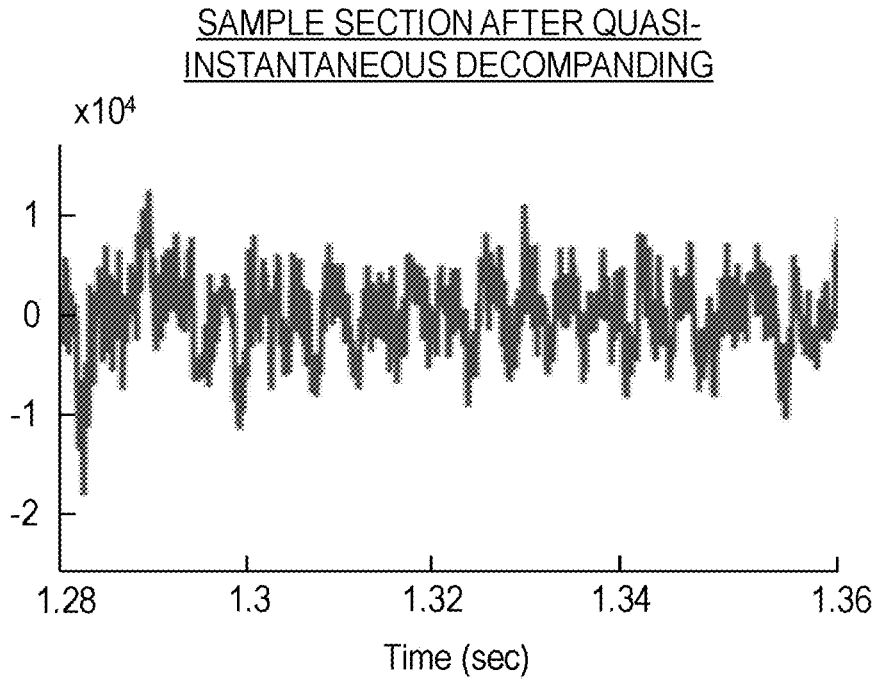
FIG. 19 is a diagram illustrating a sample section after quasi-instantaneous decompanding.
Figure 20:
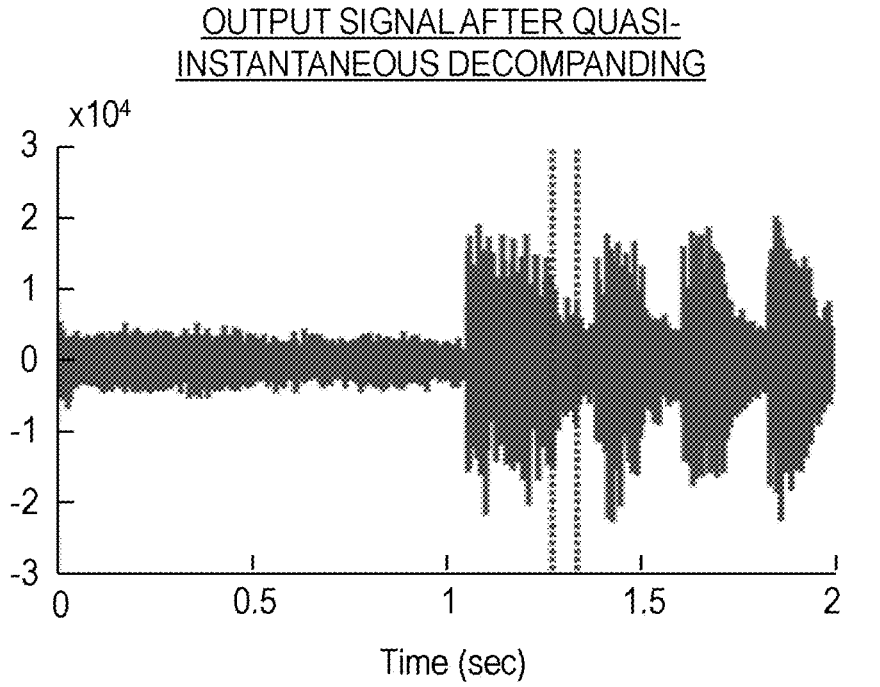
FIG. 20 is a diagram illustrating an output signal after quasi-instantaneous companding.

FIGS. 17 to 20 show a specific example of a process of a decoded weighted signal being converted by the post-processing of the decoding method of the first embodiment. FIG. 17 shows a signal waveform of the decoded weighted signal $\hat{Y}_k$. The horizontal axis indicates time, and the vertical axis indicates amplitude. In the example of FIG. 17, the decoded weighted signal $\hat{Y}_k$ from 0 second to 2 seconds is shown. FIG. 18 shows a signal waveform of the decoded weighted signal in a section by M samples, which is cut out at a position separated by dotted lines in FIG. 17 in order to calculate a companded representative value. The companded representative value is calculated from the M samples included in the section of 1.28 to 1.36 seconds shown in FIG. 18. FIG. 19 shows a signal waveform of an output signal in the section by the M samples after weighting is performed according to a function value of the companded representative value by an inverse function of a companding function. Compared with FIG. 18, it is seen that amplitude values have been transformed though the shape of the waveform has not been changed. FIG. 20 shows a signal waveform of the output signal $\hat{X}_k$ outputted from the signal post-processing part finally. Compared with FIG. 17, it is seen that the signal waveform is decompanded as a whole.

Second Embodiment

Though the signal pre-processing part 10 and the signal post-processing part 25 of the first embodiment perform the quasi-instantaneous companding process for a signal in a time domain, quantization distortion can be also aurally reduced by performing weighting of the signal by quasi-instantaneous companding in a frequency domain. In an encoder 3 and a decoder 4 of the second embodiment, the processes of the signal pre-processing part and the signal post-processing part are performed in a frequency domain.

The encoder 3 of the second embodiment includes a signal pre-processing part 11, the quantizing part 17, the lossless encoding part 18 and the multiplexing part 19 as shown in FIG. 5. That is, compared with the encoder 1 of the first embodiment, the process of the signal pre-processing part is different. The decoder 4 of the second embodiment includes the demultiplexing part 21, the lossless decoding part 22, the dequantizing part 23 and a signal post-processing part 26. That is, compared with the decoder 2 of the first embodiment, the process of the signal post-processing part is different.

Figure 21:
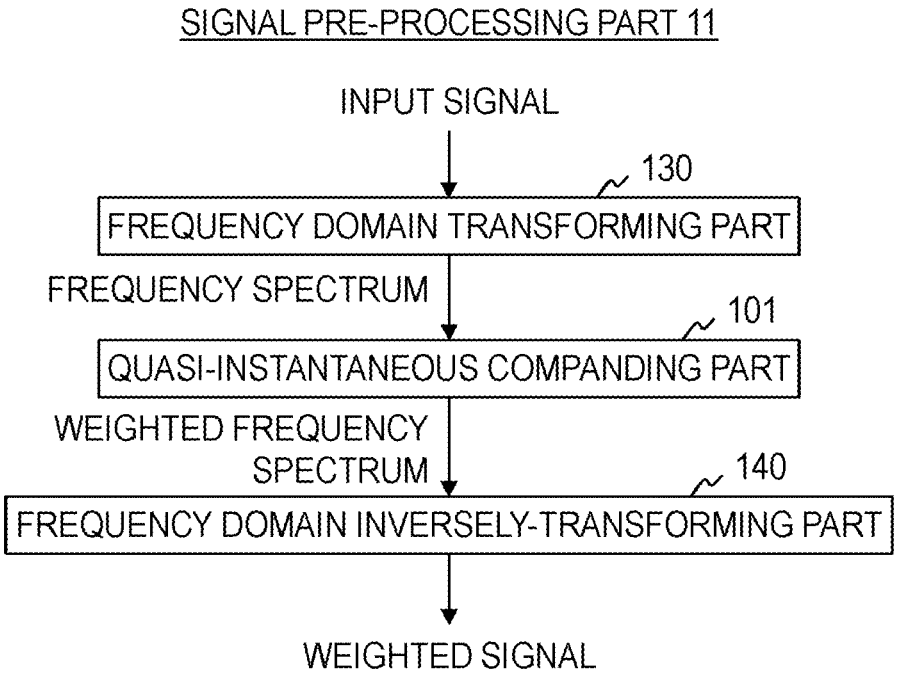
FIG. 21 is a diagram illustrating a functional configuration of a signal pre-processing part of the second embodiment.
Figure 22:
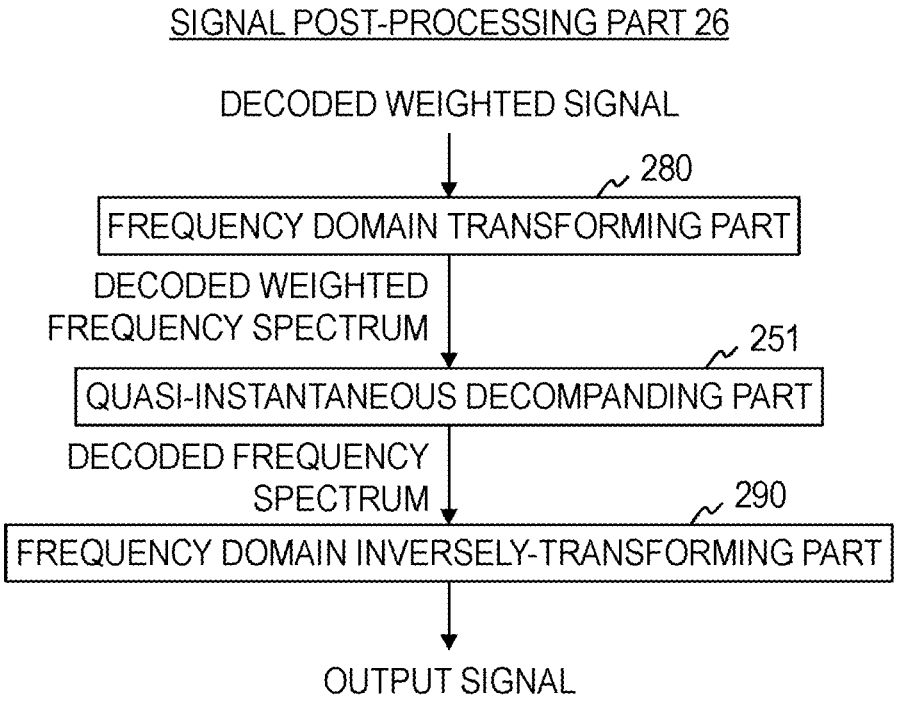
FIG. 22 is a diagram illustrating a functional configuration of a signal post-processing part of the second embodiment.
Figure 23:
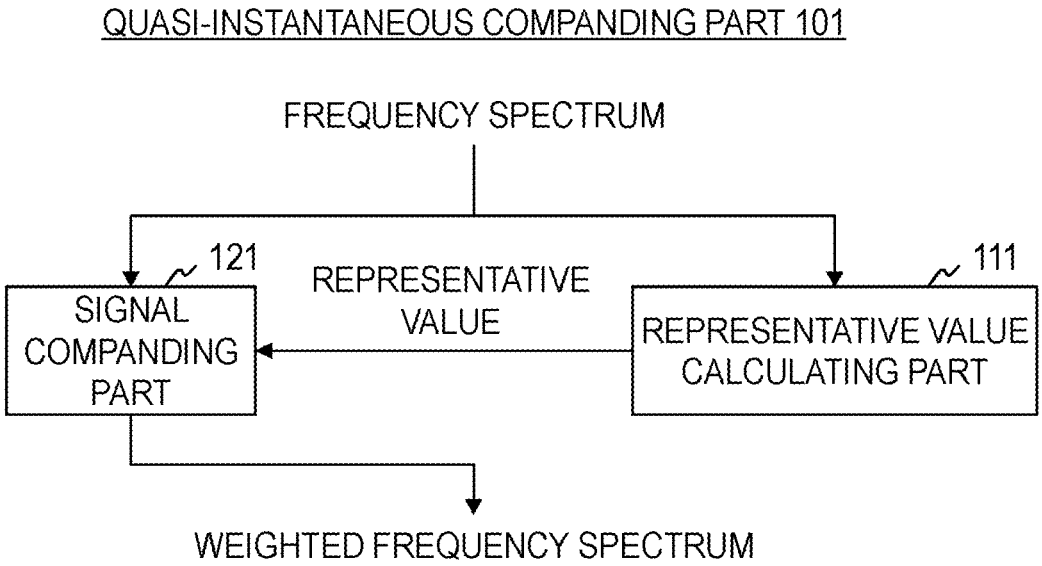
FIG. 23 is a diagram illustrating a functional configuration of a quasi-instantaneous companding part of the second embodiment.
Figure 24:
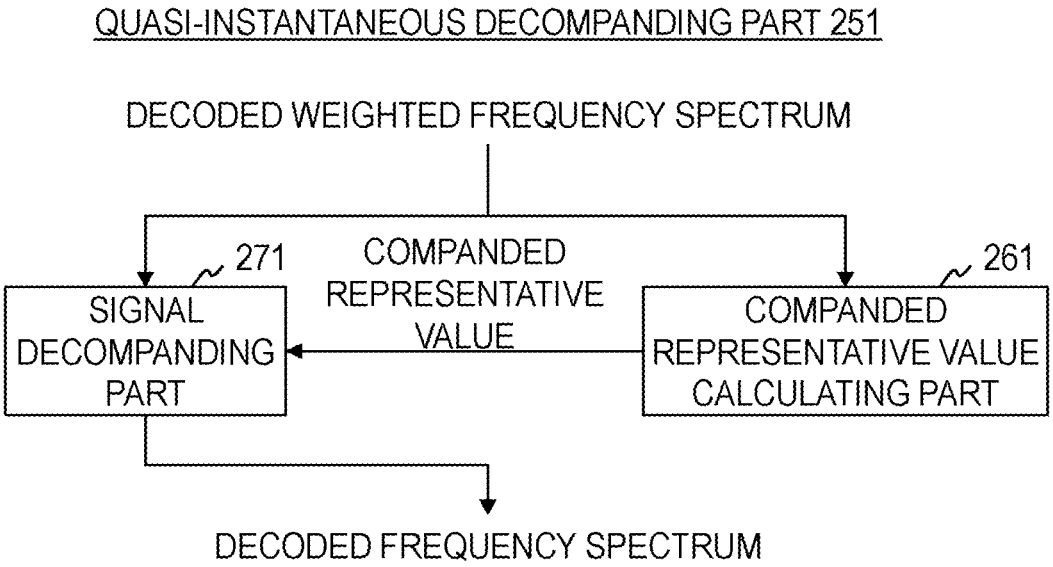
FIG. 24 is a diagram illustrating a functional configuration of a quasi-instantaneous decompanding part of the second embodiment.

The signal pre-processing part 11 includes a frequency domain transforming part 130, a quasi-instantaneous companding part 101 and a frequency domain inversely-transforming part 140 as shown in FIG. 21. The signal post-processing part 26 includes a frequency domain transforming part 280, a quasi-instantaneous decompanding part 251 and a frequency domain inversely-transforming part 290 as shown in FIG. 22. The quasi-instantaneous companding part 101 includes a representative value calculating part 111 and a signal companding part 121 as shown in FIG. 23. The quasi-instantaneous decompanding part 251 includes a companded representative value calculating part 261 and a signal decompanding part 271 as shown in FIG. 24. The quasi-instantaneous companding part 101 and the quasi-instantaneous decompanding part 251 are different from the quasi-instantaneous companding part 100 and the quasi-instantaneous decompanding part 250 of the first embodiment in that an input/output is a frequency spectrum.

<<Encoder 3>>

A time domain acoustic signal $x_n$ (n=0, . . . , N−1; N (>0) is the number of samples in a predetermined frame; and n is a sample number in the frame) of voice, music or the like is inputted to the encoder 3 in frames. The acoustic signal $x_n$ inputted to the encoder 3 is inputted to the signal pre-processing part 11.

[Signal Pre-Processing Part 11]

The signal pre-processing part 11 receives, for each frame, the acoustic signal $x_n$ (n=0, . . . , N−1) inputted to the encoder 3, performs processes by the frequency domain transforming part 130, the quasi-instantaneous companding part 101 and the frequency domain inversely-transforming part 140, and outputs a weighted signal $y_n$ (n=0, . . . , N−1) to the quantizing part 17.

[Frequency Domain Transforming Part 130]

The frequency domain transforming part 130 receives, for each frame, the acoustic signal $x_n$ (n=0, . . . , N−1) inputted to the signal pre-processing part 11, transforms the acoustic signal $x_n$ to a frequency spectrum $X_k$ (k=0, . . . , N−1), for example, by applying discrete cosine transform as below, and outputs the frequency spectrum $X_k$ to the quasi-instantaneous companding part 101.

$$X_k = \frac{1}{\sqrt{N}} \sum_{n=0}^{N-1} x_n \cos \frac{\pi}{N}(n+0.5)(k+0.5) \tag{16}$$

Here, $x_n$ (n=0, . . . , N−1) and $X_k$ (k=0, . . . , N−1) indicate a sample value of the acoustic signal and a sample value of the frequency spectrum, respectively.

[Quasi-Instantaneous Companding Part 101]

The quasi-instantaneous companding part 101 receives, for each frame, the frequency spectrum $X_k$ (k=0, . . . , N−1) outputted by the frequency domain transforming part 130, performs processes by the representative value calculating part 111 and the signal companding part 121, and outputs a weighted frequency spectrum $Y_k$ (k=0, . . . , N−1) to the frequency domain inversely-transforming part 140. The processes of the representative value calculating part 111 and the signal companding part 121 are similar to the processes of the representative value calculating part 110 and the signal companding part 120 of the first embodiment except that the frequency spectrum $X_k$ (k=0, . . . , N−1) is used instead of the acoustic signal $X_k$ (k=0, . . . , N−1) of the first embodiment, and the weighted frequency spectrum $Y_k$ (k=0, . . . , N−1) is obtained instead of the weighted signal $Y_k$ (k=0, . . . , N−1) of the first embodiment.

[Frequency Domain Inversely-Transforming Part 140]

The frequency domain inversely-transfonning part 140 receives, for each frame, the weighted frequency spectrum $Y_k$ (k=0, . . . , N−1) outputted by the quasi-instantaneous companding part 101, transforms the weighted frequency spectrum $Y_k$ to a weighted signal $y_n$ (n=0, . . . , N−1), for example, by applying inverse discrete cosine transform as below, and outputs the weighted signal $y_n$ to the quantizing part 17.

$$y_n = \frac{1}{\sqrt{N}} \sum_{k=0}^{N-1} Y_k \cos \frac{\pi}{N}(n+0.5)(k+0.5) \tag{18}$$

Here, $y_n$ (n=0, . . . , N−1) indicates a sample value of the weighted signal.

Though the weighted signal $y_n$ (n=0, . . . , N−1) of the second embodiment is expressed differently from the weighted signal $Y_k$ (k=0, . . . , N−1) of the first embodiment, it is a weighted signal in a time domain similarly to the first embodiment. Therefore, since the quantizing part 17 and subsequent parts of the second embodiment perform the same operations as the first embodiment, description thereof will be omitted.

<<Decoder 4>>

[Signal Post-Processing Part 26]

The signal post-processing part 26 receives, for each frame, a decoded weighted signal $\hat{y}_n$ (n=0, . . . , N−1)

outputted by the dequantizing part 23, performs processes by the frequency domain transforming part 280, the quasi-instantaneous decompanding part 251 and the frequency domain inversely-transforming part 290, and outputs an output signal $\hat{x}_n$ (n=0, . . . , N−1). The decoded weighted signal $\hat{y}_n$ (n=0, . . . , N−1) of the second embodiment is a decoded weighted signal in a time domain outputted by the dequantizing part 23 similarly to the decoded weighted signal $\hat{Y}_k$ (k=0, . . . , N−1) of the first embodiment though the expression is different.

[Frequency Domain Transforming Part 280]

The frequency domain transforming part 280 receives, for each frame, the decoded weighted signal $\hat{y}_n$ (n=0, . . . , N−1) inputted from the dequantizing part 23, transforms the decoded weighted signal $\hat{y}_n$ to a decoded weighted frequency spectrum $\hat{Y}_k$ (k=0, . . . , N−1) similarly to the frequency domain transforming part 130, and outputs the decoded weighted frequency spectrum $\hat{Y}_k$ to the quasi-instantaneous decompanding part 251.

[Quasi-Instantaneous Decompanding Part 251]

The quasi-instantaneous decompanding part 251 receives, for each frame, the decoded weighted frequency spectrum $\hat{Y}_k$ (k=0, . . . , N−1) outputted by the frequency domain transforming part 280, performs processes by the companded representative value calculating part 261 and the signal decompanding part 271, and outputs a decoded frequency spectrum $\hat{X}_k$ (k=0, . . . , N−1) to the frequency domain inversely-transforming part 290. The processes of the companded representative value calculating part 261 and the signal decompanding part 271 are similar to the processes of the companded representative value calculating part 260 and the signal decompanding part 270 of the first embodiment except that the decoded weighted frequency spectrum $\hat{Y}_k$ (k=0, . . . , N−1) is used instead of the decoded weighted signal $\hat{Y}_k$ (k=0, . . . , N−1) of the first embodiment, and the decoded frequency spectrum $\hat{X}_k$ (k=0, . . . , N−1) is obtained instead of the output signal $\hat{X}_k$ (k=0, . . . , N−1) of the first embodiment.

[Frequency Domain Inversely-Transforming Part 290]

The frequency domain inversely-transforming part 290 receives, for each frame, the decoded weighted frequency spectrum $\hat{X}_k$ (k=0, . . . , N−1) outputted by the quasi-instantaneous decompanding part 251, transforms the decoded weighted frequency spectrum $\hat{X}_k$ to an output signal $\hat{x}_n$ (n=0, . . . , N−1) similarly to the frequency domain inversely-transforming part 140, and outputs the output signal $\hat{x}_n$.

Third Embodiment

The signal pre-processing part 11 and the signal post-processing part 26 perform quasi-instantaneous companding in a frequency domain and, after that, return to a time domain to perform encoding and decoding processes. In a third embodiment, encoding and decoding processes are performed in a frequency domain without returning to a time domain.

Figure 25:
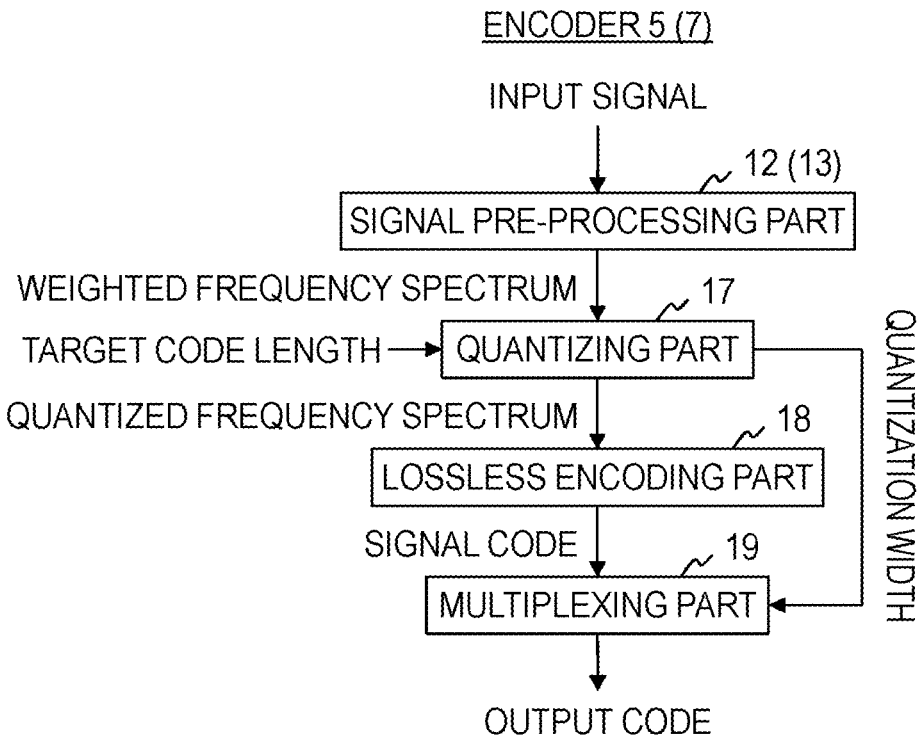
FIG. 25 is a diagram illustrating a functional configuration of encoders of third and fourth embodiments.
Figure 26:
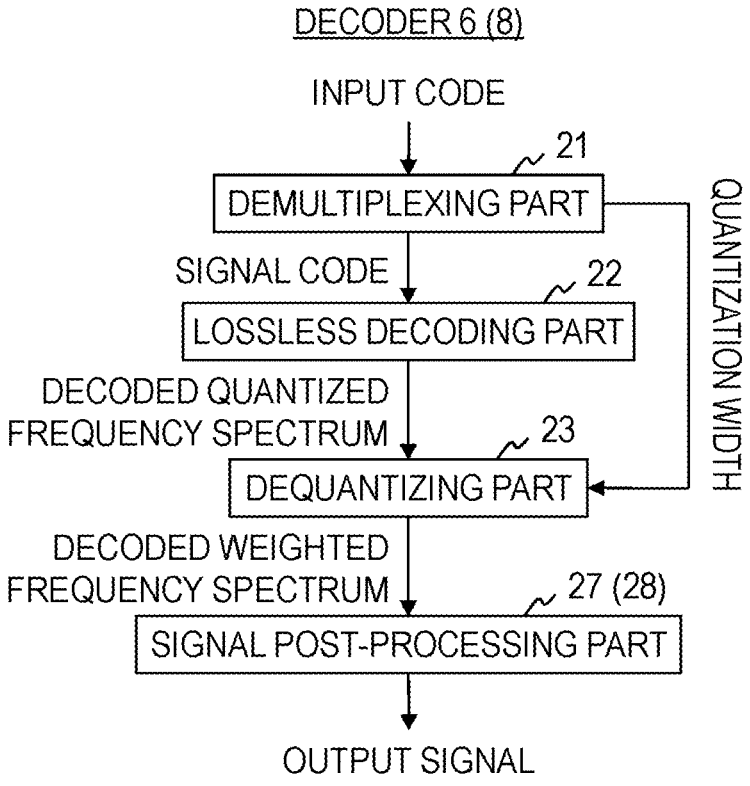
FIG. 26 is a diagram illustrating a functional configuration of decoders of the third and fourth embodiments.

An encoder 5 of the third embodiment includes a signal pre-processing part 12, the quantizing part 17, the lossless encoding part 18 and the multiplexing part 19 as shown in FIG. 25. That is, compared with the encoder 3 of the second embodiment, the process of the signal pre-processing part is different. The decoder 6 of the third embodiment includes the demultiplexing part 21, the lossless decoding part 22, the dequantizing part 23 and a signal post-processing part 27 as shown in FIG. 26. That is, compared with the decoder 4 of the second embodiment, the process of the signal post-processing part is different.

Figure 27:
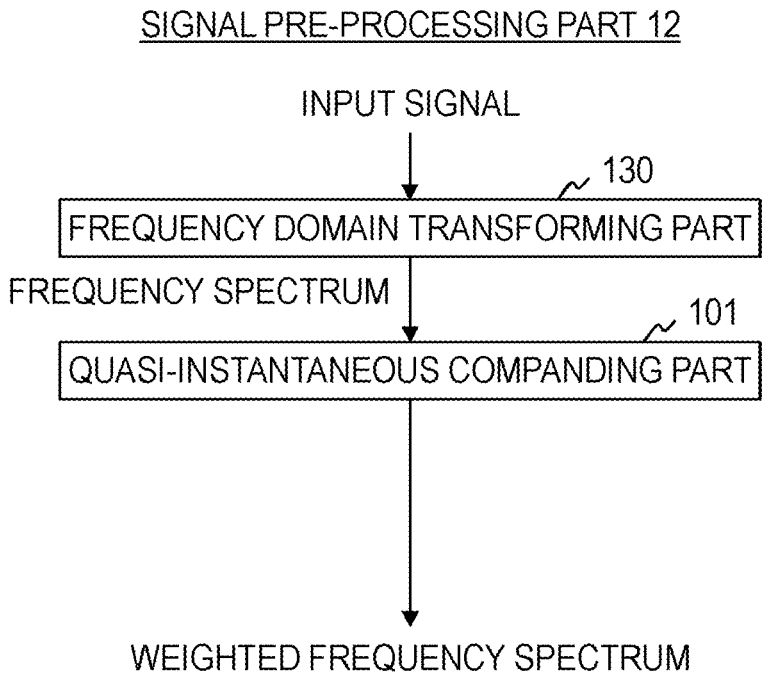
FIG. 27 is a diagram illustrating a functional configuration of a signal pre-processing part of the third embodiment.
Figure 28:
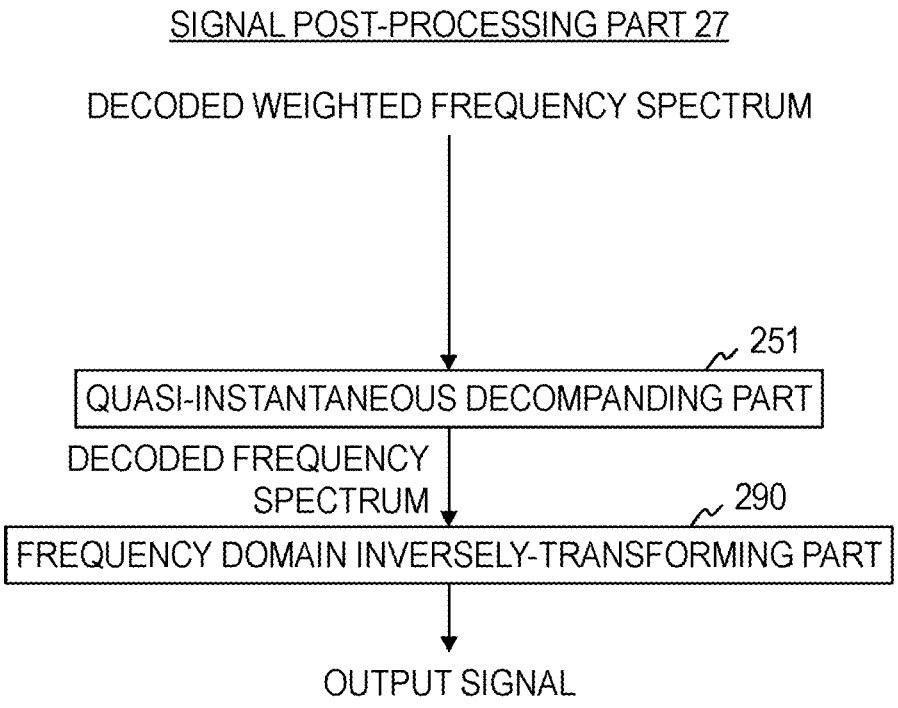
FIG. 28 is a diagram illustrating a functional configuration of a signal post-processing part of the third embodiment.

The signal pre-processing part 12 includes the frequency domain transforming part 130 and the quasi-instantaneous companding part 101 as shown in FIG. 27. That is, compared with the signal pre-processing part 11 of the second embodiment, the signal pre-processing part 12 is different in that it does not include the frequency domain inversely-transforming part 140, and it outputs a weighted frequency spectrum. The signal post-processing part 27 includes the quasi-instantaneous decompanding part 251 and the frequency domain inversely-transforming part 290 as shown in FIG. 28. That is, compared with the signal post-processing part 26 of the second embodiment, the signal post-processing part 27 is different in that it does not include the frequency domain transforming part 280, and a decoded weighted frequency spectrum is inputted. The quantizing part 17, the lossless encoding part 18, the lossless decoding part 22 and the dequantizing part 23 perform processes similar to the processes of the quantizing part 17, the lossless encoding part 18, the lossless decoding part 22 and the dequantizing part 23 of the second embodiment but are different from the second embodiment in that they handle a frequency spectrum instead of a signal in a time domain.

<<Encoder 5>>

[Signal Pre-Processing Part 12]

The signal pre-processing part 12 receives, for each frame, an acoustic signal $x_n$ (n=0, . . . , N−1) inputted to the encoder 5, performs processes by the frequency domain transforming part 130 and the quasi-instantaneous companding part 101, and outputs a weighted frequency spectrum $Y_k$ (k=0, . . . , N−1) to the quantizing part 17. The processes of the frequency domain transforming part 130 and the quasi-instantaneous companding part 101 are similar to the second embodiment described above.

The weighted frequency spectrum $Y_k$ (k=0, . . . , N−1) of the third embodiment is a signal in a frequency domain, and the weighted signal $Y_k$ (k=0, . . . , N−1) of the second embodiment is a signal in a time domain. However, as for the quantizing part 17 and subsequent parts, similar operations are performed regardless of whether a signal is in a time domain or in a frequency domain, and, therefore, description thereof will be omitted.

<<Decoder 6>>

[Lossless Decoding Part 22]

The lossless decoding part 22 receives the signal code outputted by the demultiplexing part 21, performs lossless decoding corresponding to the process of the lossless encoding part 18, and outputs a frequency spectrum corresponding to the signal code to the dequantizing part 23 as a decoded quantized frequency spectrum.

[Dequantizing Part 23]

The dequantizing part 23 receives the decoded quantized frequency spectrum outputted by the lossless decoding part 22 and a quantization width outputted by the demultiplexing part 21, and multiplies a value corresponding to the quantization width and each sample value of the decoded quantized frequency spectrum for each sample to obtain a dequantized signal, for example, similarly to the conventional technique. The dequantizing part 23 outputs the dequantized signal to the signal post-processing part 27 as a decoded weighted frequency spectrum $\hat{Y}_k$ (k=0, . . . , N−1) for each frame the number of samples of which is N.

[Signal Post-Processing Part 27]

The signal post-processing part 27 receives, for each frame, the decoded weighted frequency spectrum $\hat{Y}_k$ (k=0, . . . , N−1) outputted by the dequantizing part 23, performs processes by the quasi-instantaneous decompanding part 251 and the frequency domain inversely-transforming part 290, and outputs an output signal $\hat{x}_n$ (n=0, . . . , N−1). The processes of the quasi-instantaneous decompanding part 251 and the frequency domain inversely-transforming part 290 are similar to the second embodiment described above.

Fourth Embodiment

The signal pre-processing part 10 and the signal post-processing part 25 of the first embodiment perform the quasi-instantaneous companding process with a signal in a time domain, and, after that, perform the encoding and decoding processes in the time domain. In the fourth embodiment, after the quasi-instantaneous companding process is performed for a signal in a time domain, the signal is transformed to a frequency domain to perform encoding and decoding processes.

An encoder 7 of the fourth embodiment includes a signal pre-processing part 13, the quantizing part 17, the lossless encoding part 18 and the multiplexing part 19 as shown in FIG. 25. That is, compared with the encoder 1 of the first embodiment, the process of the signal pre-processing part is different. A decoder 8 of the fourth embodiment includes the demultiplexing part 21, the lossless decoding part 22, the dequantizing part 23 and a signal post-processing part 28 as shown in FIG. 26. That is, compared with the decoder 2 of the first embodiment, the process of the signal post-processing part is different.

Figure 29:
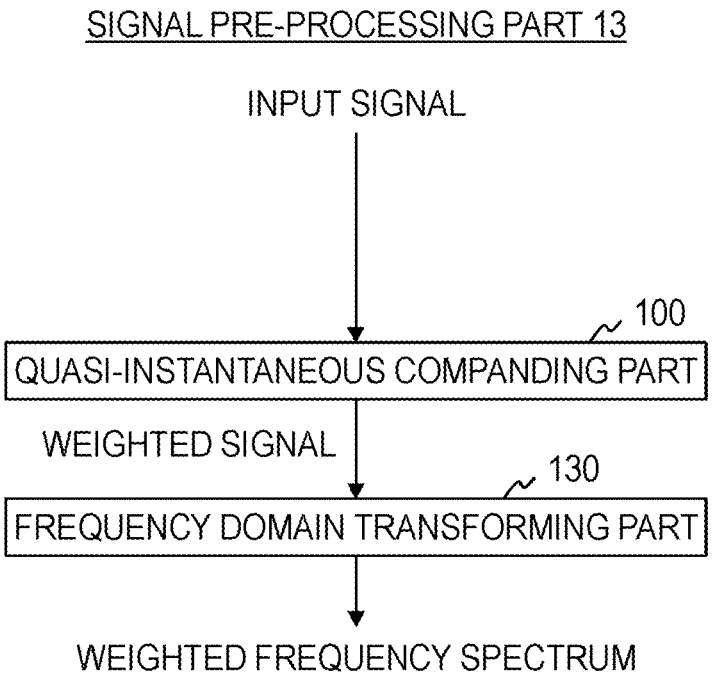
FIG. 29 is a diagram illustrating a functional configuration of a signal pre-processing part of the fourth embodiment.
Figure 30:
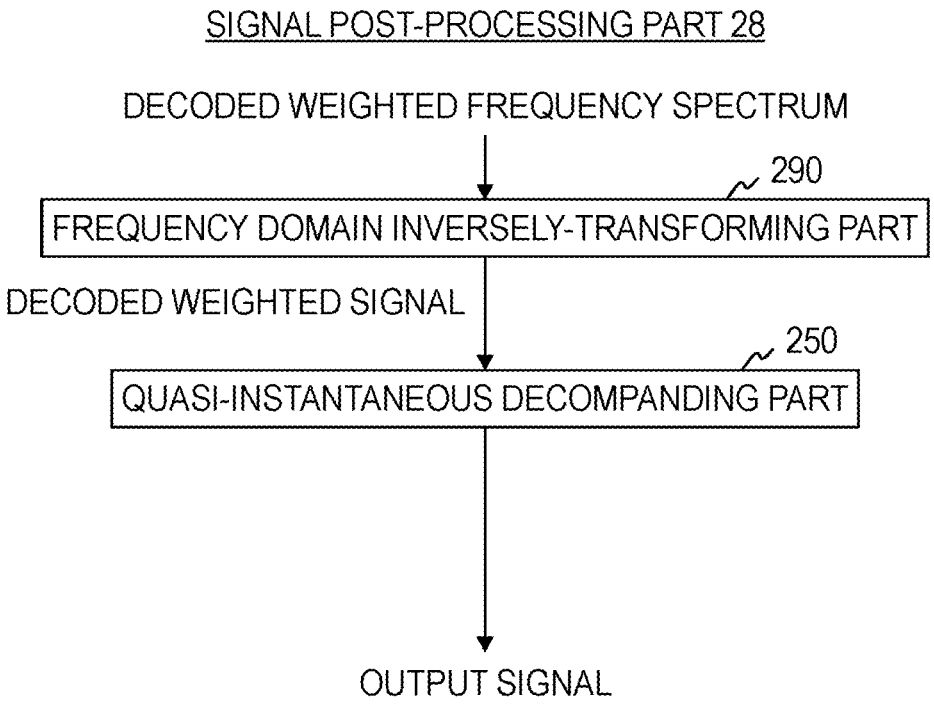
FIG. 30 is a diagram illustrating a functional configuration of a signal post-processing part of the fourth embodiment.

The signal pre-processing part 13 includes the quasi-instantaneous companding part 100 and the frequency domain transforming part 130 as shown in FIG. 29. That is, compared with the signal pre-processing part 10 of the first embodiment, the signal pre-processing part 13 is different in that the frequency domain transforming part 130 is connected to a subsequent stage of the quasi-instantaneous companding part 100, and a weighted frequency spectrum is outputted. The signal post-processing part 28 includes the frequency domain inversely-transforming part 290 and the quasi-instantaneous decompanding part 250 as shown in FIG. 30. That is, compared with the signal post-processing part 25 of the first embodiment, the signal post-processing part 28 is different in that the frequency domain inversely-transforming part 290 is connected to a previous stage of the quasi-instantaneous decompanding part 250, and a decoded weighted frequency spectrum is inputted. The quantizing part 17, the lossless encoding part 18, the lossless decoding part 22 and the dequantizing part 23 perform processes similar to the processes of the quantizing part 17, the lossless encoding part 18, the lossless decoding part 22 and the dequantizing part 23 of the first embodiment but are different from the first embodiment in that they handle a frequency spectrum instead of a signal in a time domain.

<<Encoder 7>>

A time domain acoustic signal $x_n$ (n=0, . . . , N−1; N (>0) is the number of samples in a predetermined frame; and n is a sample number in the frame) of voice, music or the like is inputted to the encoder 7 in frames. The acoustic signal $x_n$ inputted to the encoder 7 is inputted to the signal pre-processing part 13.

[Signal Pre-Processing Part 13]

The signal pre-processing part 13 receives, for each frame, the acoustic signal $x_n$ (n=0, . . . , N−1) inputted to the encoder 7, performs processes by the quasi-instantaneous companding part 100 and the frequency domain transforming part 130, and outputs a weighted frequency spectrum $Y_k$ (k=0, . . . , N−1) to the quantizing part 17.

[Quasi-Instantaneous Companding Part 100]

The quasi-instantaneous companding part 100 receives, for each frame, the acoustic signal $x_n$ (n=0, . . . , N−1) inputted to the encoder 7, performs the processes by the representative value calculating part 110 and the signal companding part 120, and outputs a weighted signal $y_n$ (n=0, . . . , N−1) to the frequency domain transforming part 130. The process of the quasi-instantaneous companding part 100 is similar to the first embodiment described above except that the acoustic signal $x_n$ (n=0, . . . , N−1) is expressed as the acoustic signal $X_k$ (k=0, . . . , N−1) in the first embodiment described above, and the weighted signal $y_n$ (n=0, . . . , N−1) is expressed as the weighted signal $Y_k$ (k=0, . . . , N−1) in the first embodiment described above.

[Frequency Domain Transforming Part 130]

The frequency domain transforming part 130 receives, for each frame, the weighted signal $y_n$ (n=0, . . . , N−1) inputted from the quasi-instantaneous companding part 100, transforms the weighted signal $y_n$ to a spectrum in a frequency domain to obtain a weighted frequency spectrum $Y_k$ (k=0, . . . , N−1), and outputs the weighted frequency spectrum $Y_k$ to the quantizing part 17. The process of the frequency domain transforming part 130 is similar to the second embodiment described above.

The weighted frequency spectrum $Y_k$ (k=0, . . . , N−1) of the fourth embodiment is a signal in the frequency domain, and the weighted signal $Y_k$ (k=0, . . . , N−1) of the first embodiment is a signal in a time domain. However, as for the quantizing part 17 and subsequent parts, similar operations are performed regardless of whether a signal is in a time domain or in a frequency domain, and, therefore, description thereof will be omitted.

<<Decoder 8>>

[Lossless Decoding Part 22]

The lossless decoding part 22 receives the signal code outputted by the demultiplexing part 21, performs lossless decoding corresponding to the process of the lossless encoding part 18, and outputs a frequency spectrum corresponding to the signal code to the dequantizing part 23 as a decoded quantized frequency spectrum.

[Dequantizing Part 23]

The dequantizing part 23 receives the decoded quantized frequency spectrum outputted by the lossless decoding part 22 and a quantization width outputted by the demultiplexing part 21, and multiplies a value corresponding to the quantization width and each sample value of the decoded quantized frequency spectrum for each sample to obtain a dequantized signal, for example, similarly to the conventional technique. The dequantizing part 23 outputs the dequantized signal to the signal post-processing part 28 as a decoded weighted frequency spectrum $\hat{Y}_k$ (k=0, . . . , N−1).

[Signal Post-Processing Part 28]

The signal post-processing part 28 receives, for each frame, the decoded weighted frequency spectrum $\hat{Y}_k$ (k=0, . . . , N−1) outputted by the dequantizing part 23, performs processes by the frequency domain inversely-transforming part 290 and the quasi-instantaneous decompanding part 250, and outputs an output signal $\hat{x}_n$ (n=0, . . . , N−1).

[Frequency Domain Inversely-Transforming Part 290]

The frequency domain inversely-transfonning part 290 receives, for each frame, the decoded weighted frequency spectrum $\hat{Y}_k$ (k=0, . . . , N−1) outputted by the dequantizing part 23, transforms the decoded weighted frequency spectrum $\hat{Y}_k$ to a signal in a time domain to obtain a decoded weighted signal $\hat{y}_n$ (n=0, . . . , N−1), and outputs the decoded weighted signal $\hat{y}_n$ to the quasi-instantaneous decompanding part 250. The process of the frequency domain inversely-transforming part 290 is similar to the second embodiment described above.

[Quasi-Instantaneous Decompanding Part 250]

The quasi-instantaneous decompanding part 250 receives, for each frame, the decoded weighted signal $\hat{y}_n$ (n=0, . . . , N−1) that has been inputted, performs the processes by the companded representative value calculating part 260 and the signal decompanding part 270, and outputs an output signal $\hat{x}_n$ (n=0, . . . , N−1). The process of the quasi-instantaneous decompanding part 250 is similar to the first embodiment described above except that the decoded weighted signal $\hat{y}_n$ (n=0, . . . , N−1) is expressed as the decoded weighted signal $\hat{Y}_k$ (k=0, . . . , N−1) in the first embodiment described above, and the output signal $\hat{x}_n$ (n=0, . . . , N−1) is expressed as the output signal $\hat{X}_k$ (k=0, . . . , N−1) in the first embodiment described above.

<Points of First to Fourth Embodiments>

In the first embodiment, a configuration is described in which pre-processing and post-processing are performed in a time domain, and an encoding process and a decoding process are performed in the time domain. In the second embodiment, a configuration is described in which pre-processing and post-processing are performed in a frequency domain, and an encoding process and a decoding process are performed in a time domain. In the third embodiment, a configuration is described in which pre-processing and post-processing are performed in a frequency domain, and an encoding process and a decoding process are performed in the frequency domain. In the fourth embodiment, a configuration is described in which pre-processing and post-processing are performed in a time domain, and an encoding process and a decoding process are performed in a frequency domain. That is, in the present invention, pre-processing and post-processing, and an encoding process and a decoding process can be performed with an arbitrary combination of a frequency domain and a time domain. In other words, the pre-processing and post-processing of the present invention are applicable to both of an encoding process and a decoding process in a frequency domain and an encoding process and a decoding process in a time domain.

Fifth Embodiment

As for a section of a plurality of samples for which a quasi-instantaneous companding process is performed, inversely transformation can be performed without using auxiliary information regardless of how the section is specified if the length is a length determined in advance. However, if aural quality is considered, the section of a plurality of samples for which quasi-instantaneous companding is to be performed can be more appropriately specified.

Human hearing sense logarithmically senses an amplitude of each frequency. Therefore, from that point of view, it is better to individually weight each sample. However, weights applied to frequencies around a peak should be small according to the value of the peak, and, from that point of view, it is better to collectively weight a plurality of samples. It is known that human aural frequency resolution is high at a low frequency and low at a high frequency. Therefore, in the fifth embodiment, by setting processing sections at low frequencies finely and setting processing sections at high frequencies roughly, more efficient weighting is realized in consideration of aural quality.

<<Encoder>>

An encoder of the fifth embodiment is such that, in the encoder 3 of the second embodiment or the encoder 5 in the third embodiment, the processes of the representative value calculating part 111 and the signal companding part 121 are changed as below.

[Representative Value Calculating Part 111]

The representative value calculating part 111 receives, for each frame, a frequency spectrum $X_k$ (k=0, . . . , N−1) outputted by the frequency domain transforming part 130, divides the frequency spectrum $X_k$ (k=0, . . . , N−1) of each frame into L sections (frequency sections) each of which includes a predetermined number of samples, calculates a representative value $\bar{X}_m$ (m=1, L) for each section, and outputs the representative value $\bar{X}_m$ to the signal companding part 121. At this time, the number of samples included in each section can be arbitrarily specified. For example, it is assumed that $K_0, \ldots, K_L$ ($0=K_0<\ldots<K_L=N-1$) indicate numbers of samples in the frame, and the L sections are defined as $[K_0\ K_1], [K_1\ K_2], \ldots, [K_{L-1}\ K_L]$. Here, $[K_{m-1}\ K_m]$ indicates that the $(K_{m-1}+1)$-th to $K_m$-th samples in the frame are defined as the m-th section. At this time, the example calculating the representative value follows.

$$\bar{X}_m = \frac{1}{K_m - K_{m-1} + 1} \sum_{k=K_{m-1}} |X_k| \tag{19}$$

The representative value $\bar{X}_m$ (m=1, . . . , L) is calculated as above formula using an average absolute value.

When the number of samples included in each of the L sections is indicated by $M_m$ (m=1, . . . , L; $M_1 \leq M_2 \leq \ldots \leq M_L$), it is possible to, for example, by defining $[K_{m-1}\ K_m]$ so that $M_1<\ldots<M_L$ is satisfied, set processing sections more finely for a lower frequency and more roughly for a higher frequency. In the case of $M_1=M_2=\ldots=M_L$, a configuration equal to the configuration of the first to fourth embodiments is made.

[Signal Companding Part 121]

The signal companding part 121 receives, for each frame, the representative value $\bar{X}_m$ (m=1, . . . , L) outputted by the representative value calculating part 111 and the frequency spectrum $X_k$ (k=0, . . . , N−1) outputted by the frequency domain transforming part 130, generates a weighted frequency spectrum $Y_k$ (k=0, . . . , N−1) as below, and outputs the weighted frequency spectrum $Y_k$ to the frequency domain inversely-transforming part 140.

Using a representative value $f(\bar{X}_m)$ after transformation by a companding function f(x) and the original representative value $\bar{X}_m$, a sample value $X_k$ of the frequency spectrum is converted to a weighted frequency spectrum $Y_k$ as below, for each of the L sections each of which includes a predetermined number of samples.

$$Y_k = \frac{f(\bar{X}_m)}{\bar{X}_m} X_k (k = K_{m-1}, \ldots, K_m;\ m = 1, \ldots, L) \tag{20}$$

<<Decoder>>

A decoder of the fifth embodiment is such that, in the decoder 4 of the second embodiment, the processes of the companded representative value calculating part 261 and the signal decompanding part 271 are changed as below.

[Companded Representative Value Calculating Part 261]

The companded representative value calculating part 261 receives, for each frame, a decoded weighted frequency spectrum $\hat{Y}_k$ (k=0, . . . , N−1) outputted by the frequency domain transforming part 280, divides the decoded weighted frequency spectrum $\hat{Y}_k$ (k=0, . . . , N−1) of each frame into L sections (frequency sections) each of which includes a predetermined number of samples, calculates a representative value $\bar{Y}_m$ (m=1, . . . , L) for each section similarly to the representative value calculating part 111, and outputs the representative value $\bar{Y}_m$ to the signal decompanding part 271. As a method for calculating the companded representative value $\bar{Y}_m$, the same method as the representative value calculating part 111 is used.

The example in the case of an average absolute value follows.

$$\bar{Y}_m = \frac{1}{K_m - K_{m-1} + 1} \sum_{k=K_{m-1}}^{K_m} |\hat{Y}_k| \tag{21}$$

The companded representative value $\bar{Y}_m$ (m=1, . . . , L) is calculated as above formula in the case of an average absolute value.

[Signal Decompanding Part 271]

The signal decompanding part 271 receives, for each frame, the companded representative value $\bar{Y}_m$ (m=1, . . . , M') outputted by the companded representative value calculating part 261 and the decoded weighted frequency spectrum $\hat{Y}_k$ (k=0, . . . , N−1) outputted by the frequency domain transforming part 280, generates a decoded frequency spectrum $\hat{X}_k$ (k=0, . . . , N−1) as below, and outputs the decoded frequency spectrum $\hat{X}_k$ to the frequency domain inversely-transforming part 290.

Using a companded representative value $f^{-1}(\bar{Y}_m)$ after transformation by an inverse function $f^{-1}(y)$ of the companding function f(x) and the original companded representative value $\bar{Y}_m$, a sample value $\hat{Y}_k$ of the decoded weighted frequency spectrum is converted to a sample value of the decoded frequency spectrum $\hat{X}_k$ as below for each section of the predetermined M samples.

$$\hat{X}_k = \frac{f^{-1}(\bar{Y}_m)}{\bar{Y}_m} \hat{Y}_k (k = K_{m-1}, \ldots, K_m) \tag{22}$$

Figure 31:
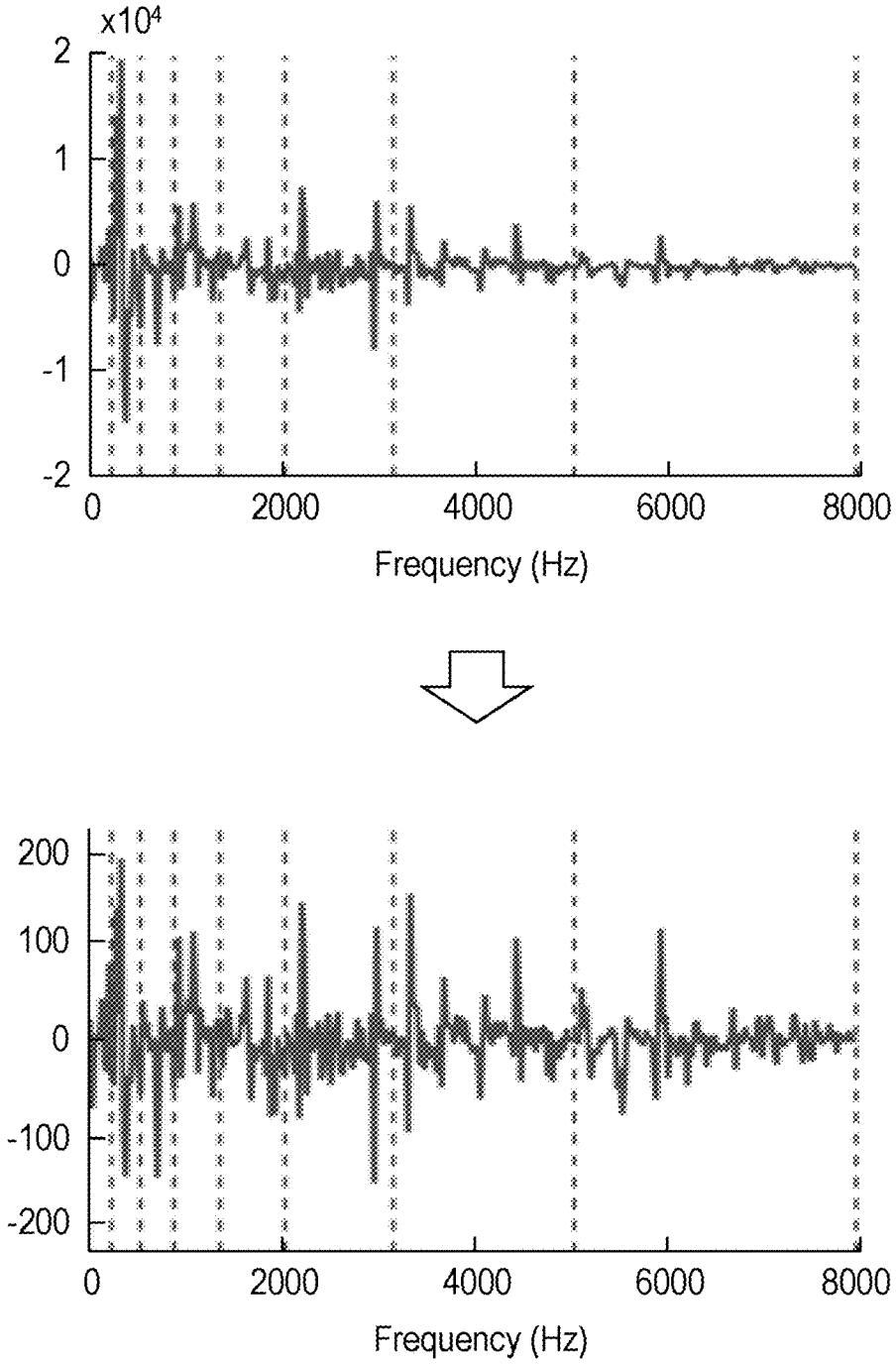
FIG. 31 is a diagram illustrating frequency spectra before and after quasi-instantaneous companding according to a fifth embodiment.

FIG. 31 shows a specific example of a frequency spectrum at the time of dividing a frequency spectrum into finer sections for a lower frequency and into rougher sections for a higher frequency to perform signal companding by the pre-processing of the encoding method of the fifth embodiment. In the example of FIG. 31, for example, a frequency band of 0 to 2000 Hz is divided in five sections, and, for example, the whole frequency band of 5000 to 8000 Hz is included in one section. It is seen that processing sections are set more finely for a lower frequency and more roughly for a higher frequency.

Sixth Embodiment

In the case of finely setting sections and performing quasi-instantaneous companding for such a signal that does not have rises or falls of the spectrum in a frame and that uniformly shows large values, there may be a case where values of the spectrum in the frame are uniformly reduced, and performance of quantization is adversely affected. In the sixth embodiment, a quasi-instantaneous companding process is hierarchically used as a measure against the case. For example, quasi-instantaneous companding is performed for rough sections in the frame first to increase values for high-energy sections, for example, using an inverse function of a companding function. After that, quasi-instantaneous companding is performed for finer sections. In inverse transformation, by performing quasi-instantaneous decompanding for fine sections first, and then performing quasi-instantaneous decompanding for rough sections, the original frequency spectrum is determined.

<<Encoder>>

Figure 32:
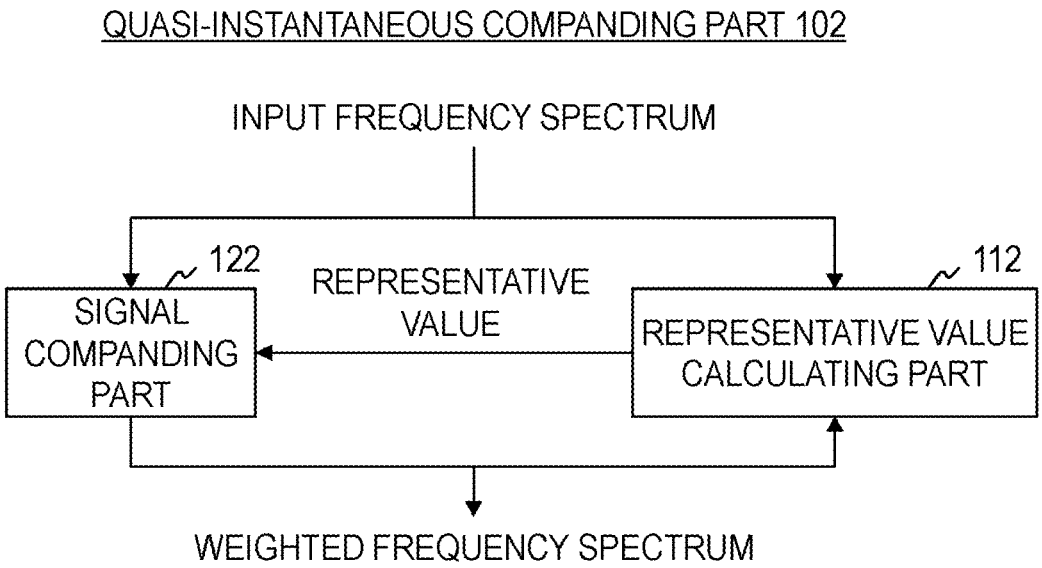
FIG. 32 is a diagram illustrating a functional configuration of a quasi-instantaneous companding part of a sixth embodiment.

An encoder of the sixth embodiment is such that, in the encoder 3 of the second embodiment, the process of the quasi-instantaneous companding part 101 is changed as below. However, it is not limited to the second embodiment that the configuration of the sixth embodiment can be applied to. The configuration can be applied to all of the first to fifth embodiments. As shown in FIG. 32, a quasi-instantaneous companding part 102 of the sixth embodiment includes a representative value calculating part 112 and a signal companding part 122 and is configured so that an output of the signal companding part 122 is inputted to the representative value calculating part 112.

[Quasi-Instantaneous Companding Part 102]

The quasi-instantaneous companding part 102 receives, for each frame, a frequency spectrum $X_k$ (k=0, . . . , N−1) outputted by the frequency domain transforming part 130, repeats processes by the representative value calculating part 112 and the signal companding part 122 a predetermined number of times and, after that, outputs a weighted frequency spectrum $Y_k$ (k=0, . . . , N−1) to the frequency domain inversely-transforming part 140.

[Representative Value Calculating Part 112]

The representative value calculating part 112 receives, for each frame, a processing target frequency spectrum $\tilde{X}_k$ (k=0, . . . , N−1), calculates a representative value $\bar{X}_m$ (m=1, . . . , N/M) for each section of M samples, and outputs the representative value to the signal companding part 122. The representative value calculating part 112 receives the frequency spectrum $X_k$ (k=0, . . . , N−1) inputted to the quasi-instantaneous companding part 102 as the processing target frequency spectrum $\tilde{X}_k$ (k=0, . . . , N−1) at the time of the first execution, and receives the weighted frequency spectrum $Y_k$ (k=0, . . . , N−1) outputted by the signal companding part 122 as the processing target frequency spectrum $\tilde{X}_k$ (k=0, . . . , N−1) at the time of the second and subsequent executions.

For example, in the case of an average absolute value, the companded representative value $\bar{X}_m$ (m=1, . . . , M) is calculated as below:

$$\bar{X}_m = \frac{1}{M} \sum_{k=M(m-1)}^{Mm-1} |\tilde{X}_k| \tag{23}$$

A configuration may be made in which, as the number of samples M of a section for which the representative value calculating part 112 determines a representative value, a different number of samples M is used each time repetition is performed. For example, M=N/2 is set so that processing sections are set roughly for the first time, and M=N/8 is set so that processing sections are set finely for the second time.

[Signal Companding Part 122]

The signal companding part 122 receives, for each frame, the representative value $\bar{X}_m$ (m=1, . . . , N/M) outputted by the representative value calculating part 112 and the processing target frequency spectrum $\tilde{X}_k$ (k=0, . . . , N−1), generates a weighted frequency spectrum $Y_k$ (k=0, . . . , N−1) as below, and outputs the weighted frequency spectrum $Y_k$ (k=0, . . . , N−1) to the frequency domain inversely-transforming part 140. The signal companding part 122 receives the frequency spectrum $X_k$ (k=0, . . . , N−1) inputted to the quasi-instantaneous companding part 102 as the processing target frequency spectrum (k=0, . . . , N−1) at the time of the first execution, and stores the weighted frequency spectrum $Y_k$ (k=0, . . . , N−1) outputted at the time of the previous execution to use the weighted frequency spectrum $Y_k$ as the processing target frequency spectrum $\tilde{X}_k$ (k=0, . . . , N−1) at time of the second and subsequent executions.

Using a representative value $f(\bar{X}_m)$ after transformation by a companding function f(x) and the original representative value $\bar{X}_m$, the sample value $\tilde{X}_k$ of the frequency spectrum is converted to a weighted frequency spectrum $Y_k$ as below for each section of M samples.

$$Y_k = \frac{f(\bar{X}_m)}{\bar{X}_m}\tilde{X}_k(k = M(m-1), \ldots, Mm-1) \tag{24}$$

A configuration may be made in which, as the companding function f(x) used by the signal companding part 122, a different function is used each time repetition is performed. For example, an inverse function $f^{-1}(x)$ of the companding function f(x) is used for the first time, and the companding function f(x) is used for the second time.

<<Decoder>>

Figure 33:
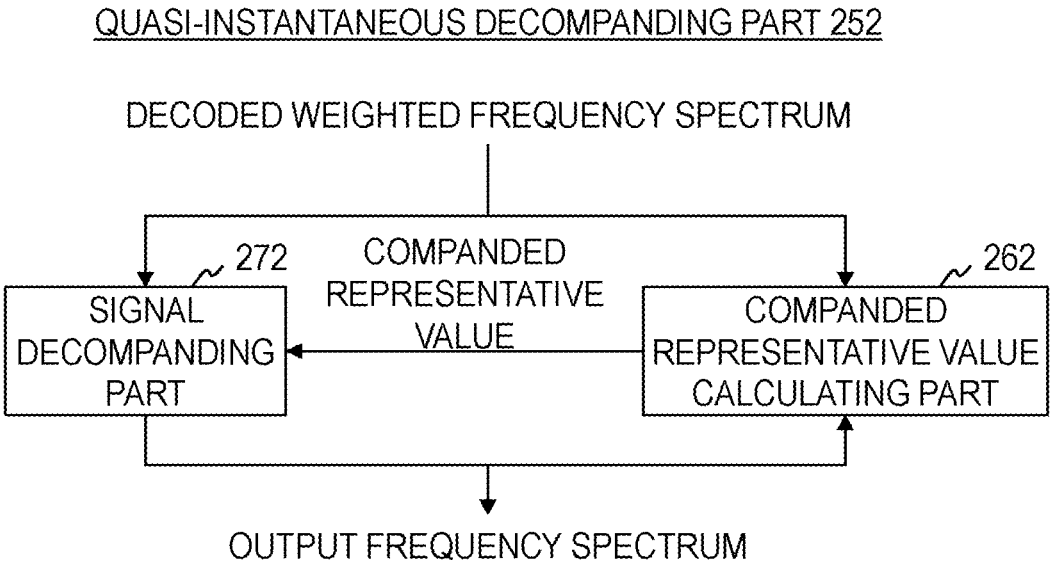
FIG. 33 is a diagram illustrating a functional configuration of a quasi-instantaneous decompanding part of a sixth embodiment.

A decoder of the sixth embodiment is such that, in the decoder 4 of the second embodiment, the process of the quasi-instantaneous decompanding part 251 is changed as below. However, it is not limited to the second embodiment that the configuration of the sixth embodiment can be applied to. The configuration can be applied to all of the first to fifth embodiments. As shown in FIG. 33, a quasi-instantaneous decompanding part 252 of the sixth embodiment includes a companded representative value calculating part 262 and a signal decompanding part 272 and is configured so that an output of the signal decompanding part 272 is inputted to the companded representative value calculating part 262.

[Quasi-Instantaneous Decompanding Part 252]

The quasi-instantaneous decompanding part 252 receives, for each frame, a decoded weighted frequency spectrum $\hat{Y}_k$ (k=0, . . . , N−1) outputted by the frequency domain transforming part 280, repeats processes by the companded representative value calculating part 262 and the signal decompanding part 272 a predetermined number of times, and outputs a decoded frequency spectrum $\hat{X}_k$ (k=0, . . . , N−1) to the frequency domain inversely-transfonning part 290.

[Companded Representative Value Calculating Part 262]

The companded representative value calculating part 262 receives, for each frame, a processing target frequency spectrum $\tilde{Y}_k$ (k=0, . . . , N−1), calculates a representative value $\bar{Y}_m$ (m=1, . . . , N/M) for each section of M samples similarly to the representative value calculating part 112 of the encoder corresponding to the decoder, and outputs the representative value $\bar{Y}_m$ to the signal decompanding part 272 as a companded representative value $\bar{Y}_m$. As a method for calculating the companded representative value $\bar{Y}_m$, the same method as the representative value calculating part 112 of the encoder corresponding to the decoder is used. The companded representative value calculating part 262 receives the decoded weighted frequency spectrum $\hat{Y}_k$ (k=0, . . . , N−1) inputted to the quasi-instantaneous decompanding part 252 as the processing target frequency spectrum $\tilde{Y}_k$ (k=0, . . . , N−1) at the time of the first execution, and receives the decoded frequency spectrum $\hat{X}_k$ (k=0, . . . , N−1) outputted by the signal decompanding part 272 as the processing target frequency spectrum $\tilde{Y}_k$ (k=0, . . . , N−1) at time of the second and subsequent executions.

The example in the case of an average absolute value follows.

$$\bar{Y}_m = \frac{1}{K_m - K_{m-1} + 1}\sum_{k=K_{m-1}}^{K_m} |\tilde{Y}_k| \tag{25}$$

The companded representative value $\bar{Y}_m$ (m=1, . . . , N/M) is calculated as above formula in the case of an average absolute value.

A configuration is made so that, as the number of samples M of a section for which the companded representative value calculating part 262 determines a companded representative value, a value corresponding to the number of samples M used by the representative value calculating part 112 of the encoder corresponding to the decoder each time of repetition is used. For example, M=N/8 is set so that processing sections are set finely for the first time, and M=N/2 is set so that processing sections are set roughly for the second time.

[Signal Decompanding Part 272]

The signal decompanding part 272 receives, for each frame, the companded representative value $\bar{Y}_m$ (m=1, . . . , N/M) outputted by the companded representative value calculating part 262 and the processing target frequency spectrum $\tilde{Y}_k$ (k=0, . . . , N−1), generates the decoded frequency spectrum $\hat{X}_k$ (k=0, . . . , N−1) as below, and outputs the decoded frequency spectrum $\hat{X}_k$ (k=0, . . . , N−1) to the frequency domain inversely-transforming part 290. The signal decompanding part 272 receives the decoded weighted frequency spectrum $\hat{Y}_k$ (k=0, . . . , N−1) inputted to the quasi-instantaneous decompanding part 252 as the processing target frequency spectrum $\tilde{Y}_k$ (k=0, . . . , N−1) at the time of the first execution, and stores the decoded frequency spectrum $\hat{X}_k$ (k=0, . . . , N−1) outputted at the time of the previous execution to use the decoded frequency spectrum $\hat{X}_k$ as the processing target frequency spectrum $\tilde{Y}_k$ (k=0, . . . , N−1) at time of the second and subsequent executions.

Using a companded representative value $f^{-1}(\bar{Y}_m)$ transformed by an inverse function $f^{-}(y)$ of the companding function f(x) and the original companded representative value $\bar{Y}_m$, a sample value $\hat{Y}_k$ of the decoded weighted frequency spectrum is converted to a sample value of the decoded frequency spectrum $\hat{X}_k$ as below for each section of the predetermined M samples.

$$\hat{X}_k = \frac{f^{-1}(\bar{Y}_m)}{\bar{Y}_m}\hat{Y}_k(k = K_{m-1}, \ldots, K_m) \tag{26}$$

A configuration is made so that, as the inverse function $f^{-1}(y)$ of the companding function f(x) used by the signal decompanding part 272, an inverse function corresponding to a companding function f(x) used by the signal companding part 122 is used each time of repetition. For example, the companding function f(x) is used as an inverse function for the inverse function $f^{-1}(x)$ of the companding function f(x) for the first time, and the inverse function $f^{-1}(x)$ of the companding function f(x) is used as an inverse function for the companding function f(x) for the second time.

Figure 34:
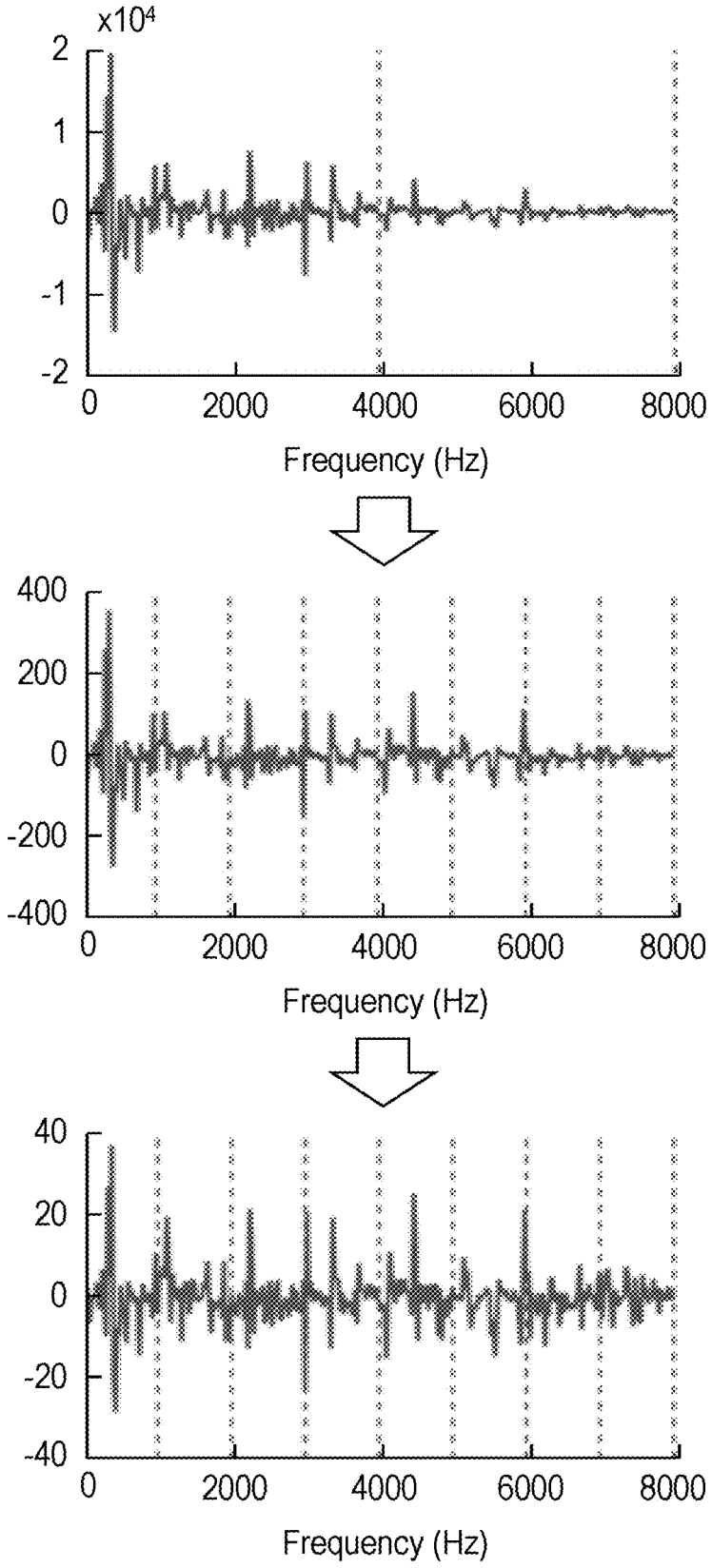
FIG. 34 is a diagram illustrating frequency spectra before and after quasi-instantaneous companding according to the sixth embodiment.

FIG. 34 shows a specific example of a frequency spectrum at the time when the representative value calculation and signal companding processes are repeated a plurality of times by the pre-processing of the encoding method of the sixth embodiment. In the example of FIG. 34, a configuration is made so that the number of samples M included in each section differs each time of repetition. Specifically, for the first process, M=N/2 is set so that one frame is divided into two sections, and, for the second process, M=N/8 is set so that one frame is divided into eight sections.

Seventh Embodiment

The quasi-instantaneous companding part 100 provided in the encoders 1 and 7, the quasi-instantaneous companding part 101 provided in the encoders 3 and 5, the quasi-instantaneous decompanding part 250 provided in the decoders 2 and 8, and the quasi-instantaneous decompanding part 251 provided in the decoders 4 and 6 described in the embodiments described above can be configured as an independent sample sequence converter.

Figure 35:
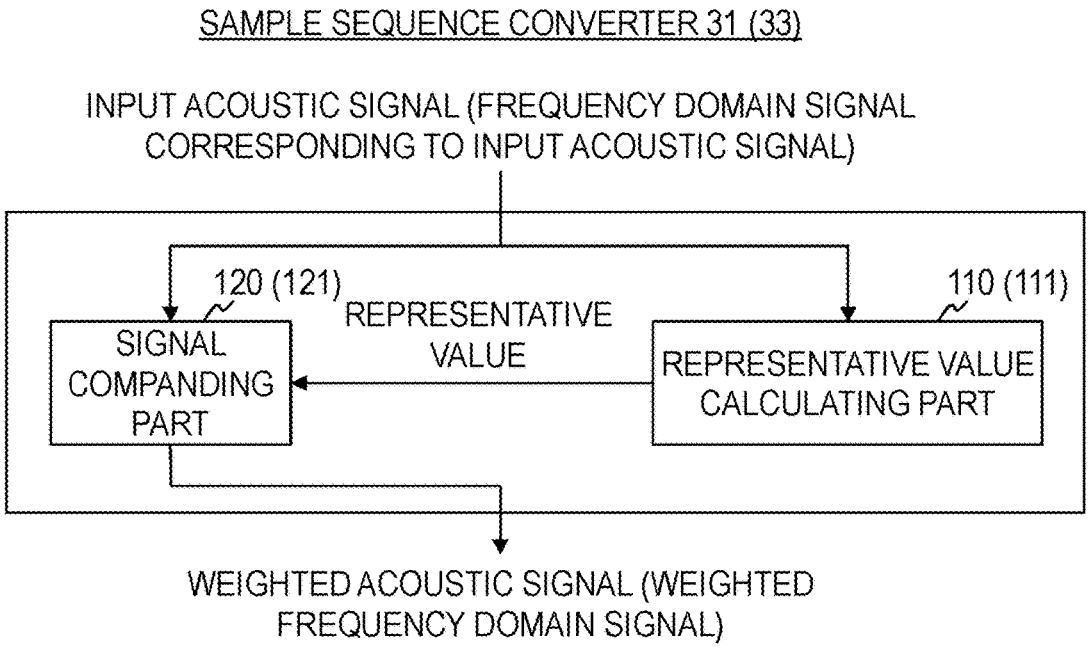
FIG. 35 is a diagram illustrating a functional configuration of a sample sequence converter of a seventh embodiment.

If the quasi-instantaneous companding part 101 is configured as an independent sample sequence converter, a configuration is made as below. This sample sequence converter 33 is a sample sequence converter that obtains a weighted frequency domain signal obtained by converting a frequency domain signal corresponding to an input acoustic signal, the weighted frequency domain signal being to be inputted to an encoder encoding the weighted frequency domain signal, or a weighted frequency domain signal corresponding to a weighted time domain signal corresponding to the weighted frequency domain signal obtained by converting the frequency domain signal corresponding to the input acoustic signal, the weighted time domain signal being to be inputted to an encoder encoding the weighted time domain signal, and includes, for example, the representative value calculating part 111 and the signal companding part 121 as shown in FIG. 35. The representative value calculating part 111 calculates, for each frequency section by a plurality of samples fewer than the number of frequency samples of a sample sequence of the frequency domain signal corresponding to the input acoustic signal, from the sample sequence of the frequency domain signal, a representative value of the frequency section from sample values of samples included in the frequency section, for each of predetermined time sections. The signal companding part 121 obtains, for each of the predetermined time sections, a frequency domain sample sequence obtained by multiplying a weight according to a function value of the representative value by a companding function for which an inverse function can be defined and each of the samples corresponding to the representative value in the sample sequence of the frequency domain signal, as a sample sequence of the weighted frequency domain signal.

Figure 36:
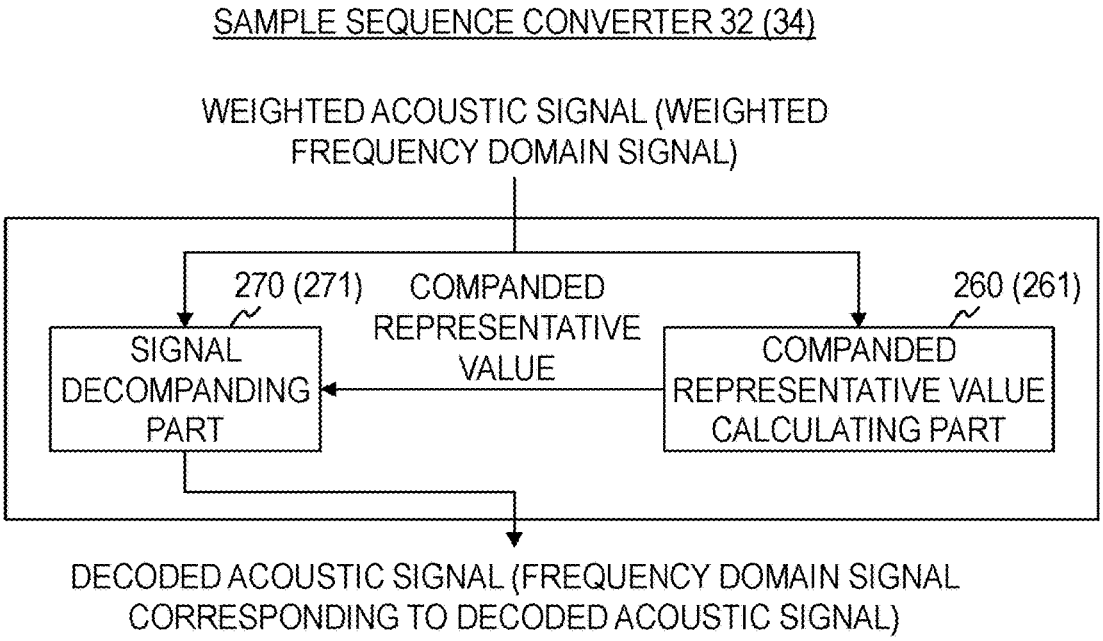
FIG. 36 is a diagram illustrating a functional configuration of a sample sequence converter of the seventh embodiment.

If the quasi-instantaneous decompanding part 251 is configured as an independent sample sequence converter, a configuration is made as below. This sample sequence converter 34 is a sample sequence converter that obtains a frequency domain signal corresponding to a decoded acoustic signal from a weighted frequency domain signal obtained by a decoder that obtains a weighted frequency domain signal corresponding to a frequency domain signal corresponding to a decoded acoustic signal by decoding or a weighted frequency domain signal corresponding to a weighted time domain signal obtained by a decoder that obtains a weighted time domain signal corresponding to a frequency domain signal corresponding to a decoded acoustic signal by decoding, and includes, for example, the companded representative value calculating part 261 and the signal decompanding part 271 as shown in FIG. 36. The companded representative value calculating part 261 calculates, for each frequency section by a plurality of samples fewer than the number of frequency samples of a sample sequence of the weighted frequency domain signal, from the sample sequence of the weighted frequency domain signal, a representative value of the frequency section from sample values of samples included in the frequency section, for each of predetermined time sections. The signal decompanding part 271 obtains, for each of the predetermined time sections, a frequency domain sample sequence obtained by multiplying a weight according to a function value of the representative value by a companding function for which an inverse function can be defined and each of the samples corresponding to the representative value in the sample sequence of the weighted frequency domain signal, as a sample sequence of the frequency domain signal corresponding to the decoded acoustic signal.

If the quasi-instantaneous companding part 100 is configured as an independent sample sequence converter, a configuration is made as below. This sample sequence converter 31 is a sample sequence converter that obtains a weighted acoustic signal obtained by converting an input acoustic signal, the weighted acoustic signal being to be inputted to an encoder encoding the weighted acoustic signal, or a weighted acoustic signal corresponding to a weighted frequency domain signal corresponding to the weighted acoustic signal obtained by converting the input acoustic signal, the weighted frequency domain signal being to be inputted to an encoder encoding the weighted frequency domain signal, and includes, for example, the representative value calculating part 110 and the signal companding part 120 as shown in FIG. 35. The representative value calculating part 110 calculates, for each time section by a plurality of samples fewer than the number of samples of a sample sequence of the input acoustic signal in a time domain, from the sample sequence of the input acoustic signal, a representative value of the time section from sample values of samples included in the time section, for each of predetermined time sections. The signal companding part 120 obtains, for each of the predetermined time sections, a time domain sample sequence obtained by multiplying a weight according to a function value of the representative value by a companding function for which an inverse function can be defined and each of the samples corresponding to the representative value in the sample sequence of the input acoustic signal, as a sample sequence of the weighted acoustic signal.

If the quasi-instantaneous decompanding part 250 is configured as an independent sample sequence converter, a configuration is made as below. This sample sequence converter 32 is a sample sequence converter that obtains a decoded acoustic signal from a weighted acoustic signal in a time domain obtained by a decoder that obtains a weighted acoustic signal in a time domain corresponding to a decoded acoustic signal by decoding or a weighted acoustic signal in a time domain corresponding to a weighted acoustic signal in a frequency domain obtained by a decoder that obtains a weighted acoustic signal in the frequency domain corresponding to a decoded acoustic signal by decoding, and includes, for example, the companded representative value calculating part 260 and the signal decompanding part 270 as shown in FIG. 36. The companded representative value calculating part 260 calculates, for each time section by a plurality of samples fewer than the number of samples of a sample sequence of the weighted acoustic signal in the time domain, from the sample sequence of the weighted acoustic signal, a representative value of the time section from sample values of samples included in the time section, for each of predetermined time sections. The signal decompanding part 270 obtains, for each of the predetermined time sections, a frequency domain sample sequence obtained by multiplying a weight according to a function value of the representative value by a companding function for which an inverse function can be defined and each of the samples corresponding to the representative value in the sample sequence of the weighted frequency domain signal, as a sample sequence of the frequency domain signal corresponding to the decoded acoustic signal.

The sample sequence converters 33 and 34 can be configured as a sample sequence converter 35 in which the frequency section by the plurality of samples are set so that the number of included samples is smaller for a section corresponding to a lower frequency and is larger for a section corresponding to a higher frequency.

Each of the sample sequence converters 31 to 35 can be configured as a sample sequence converter 36 that repeatedly executes calculation of a representative value for each section by a plurality of samples of an input acoustic signal and multiplication of a weight according to a function value of the calculated representative value and each sample of a sample sequence a predetermined number of times.

Eighth Embodiment

If the upper limit of a code length of each frame is constant, compression efficiency fluctuates depending on statistical properties of each frame of an inputted signal, and such a frame that the quantization width can be reduced or such a frame that a large quantization width has to be used appear. Especially as for such a frame that the compression efficiency is high, and the quantization width can be reduced, a quantization error is often sufficiently small from an aural point of view even if pre-processing or post-processing is not performed. Pre-processing by quasi-instantaneous companding and post-processing by quasi-instantaneous decompanding have a property of increasing a numerical error like a square error of a waveform of a decoded signal but reducing aural distortion. Therefore, as for a frame with a small quantization width of an input acoustic signal or a frequency domain signal corresponding to the input acoustic signal, it is more convenient at the time of re-compressing or processing a decoded signal to aim to reduce a numerical error of a waveform of a simple decoded signal without using pre-processing or post-processing than to try to reduce aural distortion using pre-processing and post-processing of a signal.

Therefore, in the eighth embodiment, whether or not to perform pre-processing and post-processing of a signal by quasi-instantaneous companding and quasi-instantaneous decompanding is selected for each frame based on a value of a quantization width of an input acoustic signal or a frequency domain signal corresponding to the input acoustic signal.

The eighth embodiment can be applied to the first, second and fifth embodiments, and the sixth embodiment applied to these embodiments.

According to an encoder and a decoder of the eighth embodiment, by selecting whether or not to perform pre-processing of a signal based on a value of a quantization width of an input acoustic signal or a frequency domain signal corresponding to the input acoustic signal in the encoder, and selecting whether or not to perform post-processing based on a quantization width obtained by decoding in the decoder, it is possible to perform post-processing corresponding to pre-processing performed by the encoder only for a frame for which the pre-processing has been performed by the encoder. That is, it becomes possible for the decoder to perform a decoding process corresponding to an encoding process performed by the encoder.

<<Encoder 41>>

Figure 37:
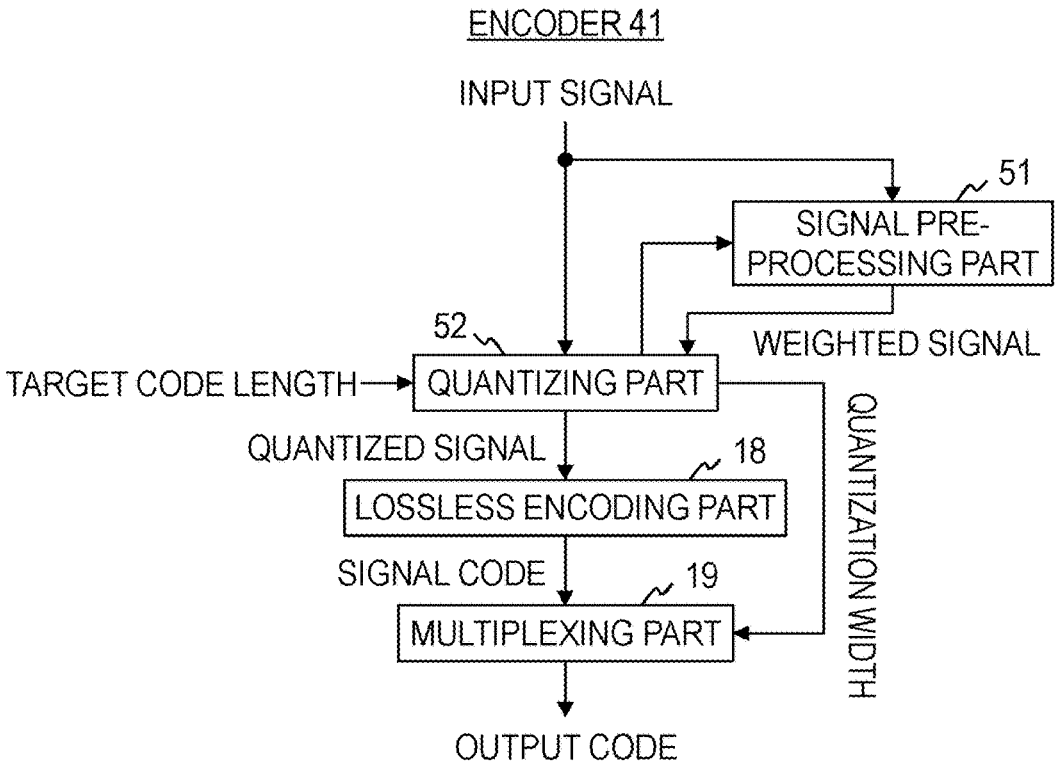
FIG. 37 is a diagram illustrating a functional configuration of an encoder of an eighth embodiment.
Figure 39:
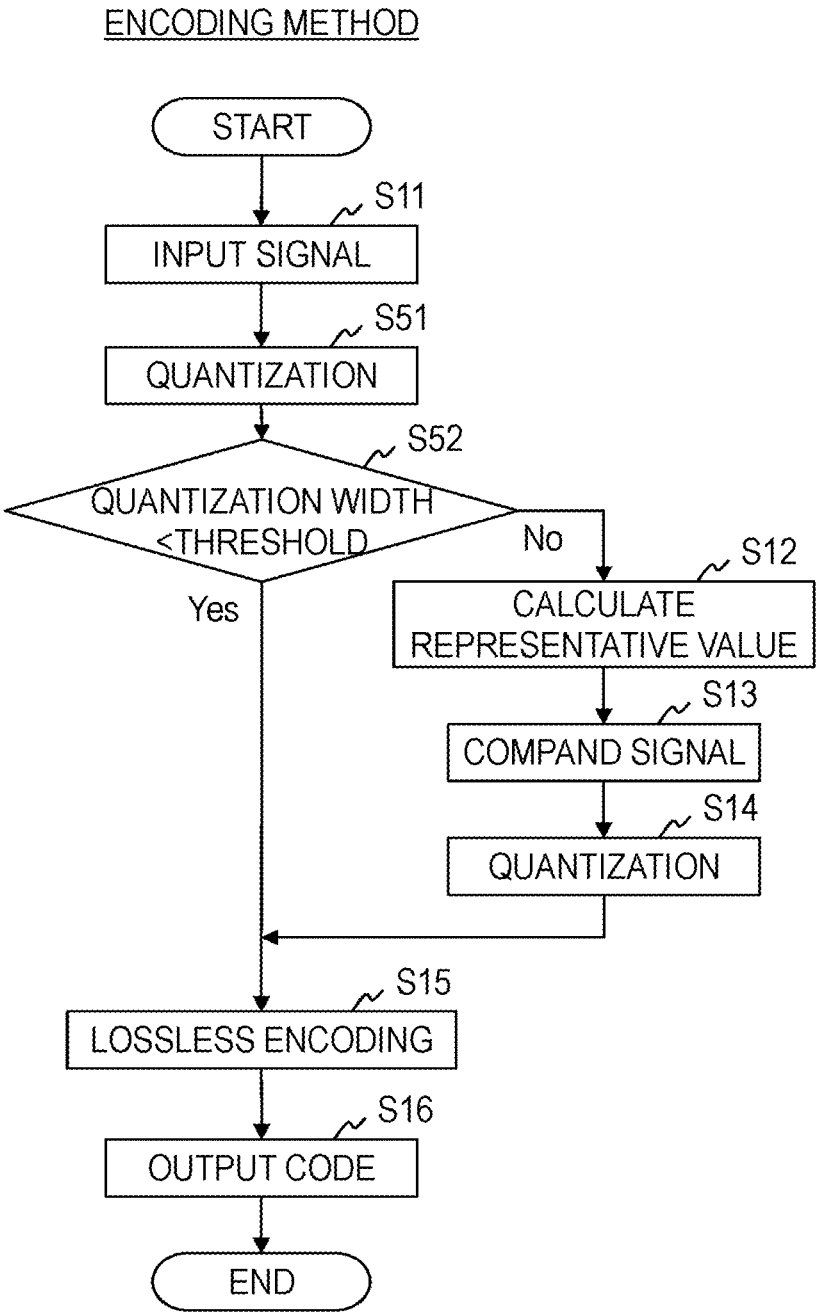
FIG. 39 is a diagram illustrating a process procedure of an encoding method of the eighth embodiment.

As an example of the encoder of the eighth embodiment, the encoder 1 of the first embodiment that has been changed will be described. An encoder 41 of the eighth embodiment includes a signal pre-processing part 51, a quantizing part 52, the lossless encoding part 18 and the multiplexing part 19 as shown in FIG. 37. In the encoder 41 of the eighth embodiment, a process performed by the quantizing part 52 is complicated. Therefore, a process procedure of an encoding method executed by the encoder 41 of the eighth embodiment will be described with reference to FIG. 39.

At step S11, a time domain acoustic signal $X_k$ (k=0, . . . , N−1) of voice, music or the like is inputted to the encoder 41 in frames. The acoustic signal $X_k$ inputted to the encoder 41 is inputted to the quantizing part 52 first.

[Quantizing Part 52; Steps S51 and S52]

At step S51, the quantizing part 52 receives the acoustic signal $X_k$ (k=0, . . . , N−1) for each frame, performs scalar quantization of the acoustic signal $X_k$ to meet a target code length, and obtains a quantized signal. At step S51, the quantizing part 52 divides the acoustic signal $X_k$ by a value corresponding to the quantization width and obtains an integer value as a quantized signal, for example, similarly to the conventional technique. The quantization width is searched for, for example, by, based on a code length as a result of compression by the lossless encoding part 18, increasing the quantization width if the code length is too long for the target code length and decreasing the quantization width if the code length is too short for the target code length. That is, the quantization width is a value obtained by search and is a value estimated to be optimal.

At step S52, as for such a frame that the quantization width used for quantization at step S51 is equal to or smaller than a predetermined threshold, the quantizing part 52 outputs a quantized signal and a quantization width used for quantization to the lossless encoding part 18 and the multiplexing part 19, respectively, and, as for other frames, outputs information about the frames for causing the signal pre-processing part to operate, to the signal pre-processing part 51.

[Signal Pre-Processing Part 51]

When the information about the frame for causing the signal pre-processing part is inputted from the quantizing part 52, that is, only when the quantization width of the acoustic signal of the frame is equal to or larger than the predetermined value, the signal pre-processing part 51 receives the acoustic signal $X_k$ inputted to the encoder 41, performs a process similar to the process of the signal pre-processing part 11, and outputs a weighted signal $Y_k$ (k=0, . . . , N−1) for each frame to the quantizing part 52 (Steps S12 and S13).

[Quantizing Part 52; Steps S14]

At step S14, for a frame with which the signal pre-processing part 51 has outputted the weighted signal $Y_k$ (k=0, . . . , N−1), that is, for such a frame that the quantization width of the acoustic signal of the frame is equal to or larger than the predetermined threshold, the quantizing part 52 receives the weighted signal $Y_k$ (k=0, . . . , N−1) of the frame outputted by the signal pre-processing part 51, performs scalar quantization of the weighted signal $Y_k$ to meet the target code length, and outputs the quantized signal. At step S14, for example, similarly to the conventional technique, the quantizing part 52 divides the weighted signal $Y_k$ by a value corresponding to the quantization width and obtains an integer value as a quantized signal for example, similarly to the conventional technique. The quantization width is searched for, for example, by, based on a code length as a result of compression by the lossless encoding part 18, increasing the quantization width if the code length is too long for the target code length and decreasing the quantization width if the code length is too short for the target code length. That is, the quantization width is a value obtained by search and is a value estimated to be optimal.

In most cases, the quantization width determined by the search of step S14 is a value larger than the quantization width determined by the search of step S51 and is larger than the threshold of step S52. In order to prevent the quantization width determined by the search of step S14 from being a value equal to or smaller than the threshold of step S52, the lower limit of the quantization width determined by the search of step S14 can be set to a value equal to or larger than the value of the threshold of step S52.

The quantizing part 52 outputs the quantized signal and the quantization width used for quantization to the lossless encoding part 18 and the multiplexing part 19, respectively.

[Lossless Encoding Part 18 and Multiplexing Part 19]

Step S15 performed by the lossless encoding part 18 and step S16 performed by the multiplexing part 19 are similar to the first embodiment.

<<Decoder 42>>

Figure 38:
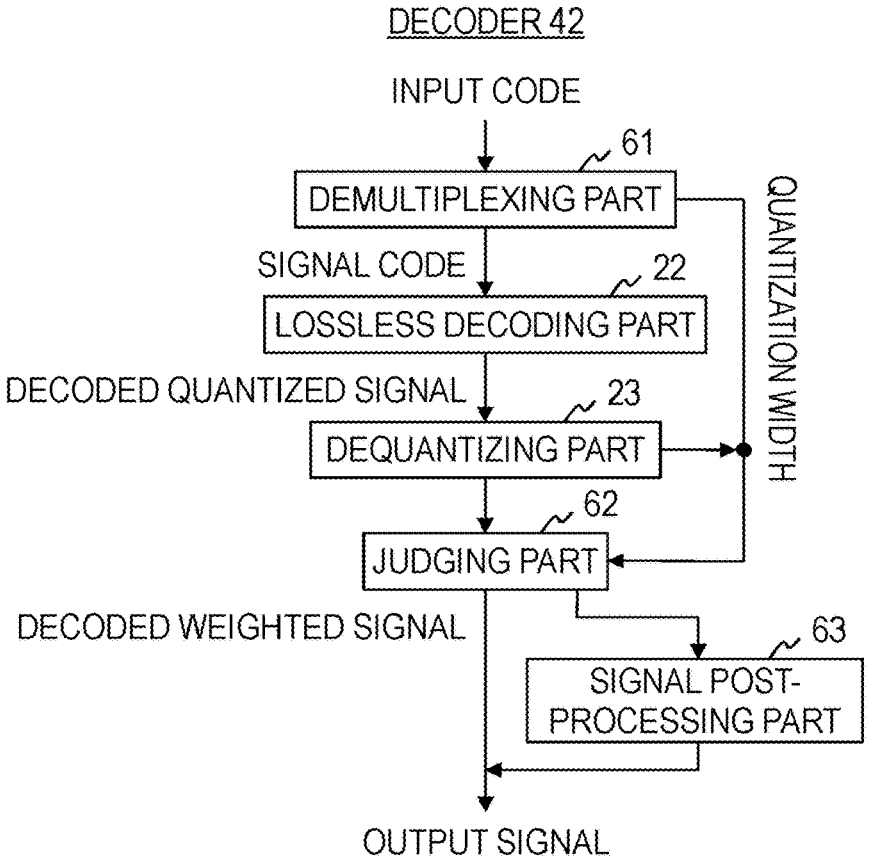
FIG. 38 is a diagram illustrating a functional configuration of a decoder of the eighth embodiment.
Figure 40:
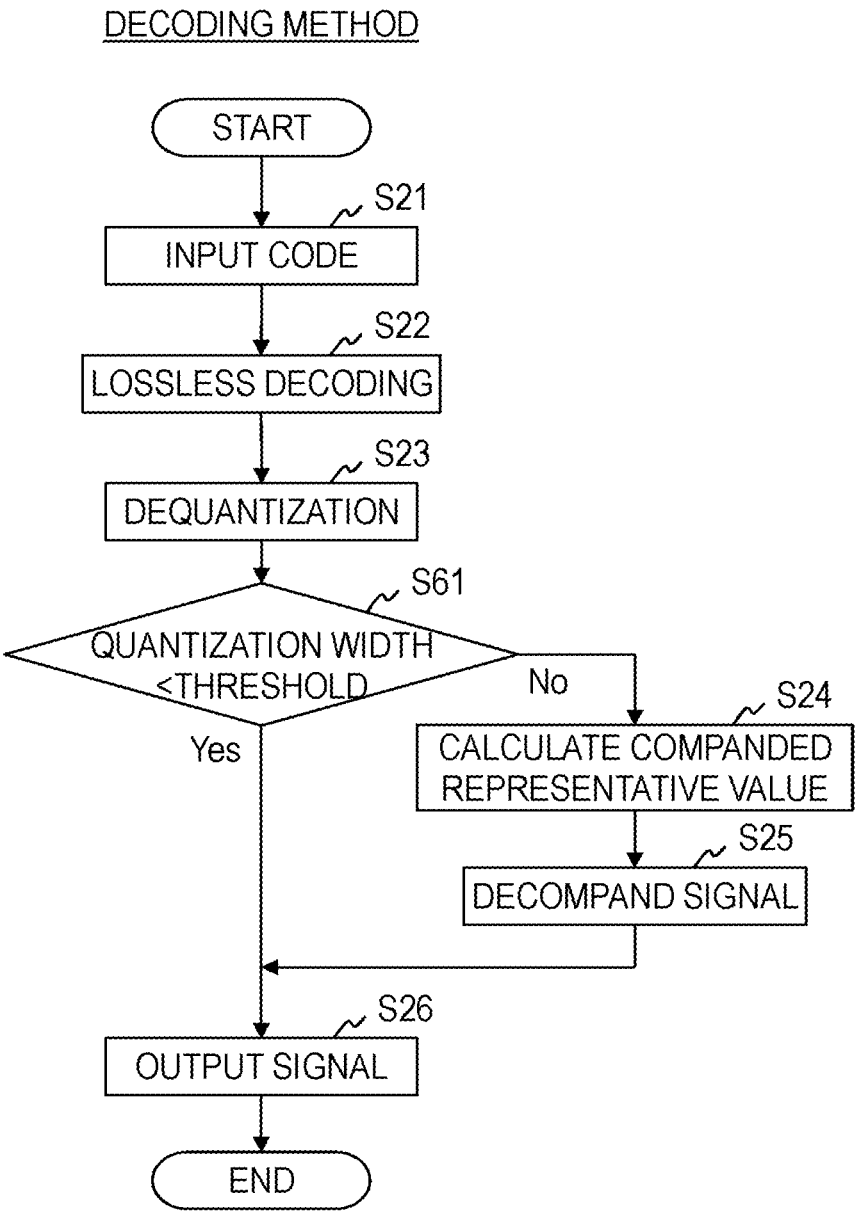
FIG. 40 is a diagram illustrating a process procedure of a decoding method of the eighth embodiment.

As an example of the decoder of the eighth embodiment, the decoder 2 of the first embodiment that has been changed will be described. A decoder 42 of the eighth embodiment includes a demultiplexing part 61, the lossless decoding part 22, the dequantizing part 23, a judging part 62 and a signal post-processing part 63 as shown in FIG. 38. A process procedure of a decoding method executed by the decoder 42 of the eighth embodiment will be described with reference to FIG. 40 below.

[Demultiplexing Part 61]

At step S21, the demultiplexing part 61 receives a code inputted to the decoder 42 and outputs the signal code to the lossless decoding part 22, and a quantization width corresponding to a quantization width code to the dequantizing part 23 and the judging part 62. The process for obtaining the quantization width by decoding is similar to the process of the demultiplexing part 21.

[Lossless Decoding Part 22 and Dequantizing Part 23]

Step S22 performed by the lossless decoding part 22 and step S23 performed by the dequantizing part 23 are similar to the first embodiment.

[Judging Part 62]

At step S61, the judging part 62 receives, for each frame, a decoded weighted signal $\hat{Y}_k$ (k=0, . . . , N−1) outputted by the dequantizing part 23 and the quantization width outputted by the demultiplexing part 61, outputs the decoded weighted signal $\hat{Y}_k$ (k=0, . . . , N−1) outputted by the dequantizing part 23 as it is, as an output signal $\hat{X}_k$ (k=0, . . . , N−1) for a frame the quantization width of which is equal to or smaller than the predetermined threshold, and, for other frames, outputs information about the frame for causing the signal post-processing part to operate and the decoded weighted signal $\hat{Y}_k$ (k=0, . . . , N−1) outputted by the dequantizing part 23 to the signal post-processing part 63.

[Signal Post-Processing Part 63]

If the information about the frame for causing the signal post-processing part to operate is inputted from the signal post-processing part 63, that is, for such a frame that the quantization width is equal to or larger than the predetermined threshold, the signal post-processing part 63 receives the decoded weighted signal $\hat{Y}_k$ (k=0, . . . , N−1) outputted by the dequantizing part 23, performs a process similar to the process of the signal post-processing part 25 of the first embodiment, and obtains and outputs an output signal $\hat{X}_k$ (k=0, . . . , N−1) (steps S24 and S25).

Ninth Embodiment

In Formula (7) used in the encoder of the first embodiment, the parameter γ specifying a degree of quasi-instantaneous companding can be adjusted continuously from γ=0 specifying logarithmic quasi-instantaneous companding to γ=1 specifying no quasi-instantaneous companding. Pre-processing and post-processing of a signal tends to be required more where accuracy of quantization of an input acoustic signal or a frequency domain signal corresponding to the input acoustic signal is rough and not required where accuracy of quantization is fine. Therefore, by causing the degree of quasi-instantaneous companding to adaptively change for each frame, it becomes possible to perform weighting more appropriate for a signal.

Therefore, an encoder of the ninth embodiment selects, for each frame, a degree of quasi-instantaneous companding in pre-processing of a signal, based on a value of a quantization width of an input acoustic signal or a frequency domain signal corresponding to the input acoustic signal, and sends a coefficient specifying the selected degree of quasi-instantaneous companding to a decoder. The decoder of the ninth embodiment selects, for each frame, a degree of quasi-instantaneous decompanding in post-processing of the signal, based on the coefficient specifying the degree of quasi-instantaneous companding sent from the encoder. By these processes, it is possible for the decoder, too, to judge the degree of quasi-instantaneous companding used for pre-processing of the signal by the encoder and perform post-processing corresponding to the pre-processing performed by the encoder. That is, it becomes possible for the decoder to perform a decoding process corresponding to an encoding process performed by the encoder. As an example, an example in which γ in Formula (7) is used as the coefficient specifying the degree of quasi-instantaneous companding will be described below. In the description below, γ that is the coefficient specifying the degree of quasi-instantaneous companding will be also referred to as a companding coefficient.

The ninth embodiment can be applied to all of the first to sixth embodiments.

<<Encoder 43>>

Figure 41:
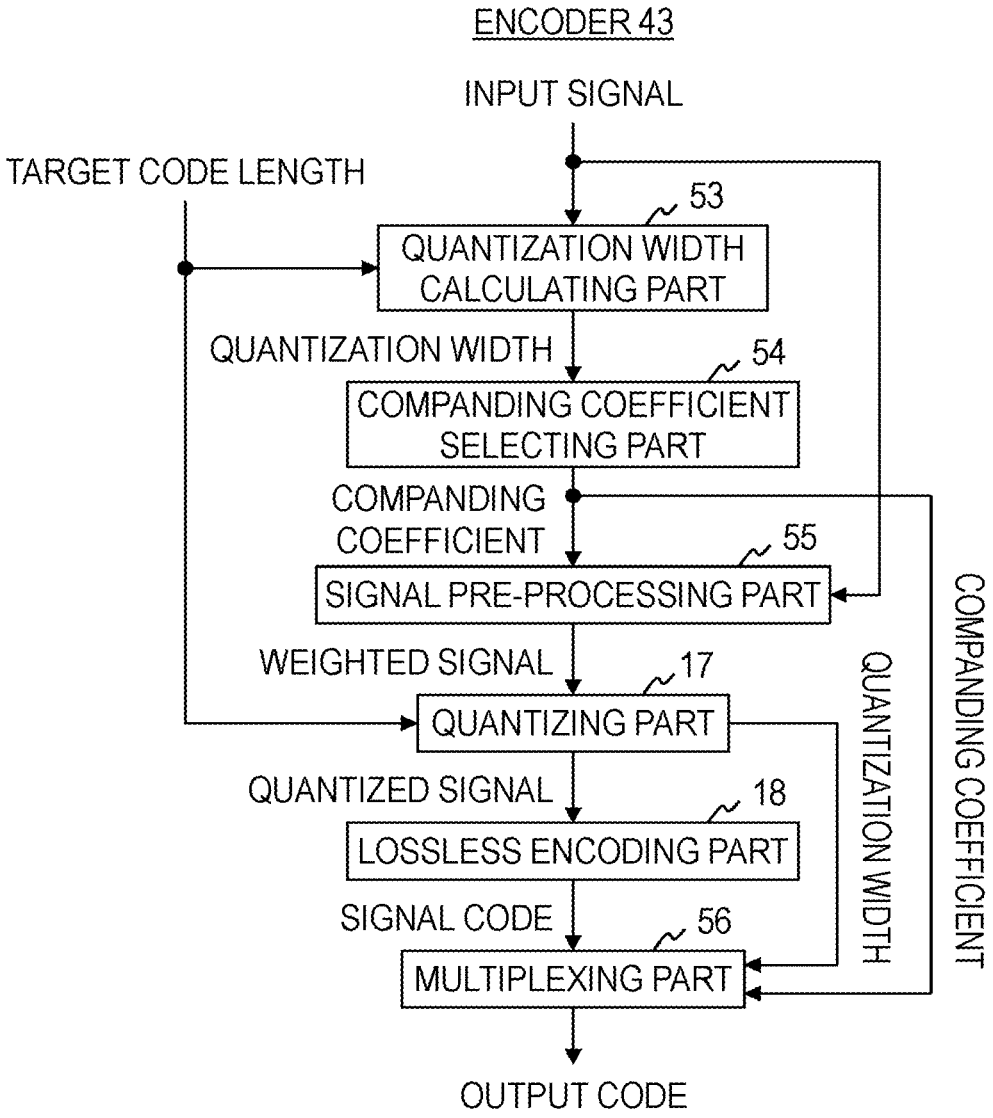
FIG. 41 is a diagram illustrating a functional configuration of an encoder of a ninth embodiment.
Figure 42:
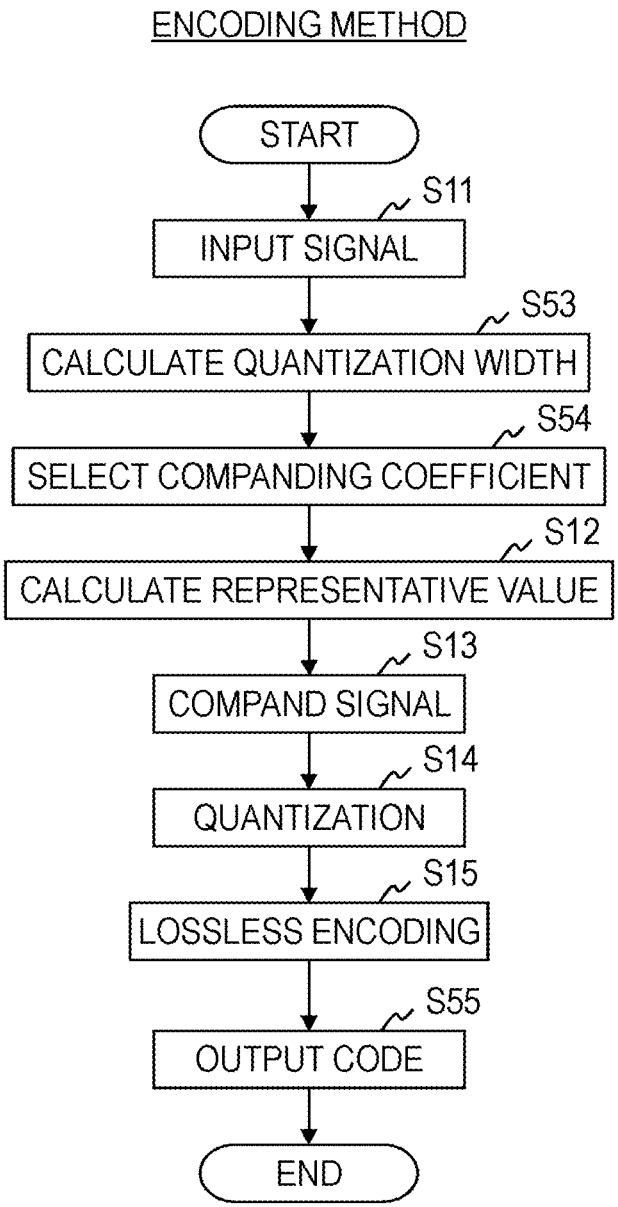
FIG. 42 is a diagram illustrating a process procedure of an encoding method of the ninth embodiment.

As an example of the encoder of the ninth embodiment, the encoder 1 of the first embodiment that has been changed will be described. An encoder 43 of the ninth embodiment includes a quantization width calculating part 53, a companding coefficient selecting part 54, a signal pre-processing part 55, the quantizing part 17, the lossless encoding part 18 and a multiplexing part 56 as shown in FIG. 41. A process procedure of an encoding method executed by the encoder 43 of the ninth embodiment will be described below with reference to FIG. 42.

At step S11, a time domain acoustic signal $X_k$ (k=0, . . . , N−1) of voice, music or the like is inputted to the encoder 43 in frames. The acoustic signal $X_k$ inputted to the encoder 43 is inputted to the quantization width calculating part 53 first.

[Quantization Width Calculating Part 53]

At step S53, the quantization width calculating part 53 receives the acoustic signal $X_k$ (k=0, . . . , N−1) for each frame and obtains a quantization width for performing scalar quantization of the acoustic signal $X_k$ to meet a target code length. The quantization width calculating part 53 outputs the obtained quantization width to the companding coefficient selecting part 54.

At step S53, the quantization width calculating part 53 searches for a quantization width, for example, by, based on a code length as a result of compression by lossless encoding, increasing the quantization width if the code length is too long for the target code length and decreasing the quantization width if the code length is too short for the target code length. That is, the quantization width is a value obtained by search and is a value estimated to be optimal.

Further, for example, at step S53, the quantization width calculating part 53 may calculate an estimated value of quantization width from an entropy of the acoustic signal $X_k$ (k=0, . . . , N−1) of each frame and the target code length and output the calculated estimated value of quantization width to the companding coefficient selecting part 54 as the quantization width.

[Companding Coefficient Selecting Part 54]

At step S54, the companding coefficient selecting part 54 receives, for each frame, the quantization width outputted by the quantization width calculating part 53, and selects, among a plurality of candidate values of a companding coefficient γ stored in advance in the companding coefficient selecting part 54, one candidate value corresponding to the value of the quantization width as the companding coefficient γ. As for selection of γ, for example, by selecting a value that is inversely proportional to the value of the quantization width as γ in the range of $0 \leq \gamma \leq 1$, a value close to γ=0 and a value close to γ=1 are selected for a frame with a large quantization width and a frame with a small quantization width, respectively. That is, a companding coefficient is selected that specifies, for a frame with a low acoustic signal quantization accuracy, such a companding function that power of a sample sequence of a weighted acoustic signal after companding or a weighted frequency domain signal corresponding to the input acoustic signal is flatter, and, for a frame with a high acoustic signal quantization accuracy, such a companding function that a difference between the input acoustic signal and the weighted acoustic signal before and after companding or between a sample sequence of a frequency domain signal of the input acoustic signal and a sample sequence of the weighted frequency domain signal is smaller. The companding coefficient selecting part 54 outputs the companding coefficient γ obtained by the selection to the signal pre-processing part 55 and the multiplexing part 56.

[Signal Pre-Processing Part 55]

The signal pre-processing part 55 receives, for each frame, the acoustic signal $X_k$ (k=0, . . . , N−1) inputted to the encoder 43 and the companding coefficient γ outputted by the companding coefficient selecting part 54, performs a process similar to the process of the signal pre-processing part 11 of the first embodiment for the acoustic signal $X_k$ using the inputted companding coefficient γ, and outputs a weighted signal $Y_k$ (k=0, . . . , N−1) for each frame to the quantizing part 17 (steps S12 and S13).

[Quantizing Part 17 and Lossless Encoding Part 18]

Step S14 performed by the quantizing part 17 and step S15 performed by the lossless encoding part 18 are similar to the first embodiment.

[Multiplexing Part 56]

At step S55, the multiplexing part 56 receives the quantization width outputted by the quantizing part 17, the signal code outputted by the lossless encoding part 18 and the companding coefficient outputted by the companding coefficient selecting part 54, and outputs a quantization width code that is a code corresponding to the quantization width, a companding coefficient code that is a code corresponding to the companding coefficient and the signal code together as an output code. The quantization width code is obtained by encoding the value of the quantization width. As a method for encoding the value of the quantization width, a well-known encoding method can be used. The companding coefficient code is obtained by encoding the value of the companding coefficient. As a method for encoding the value of the companding coefficient, a well-known encoding method can be used. The multiplexing part 56 may be caused to operate for each frame with the same number of samples N as the signal pre-processing part 55 or may be caused to operate for every number of samples different from the number of frames of the signal pre-processing part 55, for example, for every number of samples 2N.

<<Modification of Encoder 43>>

Figure 43:
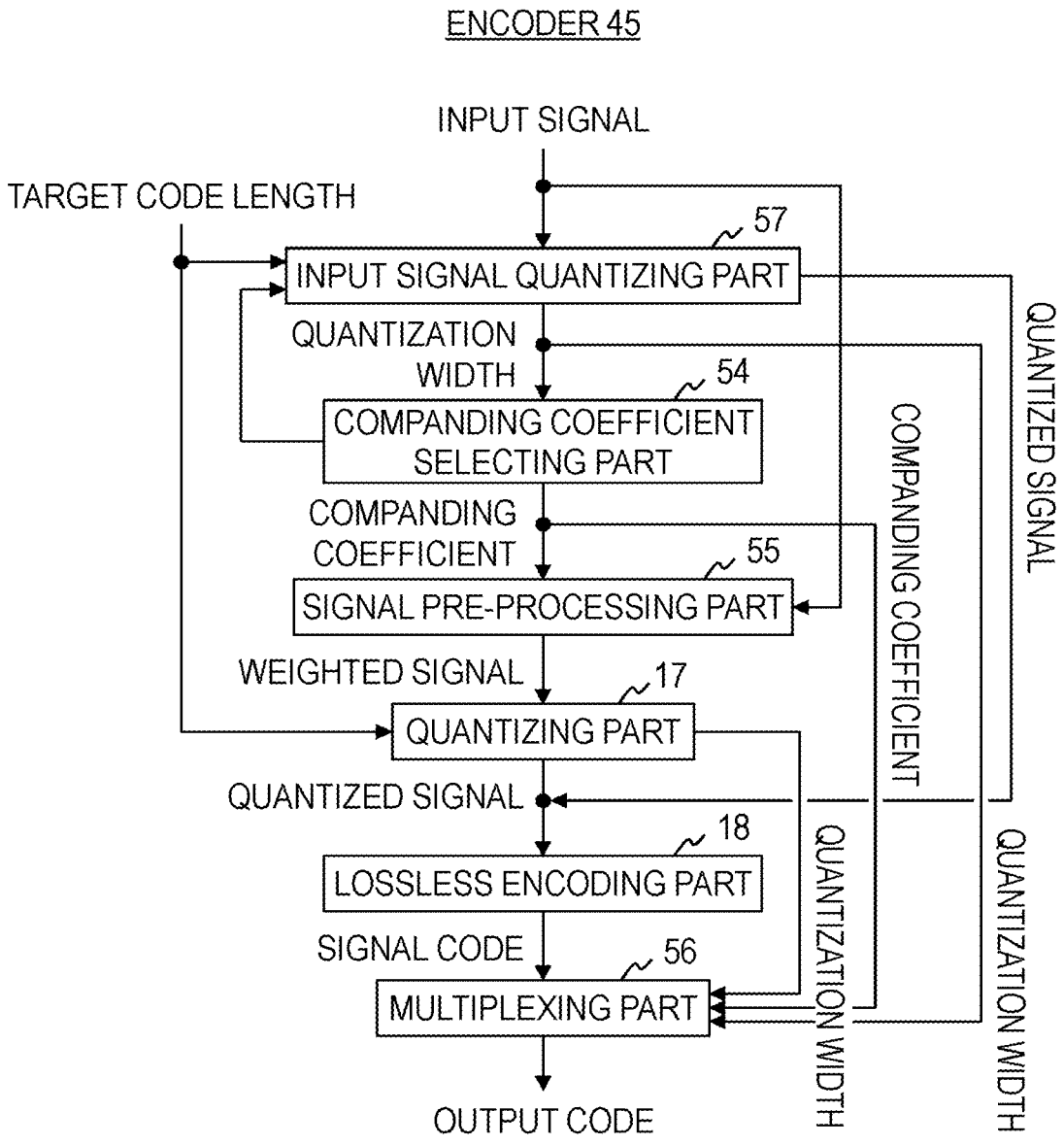
FIG. 43 is a diagram illustrating a functional configuration of an encoder of a modification of the ninth embodiment.
Figure 44:
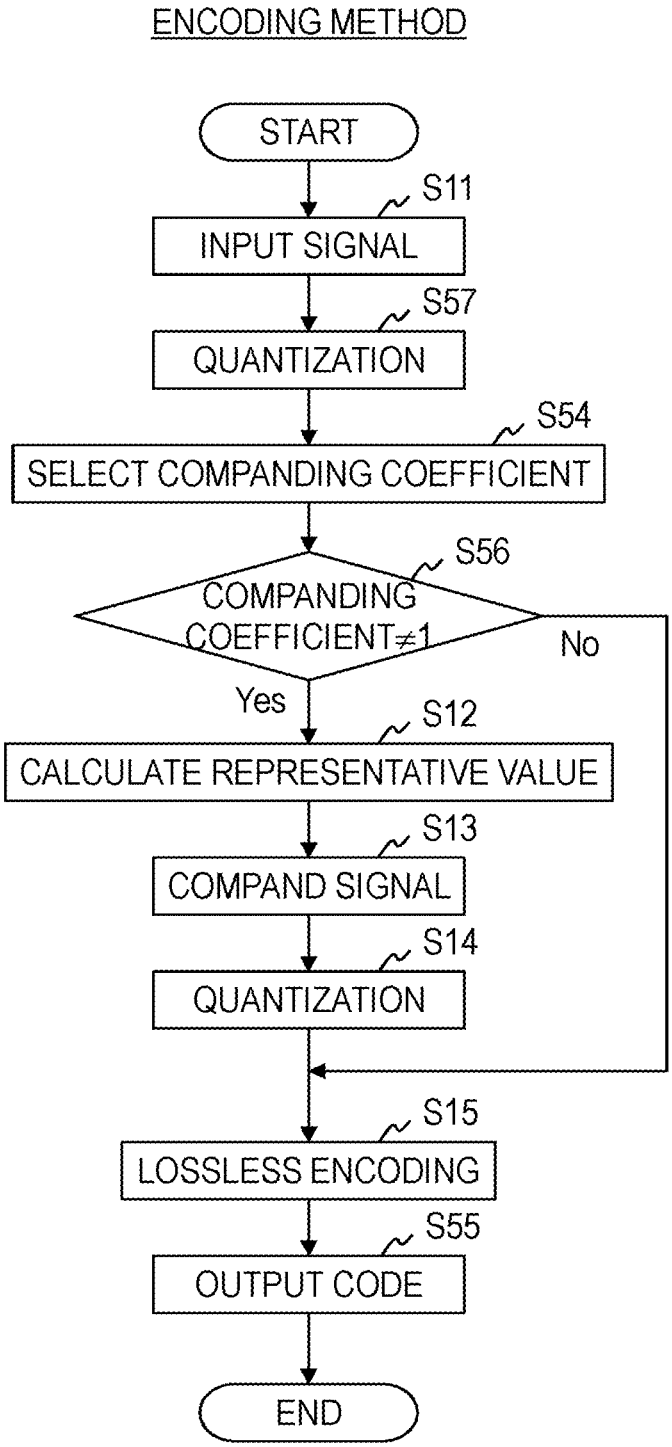
FIG. 44 is a diagram illustrating a process procedure of an encoding method of the modification of the ninth embodiment.

As a modification of the encoder 43 of the ninth embodiment, an example in which an input signal quantizing part 57 is provided instead of the quantization width calculating part 53 will be described. An encoder 45 of the modification of the ninth embodiment includes the input signal quantizing part 57, the companding coefficient selecting part 54, the signal pre-processing part 55, the quantizing part 17, the lossless encoding part 18 and the multiplexing part 56 as shown in FIG. 43. A process procedure of an encoding method executed by the encoder 45 of the modification of the ninth embodiment will be described below with reference to FIG. 44.

At step S11, a time domain acoustic signal $X_k$ (k=0, . . . , N−1) of voice, music or the like is inputted to the encoder 45 in frames. The acoustic signal $X_k$ inputted to the encoder 45 is inputted to the input signal quantizing part 57 first.

[Input Signal Quantizing Part 57]

At step S57, the input signal quantizing part 57 receives the acoustic signal $X_k$ (k=0, . . . , N−1) for each frame and obtains a quantization width for performing scalar quantization of the acoustic signal $X_k$ to meet a target code length and a quantized signal obtained by performing scalar quantization of the acoustic signal $X_k$ with the quantization width. At step S57, for example, similarly to the conventional technique, the input signal quantizing part 57 divides the acoustic signal $X_k$ by a value corresponding to the quantization width and obtains an integer value as the quantized signal. A method for obtaining the quantization width is the same as the method of the quantization width calculating part 53 of the encoder 43. The input signal quantizing part 57 outputs the obtained quantization width to the companding coefficient selecting part 54 and the multiplexing part 56, and the quantized signal to the lossless encoding part 18. Among the above, however, the output of the quantization width to the multiplexing part 56 and the output of the quantized signal to the lossless encoding part 18 are in accordance with control of the companding coefficient selecting part 54.

[Companding Coefficient Selecting Part 54]

Step S54 performed by the companding coefficient selecting part 54 is similar to the step of the encoder 43 of the ninth embodiment.

At step S56, the companding coefficient selecting part 54 performs control to output the companding coefficient γ obtained by selection to the signal pre-processing part 55 if the companding coefficient γ is not 1, and input the quantized signal obtained by the input signal quantizing part 57 to the lossless encoding part 18 and input the quantization width obtained by the input signal quantizing part 57 to the multiplexing part 56 if the companding coefficient γ is 1. Further, the companding coefficient selecting part 54 outputs the companding coefficient γ to the multiplexing part 56.

[Signal Pre-Processing Part 55]

The companding coefficient γ outputted by the companding coefficient selecting part 54 is inputted to the signal pre-processing part 55. The signal pre-processing part 55 receives, for each frame, the acoustic signal $X_k$ (k=0, . . . , N−1) inputted to the encoder 45 only when the companding coefficient γ is not 1, that is, only when specification other than specification of no quasi-instantaneous companding is made, performs a process similar to the process of the signal pre-processing part 11 of the first embodiment for the acoustic signal $X_n$ using the inputted companding coefficient γ, and outputs a weighted signal $Y_k$ (k=0, . . . , N−1) for each frame to the quantizing part 17 (steps S12 and S13).

[Quantizing Part 17]

Step S14 performed by the quantizing part 17 is the same as the step of the encoder 43 of the ninth embodiment. Step S14 is, however, performed only when the companding coefficient γ is not 1, that is, only when specification other than specification of no quasi-instantaneous companding is made.

[Lossless Encoding Part 18 and Multiplexing Part 56]

Step S15 performed by the lossless encoding part 18 and step S55 performed by the multiplexing part 56 are similar to the steps of the encoder 43 of the ninth embodiment.

<<Decoder 44>>

Figure 45:
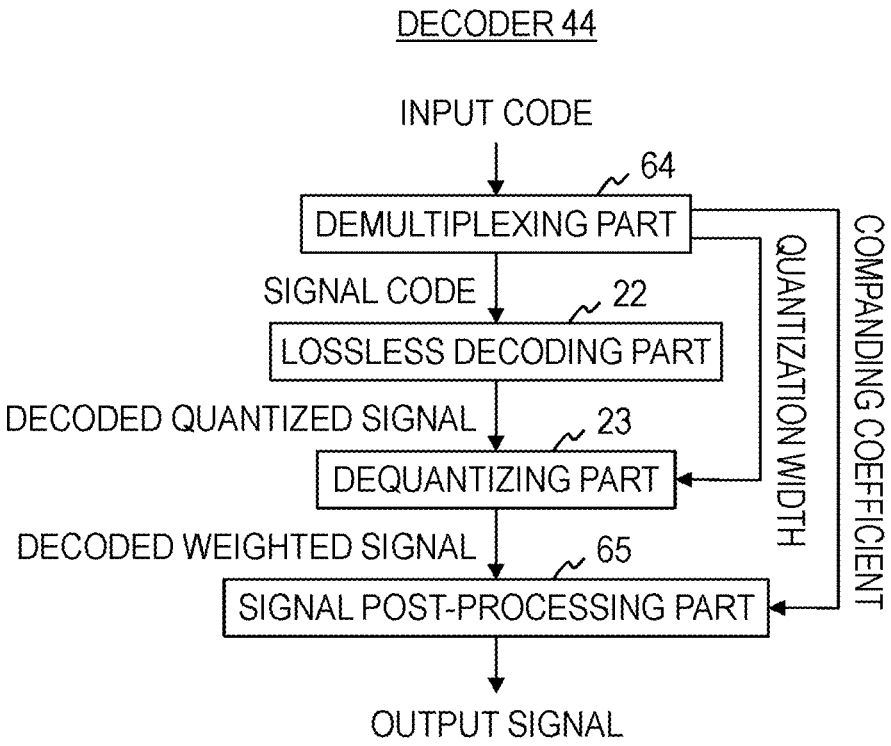
FIG. 45 is a diagram illustrating a functional configuration of a decoder of the ninth embodiment.
Figure 46:
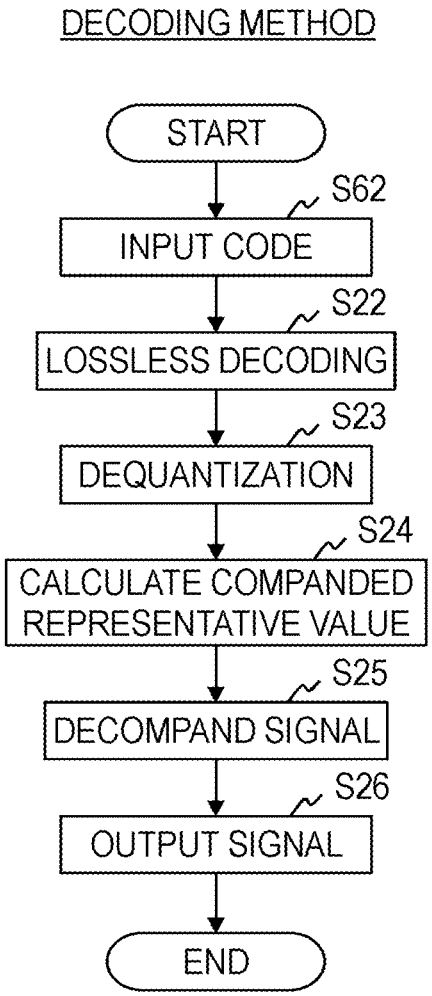
FIG. 46 is a diagram illustrating a process procedure of a decoding method of the ninth embodiment.

As an example of the decoder of the ninth embodiment, the decoder 2 of the first embodiment that has been changed will be described. A decoder 44 of the ninth embodiment includes a demultiplexing part 64, the lossless decoding part 22, the dequantizing part 23 and a signal post-processing part 65 as shown in FIG. 45. A process procedure of a decoding method executed by the decoder 44 of the ninth embodiment will be described below with reference to FIG. 46 below.

[Demultiplexing Part 64]

At step S62, the demultiplexing part 64 receives the code inputted to the decoder 44 and outputs the signal code, the companding coefficient γ corresponding to the companding coefficient code, and the quantization width corresponding to the quantization width code to the lossless decoding part 22, the signal post-processing part 65 and the dequantizing part 23, respectively.

[Lossless Decoding Part 22 and Dequantizing Part 23]

Step S22 performed by the lossless decoding part 22 and step S23 performed by the dequantizing part 23 are similar to the first embodiment.

[Signal Post-Processing Part 65]

The signal post-processing part 65 receives, for each frame, a decoded weighted signal $\hat{X}_k$ (k=0, . . . , N−1) outputted by the dequantizing part 23 and the companding coefficient γ outputted by the demultiplexing part 64, performs a process similar to the process of the signal post-processing part 65 of the first embodiment for the decoded weighted signal $\hat{Y}_k$ using the companding coefficient γ, and obtains and outputs an output signal $\hat{X}_k$ (k=0, . . . , N−1) (steps S24 and S25).

If the companding coefficient γ is 1, the decoded weighted signal $\hat{Y}_k$ and the output signal $\hat{X}_k$ are the same. Therefore, it is also possible to, only when the companding coefficient γ is not 1, that is, only when specification other than no quasi-instantaneous companding is made, perform the process similar to the process of the signal post-processing part 25 of the first embodiment for the decoded weighted signal $\hat{Y}_k$ using the companding coefficient γ to obtain and output the output signal $\hat{X}_k$ (k=0, . . . , N−1), and, in other cases, that is, when the companding coefficient is 1, output the decoded weighted signal $\hat{Y}_k$ (k=0, . . . , N−1) as it is, as the output signal $\hat{X}_k$ (k=0, . . . , N−1).

Tenth Embodiment

The encoder and the decoder of the eighth embodiment can be configured as a signal encoding apparatus and a signal decoding apparatus using the sample sequence converter described in the seventh embodiment.

Figure 47:
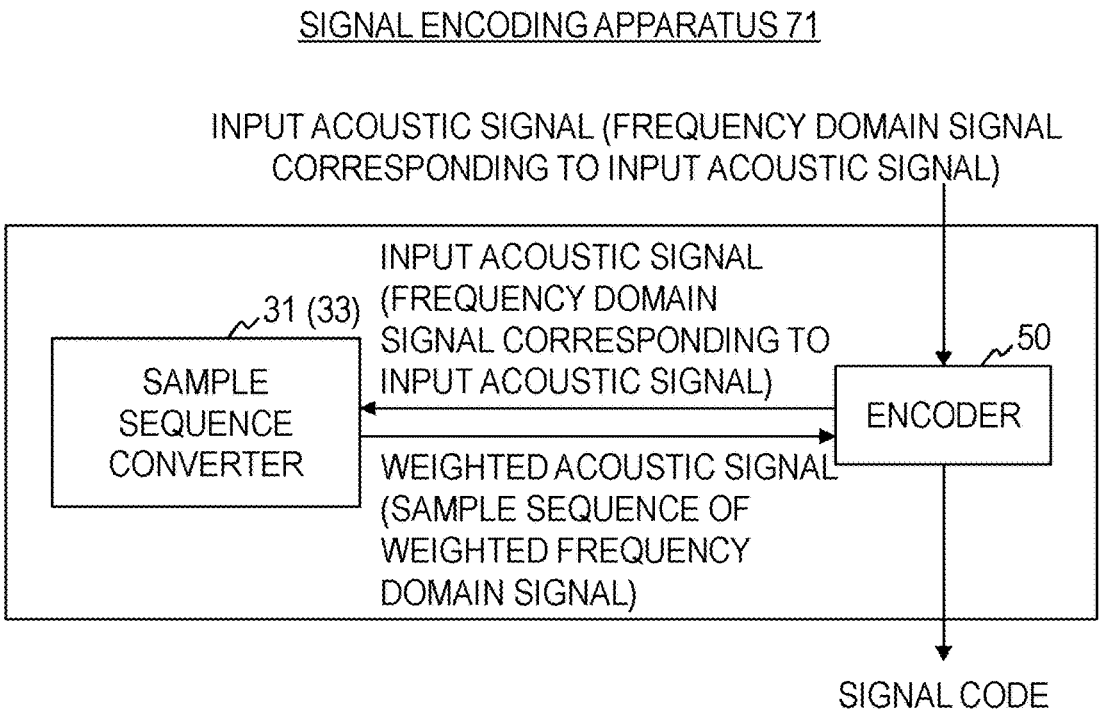
FIG. 47 is a diagram illustrating a functional configuration of a signal encoding apparatus of a tenth embodiment.

The signal encoding apparatus using the sample sequence converter of the seventh embodiment is configured as below. This signal encoding apparatus 71 includes, for example, the sample sequence converter 31 or 33 of the seventh embodiment and an encoder 50 that encodes an encoding target signal to obtain a signal code as shown in FIG. 47. The encoder 50 performs, for example, processes corresponding to the parts other than the signal pre-processing part 51 of the encoder 41 of the eighth embodiment, and the sample sequence converter 31 or 33 performs, for example, the process corresponding to the signal pre-processing part 51 of the encoder 41 of the eighth embodiment. The signal encoding apparatus 71 obtains, for each predetermined time section, a quantization width for encoding an input acoustic signal or a frequency domain signal corresponding to the input acoustic signal with a target code length, by the encoder 50. For such a time section that the obtained quantization width is equal to or smaller than a predetermined threshold, the signal encoding apparatus 71 encodes the input acoustic signal or the frequency domain signal corresponding to the input acoustic signal as an encoding target signal by the encoder 50. For other time sections, the signal encoding apparatus 71 inputs the input acoustic signal or the frequency domain signal corresponding to the input acoustic signal to the sample sequence converter 31 or 33, and encodes a sample sequence of a weighted acoustic signal or a weighted frequency domain signal obtained by the sample sequence converter 31 or 33 by the encoder 50 as an encoding target signal.

Figure 48:
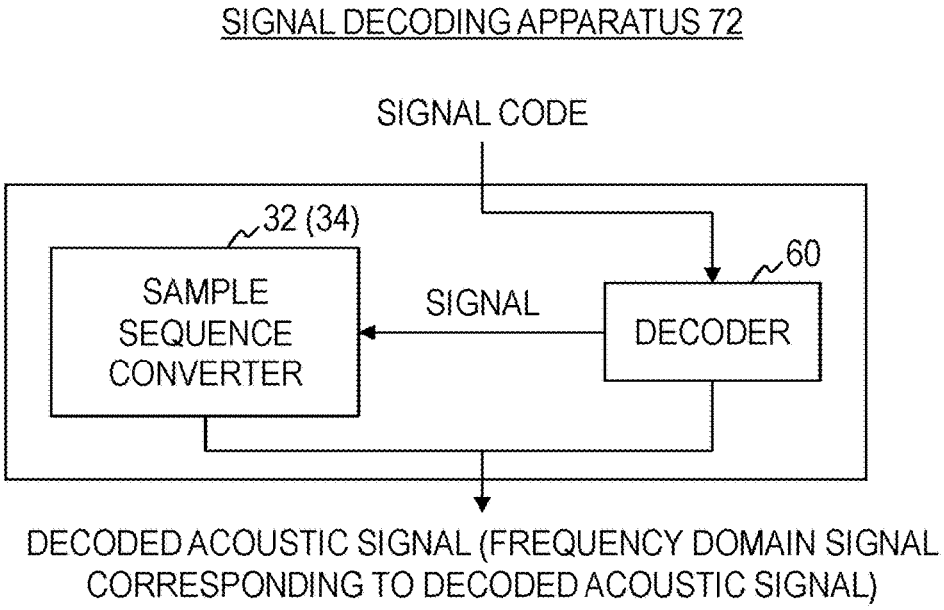
FIG. 48 is a diagram illustrating a functional configuration of a signal decoding apparatus of the tenth embodiment.

The signal decoding apparatus using the sample sequence converter of the seventh embodiment is configured as below. This signal decoding apparatus 72 includes, for example, the sample sequence converter 32 or 34 of the seventh embodiment and a decoder 60 that decodes a signal code to obtain a decoded signal as shown in FIG. 48. The decoder 60 performs, for example, processes corresponding to the parts other than the signal post-processing part 63 of the decoder 42 of the eighth embodiment, and the sample sequence converter 32 or 34 performs, for example, the process corresponding to the signal post-processing part 63 of the decoder 42 of the eighth embodiment. For each of predetermined time sections, the signal decoding apparatus 72 obtains a quantization width by decoding a quantization width code by a decoder 60. For such a time section that the obtained quantization width is equal to or smaller than a predetermined threshold, the signal decoding apparatus 72 obtains a signal obtained by decoding a signal code by the decoder 60 as a decoded acoustic signal or a frequency domain signal corresponding to the decoded acoustic signal, and, for other time sections, obtains the decoded acoustic signal or the frequency domain signal corresponding to the decoded acoustic signal by inputting the signal obtained by the decoder 60 to the sample sequence converter 32 or 34.

Eleventh Embodiment

The way of thinking of the ninth embodiment can be applied to the sample sequence converter 31 or 33 described in the seventh embodiment to configure the sample sequence converter 31 or 33 as a sample sequence converter 37. This sample sequence converter 37 is configured in a manner that the quantization width calculating part described in the ninth embodiment and a companding function selecting part that performs a process for selecting a companding function corresponding to a companding coefficient selected by the companding coefficient selecting part 54 are further included in the sample sequence converter 31 or 33. The quantization width calculating part obtains, for each of predetermined time sections, a quantization width for encoding an input acoustic signal or a frequency domain signal corresponding to the input acoustic signal with a target code length. The companding function selecting part selects, for each of the predetermined time sections, such a companding function that the input acoustic signal and the weighted acoustic signal, or a sample sequence of the frequency domain signal corresponding to the input acoustic signal and a sample sequence of the weighted frequency domain signal are closer to each other as the quantization width is smaller, and/or power of the sample sequence of the weighted acoustic signal or the weighted frequency domain signal is flatter as the quantization width is larger.

<Points of Invention>

Quasi-instantaneous companding can perform transformation having the following two properties without adding auxiliary information. 1. In a frame, a relatively small weight is applied to a large value of a signal or a value of a frequency spectrum of the signal, and a relatively large weight is applied to a small value. 2. In a frame, in the vicinity of a peak of the signal or the frequency spectrum of the signal, a relatively small weight is applied similarly to the peak. Reasons why the above are realized by the above configurations will be described below.

Figure 49:
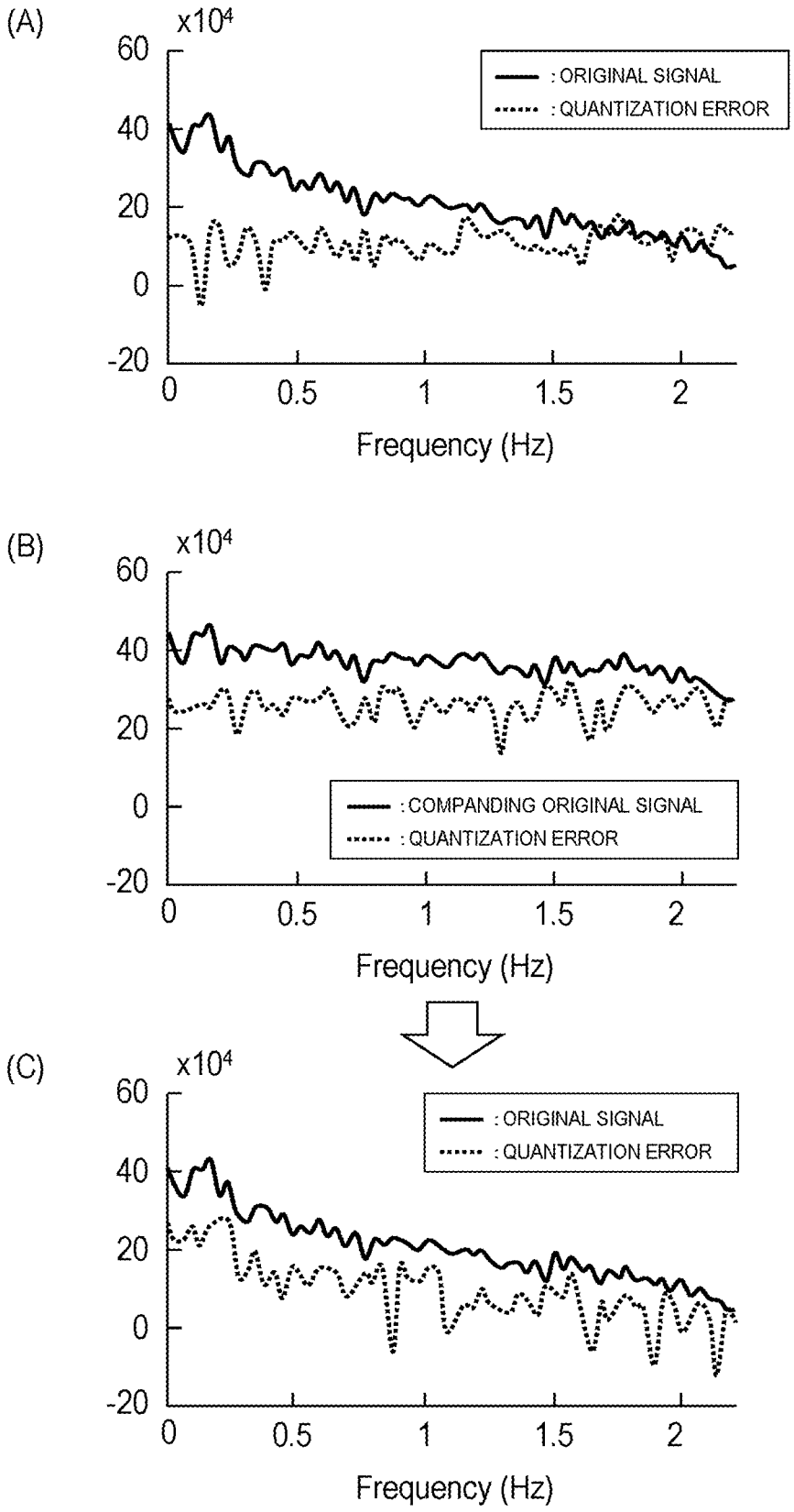
FIG. 49 is a diagram for illustrating a mechanism in which aural quality is enhanced.

First, it will be described that aural quality is enhanced by performing quasi-instantaneous companding from a relationship between an original signal and a quantization error. FIG. 49 (A) shows a quantization error frequency spectrum in the case of performing equal interval quantization of an original signal as it is, in a time domain. In this case, a quantization error with a flat spectrum occurs and causes aural harshness, and the aural quality deteriorates. FIG. 49 (B) shows a quantization error frequency spectrum in the case of performing equal interval quantization of a companded original signal obtained by companding an original signal, in a time domain. It is seen that the companded signal and a quantization error show similar flat spectra. FIG. 49 (C) shows a quantization error frequency spectrum in the case of decompanding the frequency spectrum shown in FIG. 49 (B). In this case, since a quantization error is such that is along an inclination of a spectrum of an original signal, noise is difficult to hear, and the aural quality is enhanced.

In quasi-instantaneous companding, a representative value is determined for each sample in a predetermined section, and constant multiplication is performed for an acoustic signal or a frequency spectrum $X_k$ in the section based on the representative value as below:

$$Y_k = \frac{f(\overline{X}_m)}{\overline{X}_m} X_k (k = M(m-1), \ldots, Mm-1) \tag{27}$$

Here, when the companding function f(x) is, for example, a logarithmic function, and the way of deciding the representative value is a root mean square, then the transformation corresponds to constant multiplication by a small value for a section with a high energy and constant multiplication by a large value for a section with a low energy. Therefore, as the number of large samples increases, the section is compressed more by transformation, and, as the number of small values increases, the section is decompressed more by transformation. For a similar reason, a sample value in the vicinity of a large sample value is compressed by transformation more than a sample value in the vicinity of a small sample value.

Since only the value of a weighted signal or a weighted frequency spectrum $Y_k$ generated by the above transformation is transmitted to the decoder, the value of the representative value $\overline{X}_m$ is not determined by a general way of determination, and it is not possible to perform inverse transformation.

$$g(\{x_i\}_{i=0,\ldots M-1})\ (>0)$$

However, if the function to determine the representative value shown above satisfies first-degree positive homogeneity like absolute average, $$\overline{X}_m = g(\{X_k\}_{k=M(m-1)}^{Mm-1})$$

(that is, a function g shown above satisfies the following for an arbitrary $\alpha(>0)$.)

$$g(\{\alpha x_i\}_{i=0}^{M-1}) = \alpha g(\{x_i\}_{i=0}^{M-1})$$

when a representative value is similarly determined from the value of $Y_k$, a companded representative value is obtained as shown below.

$$\begin{aligned}
\overline{Y}_m &= g(\{Y_k\}_{k=M(m-1)}^{Mm-1}) \\
&= g\left(\left\{\frac{f(\overline{X}_m)}{\overline{X}_m} X_k\right\}_{k=M(m-1)}^{Mm-1}\right) \\
&= \frac{f(\overline{X}_m)}{\overline{X}_m} g(\{X_k\}_{k=M(m-1)}^{Mm-1}) \\
&= \frac{f(\overline{X}_m)}{\overline{X}_m} \overline{X}_m \\
&= f(\overline{X}_m)
\end{aligned}$$

By converting the companded representative value with an inverse function as below, $$f^{-1}(\overline{Y}_m) = f^{-1}(f(\overline{X}_m)) = \overline{X}_m$$

the original representative value can be determined in the decoder, too. By performing inverse transformation based on the value as below, $$\frac{f^{-1}(\overline{Y}_m)}{\overline{Y}_m}Y_k = \frac{\overline{X}_m}{f(\overline{X}_m)}Y_k = \frac{\overline{X}_m}{f(\overline{X}_m)}\frac{f(\overline{X}_m)}{\overline{X}_m}X_k = X_k(k = M(m-1), \ldots, Mm-1)$$

the original representative value can be determined without using auxiliary information.

Of course, if $Y_k$ that has been companded is quantized during the process, and an error occurs, then the original representative value is not correctly determined. However, by performing a process similar to the above for $Y_k$ that has been companded, an estimated value of the representative value $\overline{X}_m$ can be calculated, and inverse transformation can be performed based on the value.

[Effects of Invention]

By making a configuration as described above, it is possible to, according to the present invention, perform weighting appropriate for aural characteristics according to a voice/acoustic signal to improve efficiency of lossy compression encoding without adding auxiliary. Further, according to the configuration of the fifth embodiment, it is possible to realize weighting more appropriate for aural characteristics by setting sections used for quasi-instantaneous companding finely for low frequencies and roughly for high frequencies. Further, according to the configuration of the sixth embodiment, it is possible to realize more complicated companding to improve efficiency of weighting by using different quasi-instantaneous companding a plurality of times.

The embodiments of the present invention have been described above. Specific configurations are, however, not limited to the embodiments. Even if design changes and the like are appropriately made within a range not departing from the spirit of the present invention, it goes without saying that the design changes and the like are included in the present invention.

[Program and Recording Medium]

In the case of realizing various processing functions of each of the apparatuses described in the above embodiments by a computer, processing content of the functions each apparatus should have are written by a program. By executing the program on the computer, the various processing functions of each of the apparatuses are realized on the computer.

The program in which the processing content is written can be recorded in a computer-readable recording medium. As the computer-readable recording medium, any recording medium, for example, a magnetic recording device, an optical disk, a magneto-optical recording medium, a semiconductor memory or the like is possible.

Distribution of the program is performed, for example, by selling, transferring or lending of a portable recording medium such as a DVD and a CD-ROM in which the program is recorded. Furthermore, a configuration is also possible in which the program is stored in a storage device of a server computer and distributed by transferring the program from the server computer to the other computers via a network.

For example, the computer that executes such a program stores the program recorded in the portable recording medium or transferred from the server computer into its own storage device once. Then, at the time of executing a process, the computer reads the program stored in its own recording medium and executes the process according to the program. As another form of executing the program, the computer may directly read the program from the portable recording medium and execute the process according to the program. Furthermore, each time the program is transferred to the computer from the server computer, the computer may execute a process according to the received program. A configuration is also possible in which, the program is not transferred to the computer from the server computer, but the above process is executed by a so-called ASP (Application Service Provider) type service that realizes processing functions only by an instruction to execute the program and acquisition of a result. It is assumed that the program in the present embodiments includes information to be provided for processing by an electronic calculator and is equivalent to a program (data and the like that are not direct commands to a computer but have a nature of specifying a process by the computer).

Though it is assumed in the present embodiments that the present apparatuses are configured by causing a predetermined program to be executed on a computer, at least a part of the processing content may be realized by hardware.

What is claimed is:

1. A sample sequence conversion device that obtains a weighted frequency domain signal obtained by converting a frequency domain signal corresponding to an input acoustic signal, the weighted frequency domain signal being to be inputted to an encoder encoding the weighted frequency domain signal, or a weighted frequency domain signal corresponding to a weighted time domain signal corresponding to the weighted frequency domain signal obtained by converting the frequency domain signal corresponding to the input acoustic signal, the weighted time domain signal being to be inputted to an encoder encoding the weighted time domain signal, the sample sequence conversion device comprising:

processing circuitry configured to calculate, for each frequency section by a plurality of samples fewer than the number of frequency samples of a sample sequence of the frequency domain signal corresponding to the input acoustic signal, from the sample sequence of the frequency domain signal, a representative value of the frequency section from sample values of samples included in the frequency section, for each of predetermined time sections; and obtain, for each of the predetermined time sections, a frequency domain sample sequence obtained by multiplying a weight according to a function value of the representative value by a companding function for which an inverse function can be defined and each of the samples corresponding to the representative value in the sample sequence of the frequency domain signal, as a sample sequence of the weighted frequency domain signal.

2. A sample sequence conversion device that obtains a frequency domain signal corresponding to a decoded acoustic signal from a weighted frequency domain signal obtained by a decoder or a weighted frequency domain signal corresponding to the weighted time domain signal obtained by the decoder, the sample sequence conversion device comprising:

processing circuitry configured to calculate, for each frequency section by a plurality of samples fewer than the number of frequency samples of a sample sequence of the weighted frequency domain signal, from the sample sequence of the weighted frequency domain signal, a representative value of the frequency section from sample values of samples included in the frequency section, for each of predetermined time sections; and obtain, for each of the predetermined time sections, a frequency domain sample sequence obtained by multiplying a weight according to a function value of the representative value by a companding function for which an inverse function can be defined and each of the samples corresponding to the representative value in the sample sequence of the weighted frequency domain signal, as a sample sequence of the frequency domain signal corresponding to the decoded acoustic signal.

3. A sample sequence conversionn device that obtains a weighted acoustic signal obtained by converting an input acoustic signal, the weighted acoustic signal being to be inputted to an encoder encoding the weighted acoustic signal, or a weighted acoustic signal corresponding to a weighted frequency domain signal corresponding to the weighted acoustic signal obtained by converting the input acoustic signal, the weighted frequency domain signal being to be inputted to an encoder encoding the weighted frequency domain signal, the sample sequence conversion device comprising: processing circuitry configured to calculate part calculating, for each time section by a plurality of samples fewer than the number of samples of a sample sequence of the input acoustic signal in a time domain, from the sample sequence of the input acoustic signal, a representative value of the time section from sample values of samples included in the time section, for each of predetermined time sections; and obtain, for each of the predetermined time sections, a time domain sample sequence obtained by multiplying a weight according to a function value of the representative value by a companding function for which an inverse function can be defined and each of the samples corresponding to the representative value in the sample sequence of the input acoustic signal, as a sample sequence of the weighted acoustic signal.

4. A sample sequence conversion device that obtains a decoded acoustic signal from a weighted acoustic signal in a time domain obtained by a decoder or a weighted acoustic signal in the time domain corresponding to a weighted acoustic signal in a frequency domain obtained by the decoder, the sample sequence conversion device comprising:

process circuiyry configured to calculate, for each time section by a plurality of samples fewer than the number of samples of a sample sequence of the weighted acoustic signal in the time domain, from the sample sequence of the weighted acoustic signal, a representative value of the time section from sample values of samples included in the time section, for each of predetermined time sections; and obtain, for each of the predetermined time sections, a time domain sample sequence obtained by multiplying a weight according to a function value of the representative value by a companding function for which an inverse function can be defined and each of the samples corresponding to the representative value in the sample sequence of the weighted acoustic signal, as a sample sequence of the decoded acoustic signal.

5. The sample sequence conversion device according to claim 1 or 2, wherein the frequency section by the plurality of samples are set so that the number of included samples is smaller for a frequency section corresponding to a lower frequency and is larger for a frequency section corresponding to a higher frequency.

6. The sample sequence conversion device according to any one of claims 1 to 4, wherein calculation of the representative value for each section by the plurality of samples and multiplication of the weight according to the function value of the calculated representative value and each of the samples of the sample sequence are repeatedly executed a predetermined number of times.

7. The sample sequence conversion device according to claim 1 or 3, wherein the processing circuitry is further configured to obtain, for each of the predetermined time sections, a quantization width for encoding the input acoustic signal or the frequency domain signal corresponding to the input acoustic signal with a target code length; and select, for each of the predetermined time sections, such a companding function that the input acoustic signal and the weighted acoustic signal, or the sample sequence of the frequency domain signal corresponding to the input acoustic signal and the sample sequence of the weighted frequency domain signal are closer to each other as the quantization width is smaller, and/or power of the sample sequence of the weighted acoustic signal or the weighted frequency domain signal is flatter as the quantization width is larger.

8. A signal encoding apparatus comprising the sample sequence conversion device according to claim 1 or 3 and an encoder obtaining a signal code by encoding an encoding target signal, wherein for each of the predetermined time sections, a quantization width for encoding an input acoustic signal or a frequency domain signal corresponding to the input acoustic signal with a target code length is obtained;

for such a time section that the obtained quantization width is equal to or smaller than a predetermined threshold, the input acoustic signal or the frequency domain signal corresponding to the input acoustic signal is encoded by the encoder as the encoding target signal; and for other time sections, the input acoustic signal or the frequency domain signal corresponding to the input acoustic signal is inputted to the sample sequence conversion device, and a sample sequence of the weighted acoustic signal or the weighted frequency domain signal obtained by the sample sequence converter is encoded by the encoder as the encoding target signal.

9. A signal decoding apparatus comprising the sample sequence conversion device according to claim 2 or 4 and a decoder obtaining a decoded signal by decoding a signal code, wherein for each of the predetermined time sections, a quantization width is obtained by decoding a quantization width code;

for such a time section that the obtained quantization width is equal to or smaller than a predetermined threshold, the signal obtained by decoding the signal code by the decoder is obtained as the decoded acoustic signal or a frequency domain signal corresponding to the decoded acoustic signal; and for other time sections, the decoded acoustic signal or the frequency domain signal corresponding to the decoded acoustic signal is obtained by inputting the signal obtained by the decoder to the sample sequence conversion device.

10. A sample sequence converting method for obtaining a weighted frequency domain signal obtained by converting a frequency domain signal corresponding to an input acoustic signal, the weighted frequency domain signal being to be inputted to an encoding method for encoding the weighted frequency domain signal, or a weighted frequency domain signal corresponding to a weighted time domain signal corresponding to the weighted frequency domain signal obtained by converting the frequency domain signal corresponding to the input acoustic signal, the weighted time domain signal being to be inputted to an encoding method for encoding the weighted time domain signal, the sample sequence converting method comprising:

a representative value calculating step of calculating, for each frequency section by a plurality of samples fewer than the number of frequency samples of a sample sequence of the frequency domain signal corresponding to the input acoustic signal, from the sample sequence of the frequency domain signal, a representative value of the frequency section from sample values of samples included in the frequency section, for each of predetermined time sections; and a signal companding step of obtaining, for each of the predetermined time sections, a frequency domain sample sequence obtained by multiplying a weight according to a function value of the representative value by a companding function for which an inverse function can be defined and each of the samples corresponding to the representative value in the sample sequence of the frequency domain signal, as a sample sequence of the weighted frequency domain signal.

11. A sample sequence converting method for obtaining a frequency domain signal corresponding to a decoded acoustic signal from a weighted frequency domain signal obtained by decoding or a weighted frequency domain signal corresponding to the weighted time domain signal obtained by decoding, the sample sequence converting method comprising:

a companded representative value calculating step of calculating, for each frequency section by a plurality of samples fewer than the number of frequency samples of a sample sequence of the weighted frequency domain signal, from the sample sequence of the weighted frequency domain signal, a representative value of the frequency section from sample values of samples included in the frequency section, for each of predetermined time sections; and a signal decompanding step of obtaining, for each of the predetermined time sections, a frequency domain sample sequence obtained by multiplying a weight according to a function value of the representative value by a companding function for which an inverse function can be defined and each of the samples corresponding to the representative value in the sample sequence of the weighted frequency domain signal, as a sample sequence of the frequency domain signal corresponding to the decoded acoustic signal.

12. A sample sequence converting method for obtaining a weighted acoustic signal obtained by converting an input acoustic signal, the weighted acoustic signal being to be inputted to an encoding method for encoding the weighted acoustic signal, or a weighted acoustic signal corresponding to a weighted frequency domain signal corresponding to the weighted acoustic signal obtained by converting the input acoustic signal, the weighted frequency domain signal being to be inputted to an encoding method for encoding the weighted frequency domain signal, the sample sequence converting method comprising:

a representative value calculating step of calculating, for each time section by a plurality of samples fewer than the number of samples of a sample sequence of the input acoustic signal in a time domain, from the sample sequence of the input acoustic signal, a representative value of the time section from sample values of samples included in the time section, for each of predetermined time sections; and a signal companding step for obtaining, for each of the predetermined time sections, a time domain sample sequence obtained by multiplying a weight according to a function value of the representative value by a companding function for which an inverse function can be defined and each of the samples corresponding to the representative value in the sample sequence of the input acoustic signal, as a sample sequence of the weighted acoustic signal.

13. A sample sequence converting method for obtaining a decoded acoustic signal from a weighted acoustic signal in a time domain obtained by decoding or a weighted acoustic signal in the time domain corresponding to a weighted acoustic signal in a frequency domain obtained by decoding, the sample sequence converting method comprising:

a companded representative value calculating step of calculating, for each time section by a plurality of samples fewer than the number of samples of a sample sequence of the weighted acoustic signal in the time domain, from the sample sequence of the weighted acoustic signal, a representative value of the time section from sample values of samples included in the time section, for each of predetermined time sections; and a signal decompanding step of obtaining, for each of the predetermined time sections, a time domain sample sequence obtained by multiplying a weight according to a function value of the representative value by a companding function for which an inverse function can be defined and each of the samples corresponding to the representative value in the sample sequence of the weighted acoustic signal, as a sample sequence of the decoded acoustic signal.

14. The sample sequence converting method according to claim 10 or 12, further comprising:

a quantization width calculating step of obtaining, for each of the predetermined time sections, a quantization width for encoding the input acoustic signal or the frequency domain signal corresponding to the input acoustic signal with a target code length; and a companding function selecting step of selecting, for each of the predetermined time sections, such a companding function that the input acoustic signal and the weighted acoustic signal, or the sample sequence of the frequency domain signal corresponding to the input acoustic signal and the sample sequence of the weighted frequency domain signal are closer to each other as the quantization width is smaller, and/or power of the sample sequence of the weighted acoustic signal or the weighted frequency domain signal is flatter as the quantization width is larger.

15. A signal encoding method comprising the sample sequence converting method according to claim 10 or 12 and an encoding method for obtaining a signal code by encoding an encoding target signal, wherein for each of the predetermined time sections, a quantization width for encoding an input acoustic signal or a frequency domain signal corresponding to the input acoustic signal with a target code length is obtained;

for such a time section that the obtained quantization width is equal to or smaller than a predetermined threshold, the input acoustic signal or the frequency domain signal corresponding to the input acoustic signal is encoded by the encoding method as the encoding target signal; and for other time sections, the input acoustic signal or the frequency domain signal corresponding to the input acoustic signal is inputted to the sample sequence converting method, and a sample sequence of the weighted acoustic signal or the weighted frequency domain signal obtained by the sample sequence converting method is encoded by the encoding method as the encoding target signal.

16. A signal decoding method comprising the sample sequence converting method according to claim 11 or 13 and a decoding method for obtaining a decoded signal by decoding a signal code, wherein for each of the predetermined time sections, a quantization width is obtained by decoding a quantization width code;

for such a time section that the obtained quantization width is equal to or smaller than a predetermined threshold, the signal obtained by decoding the signal code by the decoding method is obtained as the decoded acoustic signal or a frequency domain signal corresponding to the decoded acoustic signal; and for other time sections, the decoded acoustic signal or the frequency domain signal corresponding to the decoded acoustic signal is obtained by inputting the signal obtained by the decoding method to the sample sequence converting method.

17. A program for causing a computer to function as the sample sequence conversion device according to any one of claims 1 to 4.

18. A non-transitory computer-readable recording medium having a program recorded thereon for causing a computer to function as the sample sequence conversion device according to any one of claims 1 to 4.

* * * * *